US011450999B2

(12) United States Patent
SooHoo et al.

(10) Patent No.: US 11,450,999 B2
(45) Date of Patent: Sep. 20, 2022

(54) SEPARABLE ARTICULATING POWER AND DATA INTERFACE

(71) Applicant: Apple Inc., Cupertino, CA (US)

(72) Inventors: Eric T. SooHoo, Sunnyvale, CA (US); Mahmoud R. Amini, Sunnyvale, CA (US); Daniel R. Bloom, Alameda, CA (US); Sean T. McIntosh, Cupertino, CA (US); Tian Shi Li, Campbell, CA (US); Jared M. Kole, San Francisco, CA (US); Jason Joseph LeBlanc, Castro Valley, CA (US); Colin M. Ely, Sunnyvale, CA (US); Peter J. Cameron, Scotts Valley, CA (US); Michael A. Kinney, San Francisco, CA (US); Eric S. Jol, San Jose, CA (US); Edward Siahaan, San Francisco, CA (US); Robert D. Zupke, San Jose, CA (US); Rohan Gupta, Union City, CA (US); Jordan J. Francis, Irvine, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/023,013

(22) Filed: Sep. 16, 2020

(65) Prior Publication Data

US 2022/0085560 A1 Mar. 17, 2022

(51) Int. Cl.

| | |
|---|---|
| ***H01R 39/12*** | (2006.01) |
| ***H01R 12/61*** | (2011.01) |
| ***H01R 12/77*** | (2011.01) |
| ***H01R 13/422*** | (2006.01) |

(52) U.S. Cl.
CPC ..... *H01R 39/12* (2013.01); *H01R 12/613* (2013.01); *H01R 12/774* (2013.01); *H01R 13/422* (2013.01)

(58) Field of Classification Search
None
See application file for complete search history.

(56) References Cited

U.S. PATENT DOCUMENTS

| | | | | |
|---|---|---|---|---|
| 6,283,796 | B1 * | 9/2001 | Yeh | H01R 13/645 439/676 |
| 2005/0234521 | A1 * | 10/2005 | Balsells | A61N 1/3752 607/37 |
| 2010/0279558 | A1 * | 11/2010 | Leon | H01R 13/2421 439/817 |

(Continued)

*Primary Examiner* — Ross N Gushi
(74) *Attorney, Agent, or Firm* — Kilpatrick Townsend & Stockton, LLP

(57) ABSTRACT

Connector inserts and connector receptacles that have a small form factor and where when a connector insert and connector receptacle are mated, the connector insert can rotate and articulate relative to an electronic device housing the connector receptacle. The connector receptacle can be connected to components in the electronic device through a flexible circuit board having an amount of slack or excess length to allow the connector receptacle and the connector insert to rotate relative to the connected components. A bearing supporting the connector receptacle can articulate about an axis to allow the connector receptacle and connector insert to articulate relative to the connected components. The bearing can further support a locking mechanism to lock the connector insert in place in the connector receptacle.

19 Claims, 41 Drawing Sheets

(56) References Cited

U.S. PATENT DOCUMENTS

| | | | | |
|---|---|---|---|---|
| 2011/0207360 | A1* | 8/2011 | Jordan | H01R 13/65912 439/350 |
| 2018/0138633 | A1* | 5/2018 | DeWitt | H01R 13/6277 |
| 2019/0190187 | A1* | 6/2019 | Fukazawa | H01R 24/84 |

* cited by examiner

2700

SEPARABLE ARTICULATING POWER AND DATA INTERFACE

BACKGROUND

The number and types of electronic devices available to consumers have increased tremendously the past few years and this increase shows no signs of abating. Devices such as portable computing devices, tablets, desktops, all-in-one computers, smart phones, storage devices, portable media players, navigation systems, monitors, and other devices have become ubiquitous.

These electronic devices can transfer power and data using cables or other structures that can have connector inserts on each end. The connector inserts can plug into connector receptacles on electronic devices, thereby forming one or more conductive paths for power, data, or both power and data.

But these connector inserts and connector receptacles can be relatively large. A sizeable connector receptacle can consume an undesirably large space in an electronic device housing the connector receptacle. This can reduce the functionality that can be provided by the electronic device, it can increase the size of the electronic device, or a combination of both.

The connection between a connector insert and an electronic device can undergo various forces during use. The connector insert can be twisted, turned, or bent relative to the device enclosure. This can cause the connector insert and connector receptacle to disconnect from each other. In some circumstances, it can cause either or both the connector insert and connector receptacle to be damaged. But in some systems, it can be useful for the connector insert to be able to move relative to the electronic device housing the connector receptacle. That is, it can be desirable that the connector insert and a connector receptacle in the electronic device be connected throughout these movements.

Thus, what is needed are connector inserts and connector receptacles that have a small form factor and where after a connector insert and connector receptacle are mated, the connector insert can move relative to an electronic device housing the connector receptacle.

SUMMARY

Accordingly, embodiments of the present invention can provide connector inserts and connector receptacles that have a small form factor and where after a connector insert and connector receptacle are mated, the connector insert can rotate and articulate relative to an electronic device housing the connector receptacle.

An illustrative embodiment of the present invention can provide connector inserts and connector receptacles that have a small form factor. The connector inserts can be reduced in size by limiting a number of contacts that they have. For example, a number of contacts can be reduced by combining data and power. Data and power signals can be combined and transmitted or received using contacts on the connector inserts. The connector insert can further be reduced in size by utilizing a connector tongue as the connector insert. In these and other embodiments of the present invention, a connector insert can be formed as a tongue having a top side and a bottom side. Two contacts can be located on each of the top and bottom sides. These two contacts can each convey a differential signal. A power supply, ground, or both can be combined with either or both of these differential signals. A ground ring to convey a ground and to provide shielding can be located or formed around a front and sides of the tongue.

The connector receptacles can be reduced in size by employing contacts that wrap over (or under) themselves in a space-saving configuration. For example, a connector receptacle can have two contacts having contacting portions in a top of an opening in a housing and two contacts having contacting portions in a bottom of an opening in a housing, where the contacting portions can physically and electrically connect to contacts on the connector insert tongue. These contacts can have contact tails that wrap underneath the contacting portions. The contact tails can include through-hole portions to be inserted into and soldered to holes in a board, posts for connecting to wires, or surface mount portions to be soldered to contacts on a board, where the board can be a flexible circuit board, printed circuit board, or other appropriate substrate. The contacts can further include barbs that can be inserted in a housing of the connector receptacle. These barbs can extend laterally from the contacting portions to further save space.

An illustrative embodiment of the present invention can provide connector inserts and connector receptacles for electronic devices, where when a connector insert and connector receptacle are mated, the connector insert and connector receptacle can rotate together about an axis relative to an electronic device housing the connector receptacle. The connector receptacle can be a portion of a connector receptacle assembly that can be located in the electronic device. The connector receptacle assembly can also include a front housing attached to the connector receptacle, where the front housing can have an opening for the connector insert. The opening in the front housing can be at a surface of a device enclosure that at least partially houses the electronic device. The front housing can ride on a ring or bearing, where the ring or bearing is fixed in this rotational direction. The front housing can rotate in the bearing, thereby allowing the connector receptacle assembly to rotate relative to the device enclosure through a rotation angle. The rotation angle can be plus and minus 180 degrees, plus and minus 120 degrees, plus and minus 90 degrees, plus and minus 45 degrees, or it can have another magnitude. Also, the magnitude can be different for each direction of rotation.

In order to maintain a connection between the rotating connector receptacle and nonrotating portions of the connector receptacle assembly, a flexible circuit board can be used to connect the connector receptacle to other portions of the connector receptacle assembly. One example can provide a connector receptacle having contacts, where each contact has a contacting portion at a first end and a post at a second end, and where the posts are connected to a first end of a flexible circuit board. A second end of the flexible circuit board might remain fixed while the connector receptacle rotates. The flexible circuit board can include an excess length or slack that can form a loop between the first end and the second end of the flexible circuit board. This slack can allow the first end of the flexible circuit board to rotate with the connector receptacle while maintaining a connection to other portions of the connector receptacle assembly via the second end of the flexible circuit board.

These and other embodiments of the present invention can provide connector inserts and connector receptacles for electronic devices, where when a connector insert and connector receptacle are mated, the connector insert and connector receptacle can articulate together in a plane relative the electronic device. The bearing that supports the front housing can pivot about a pivot axis, thereby allowing the front housing, the attached connector receptacle and other portions of the connector receptacle assembly, as well as the connector insert, to articulate through a plane defined by the pivot axis of the bearing. This articulation can have various magnitudes. The articulation can be in one or more directions, and it can be through articulation angles of 10 degrees, 15 degrees, 20 degrees, 25 degrees, 35 degrees, 45 degrees, or other angle. The articulation can be in one direction or two opposing directions, and the magnitude of possible articulation can be different in each direction.

In order to maintain a connection between the articulating connector receptacle assembly and circuits and components in the electronic device, a junction box can be used to connect first wires that are connected to contacts on the second end of the flexible circuit board to second wires that connect to circuits and components in the electronic device. The junction box can either be fixed relative to the device enclosure or the junction box can articulate with other portions of the connector receptacle assembly.

These and other embodiments of the present invention can provide connector inserts and connector receptacles for electronic devices, where when a connector insert and connector receptacle are mated, the connector insert can both rotate about an axis and articulate in a plane relative the electronic device. In these and other embodiments of the present invention, the connector insert and connector receptacle can rotate about an axis and articulate through a plane together relative to the electronic device. This flexibility can be provided by using both the flexible circuit board and junction box as described above. This flexibility can be particularly advantageous in electronic devices such as audio headphones. Connector inserts can be located at each end of a headband, where the connector inserts are each inserted into a connector receptacle in a corresponding earcup. The rotation and articulation provided by an embodiment of the present invention can allow the two earcups to be comfortably positioned against sides of a listener's head.

In some circumstances, it can be disadvantageous for a connector insert to be able to easily disconnect from a connector receptacle. To guard against an inadvertent disconnection, these and other embodiments of the present invention can provide a locking mechanism to secure a connector insert in place in a connector receptacle assembly. For example, a connector receptacle assembly can include a locking mechanism that locks a connector insert in place when the connector insert is inserted into the connector receptacle assembly. The connector insert can have a sliding or otherwise movable control mechanism that can be actuated to effect a release of the connector insert from the connector receptacle assembly.

These and other embodiments of the present invention can provide other locking mechanisms where a locking mechanism locks a connector insert in place when the connector insert is inserted into the connector receptacle assembly. To release the connector insert, the connector insert can be rotated beyond an expected range (overturned) whereupon the connector insert can be released.

These and other embodiments of the present invention can provide other locking mechanisms where a locking mechanism uses a locking mechanism to lock a connector insert in place when the connector insert is inserted into the connector receptacle assembly. To release the connector insert, a sliding mechanism can be actuated to move the locking mechanism, whereupon the connector insert can be released. These locking mechanisms can be particularly useful in devices such as audio headphones. For example, a locking mechanism can prevent an inadvertent disconnection between a headband and an earcup of the audio headphones, which could otherwise be caused by a listener's activity, such as running or working out.

These and other embodiments of the present invention can provide connector structures that can be implemented in both a connector receptacle and a connector insert. This dual utilization can reduce tooling and design costs since one contact structure can be used for both a connector insert and a corresponding connector receptacle. These connector structures can be symmetrical or otherwise configured such that two such structures can mate when they are placed in opposition and one structure is rotated relative to the other, for example by 90 degree, 180 degrees, or other angle.

The contacts of these dual-use connector structures can have various configurations. Contacts in a connector can mate with corresponding contacts in a corresponding connector, where the contacts and corresponding contacts have mating features such that they form an electrical connection when the connector and corresponding connector are mated. These mating features can be interlocking features, mating surface features, or other features that provide an electrical connection between contacts. For example, contacts formed as pins or prongs in a connector can mate by interlocking with forked contacts in a corresponding connector. In another example, contacts formed as pins or prongs in a connector can mate with contacts having recessed surfaces in corresponding connector.

These different contacts can be symmetrically located in connector structures that are used in both a connector insert and a connector receptacle. The different contacts can be arranged in an alternating fashion in an array, radially, or in another configuration. For example, a connector structure can have contacts in a two-by-two array or radial configuration, where contacts having first mating features are located in opposing corners of the array or radial configuration, and contacts having second mating features are located in the remaining corners of the array or radial configuration. Where contacts having the first interlocking features have a different size than contacts having the second interlocking features, the overall size of the connector structure can be reduced by placing these two types of contacts in this or other alternating manner.

In one example, a connector structure can include two contacts formed as pins or prongs can be placed in opposing corners, while two forked contacts can be placed in the remaining corners. In another example, a connector structure can include two contacts formed as pins or prongs can be placed in opposing corners, while two contacts having mating recesses can be placed in the remaining corners. Such a connector structure can be mated with an identical connector structure when they are placed in opposition and one is rotated 90 degrees relative to the other.

In various embodiments of the present invention, contacts, ground rings, shields, and other conductive portions of a connector receptacle assemblies and connector inserts can be formed by stamping, forging, metal-injection molding, machining, micro-machining, 3-D printing, or other manufacturing process. The conductive portions can be formed of stainless steel, steel, copper, copper-titanium, phosphor-bronze, or other material or combination of materials. They can be plated or coated with nickel, gold, or other material. The nonconductive portions, such as the housings and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials.

Embodiments of the present invention can provide connector receptacles, connector receptacle assemblies, and connector inserts that can be located in, or can connect to, various types of devices, such as portable computing devices, tablet computers, desktop computers, laptop computers, all-in-one computers, wearable computing devices such as smart watches, headphones, earbuds, cell phones, smart phones, media phones, storage devices, portable media players, navigation systems, monitors, power supplies, audio devices, video delivery systems, adapters, styluses, remote control devices, chargers, and other devices. These connector receptacles and connector inserts can provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these connector receptacles and connector inserts can be used to convey power, ground, signals, test points, and other voltage, current, data, or other information.

Various embodiments of the present invention can incorporate one or more of these and the other features described herein. A better understanding of the nature and advantages of the present invention can be gained by reference to the following detailed description and the accompanying drawings.

DESCRIPTION OF ILLUSTRATIVE EMBODIMENTS

Figure 1:
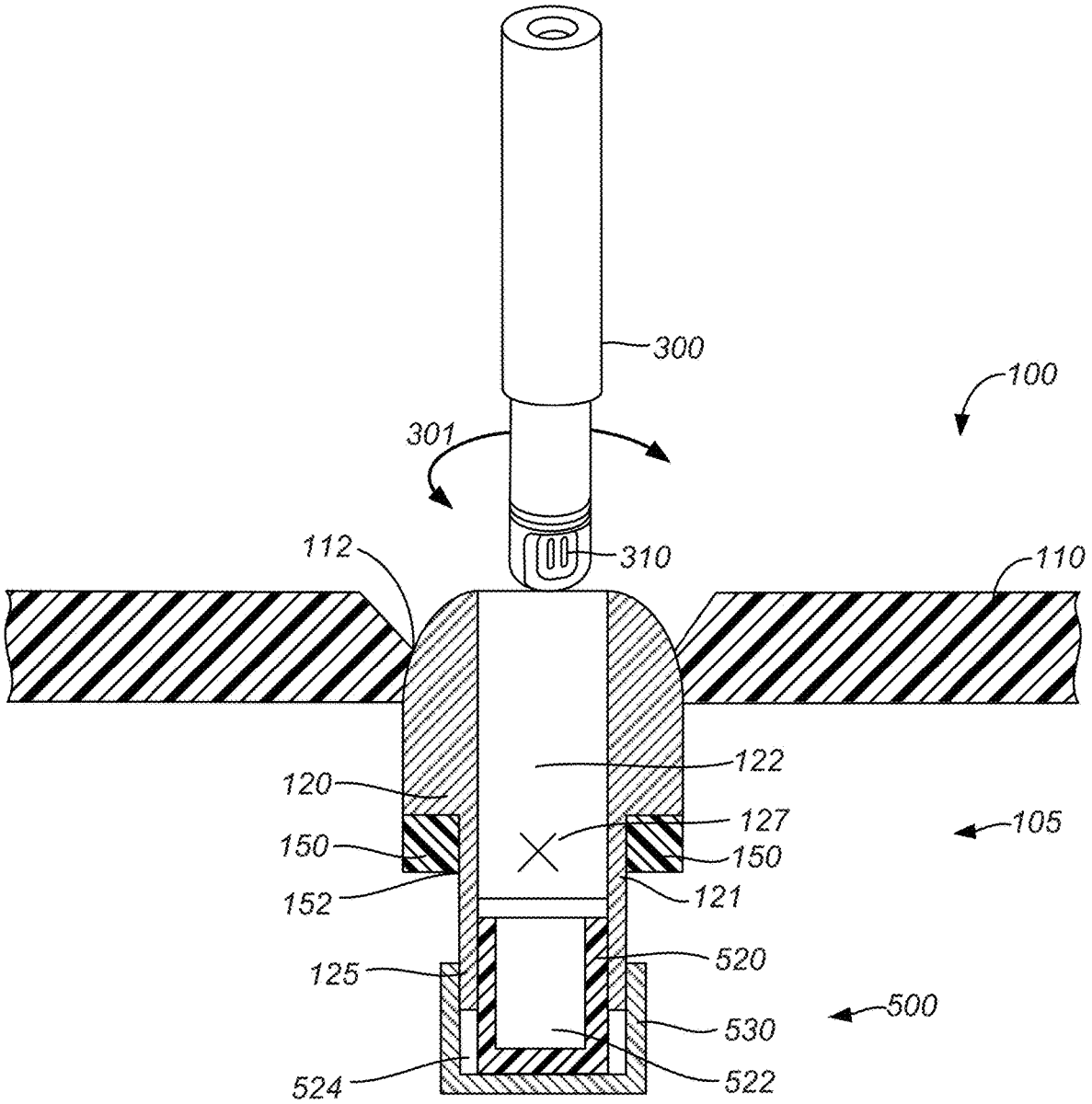
FIG. 1 illustrates a portion of an electronic system according to an embodiment of the present invention.

FIG. 1 illustrates a portion of an electronic system according to an embodiment of the present invention. This figure, as with the other included figures, is shown for illustrative purposes and does not limit either the possible embodiments of the present invention or the claims.

In this example, connector insert 300 can be inserted into connector receptacle assembly 105 in electronic device 100. That is, connector insert 300 can mate with connector receptacle 500 of connector receptacle assembly 105 of electronic device 100. Connector receptacle assembly 105 can be located in device enclosure 110 of electronic device 100. Device enclosure 110 can partially, substantially, or completely house electronic device 100. Connector receptacle assembly 105 can include front housing 120 and connector receptacle housing 520. Front housing 120 can include extensions 125 that can fit in slots 524 of connector receptacle 500. Slots 524 can be located between shield 530 and connector receptacle housing 520. Connector receptacle housing 520 can include cavity 522. Connector receptacle housing 520 can support a plurality of contacts 510 (shown in FIG. 5) in cavity 522 to physically and electrically connect to contacts 310 on connector insert 300.

Connector insert 300 can be inserted into connector receptacle 500 via passage 122 in front housing 120. When connector insert 300 and connector receptacle 500 are mated, connector insert 300 and connector receptacle 500 can rotate together relative to electronic device 100. Connector receptacle assembly 105 can ride on ring or bearing 150 and rotate relative to device enclosure 110. Ring or bearing 150 can have a circular inside surface 152. Front housing 120 can have a circular outside surface 121 to mate with inside surface 152 of ring or bearing 150 and can rotate relative to ring or bearing 150 through rotational angle 301. Ring or bearing 150 can be supported at axis 127 that can be fixed relative to device enclosure 110, either directly or through one or more structures.

In these and other embodiments of the present invention, rotational angle 301 can have various magnitudes. The amount of possible rotation can be plus and minus 180 degrees, plus and minus 120 degrees, plus and minus 90 degrees, plus and minus 45 degrees, or it can have another magnitude. The amount of rotation can be different depending on the direction of rotation. For example, connector insert 300 and connector receptacle assembly 105 can have a normal or resting position. Connector insert 300 and connector receptacle assembly 105 can rotate through a first angle in a first direction and a second angle in a second opposite direction. The first angle and the second angle can have the same or different magnitudes, such as 10, 20, 30, 40, 45, 60, 75, 90, 120, 150, 180, or other angle.

In this example, front housing 120 can interface with device enclosure 110 at opening 112. Front housing 120 can rotate relative to device enclosure 110 at opening 112. Opening 112 can be sealed to prevent moisture leakage or other ingress into electronic device 100. Contacts 510 of connector receptacle 500 can be connected to wires, a flexible circuit board 1670 (shown in FIG. 16), or other conduit that can allow contacts 510 to remain electrically connected to circuitry in electronic device 100 as connector insert 300 and connector receptacle 500 rotate.

Figure 2:
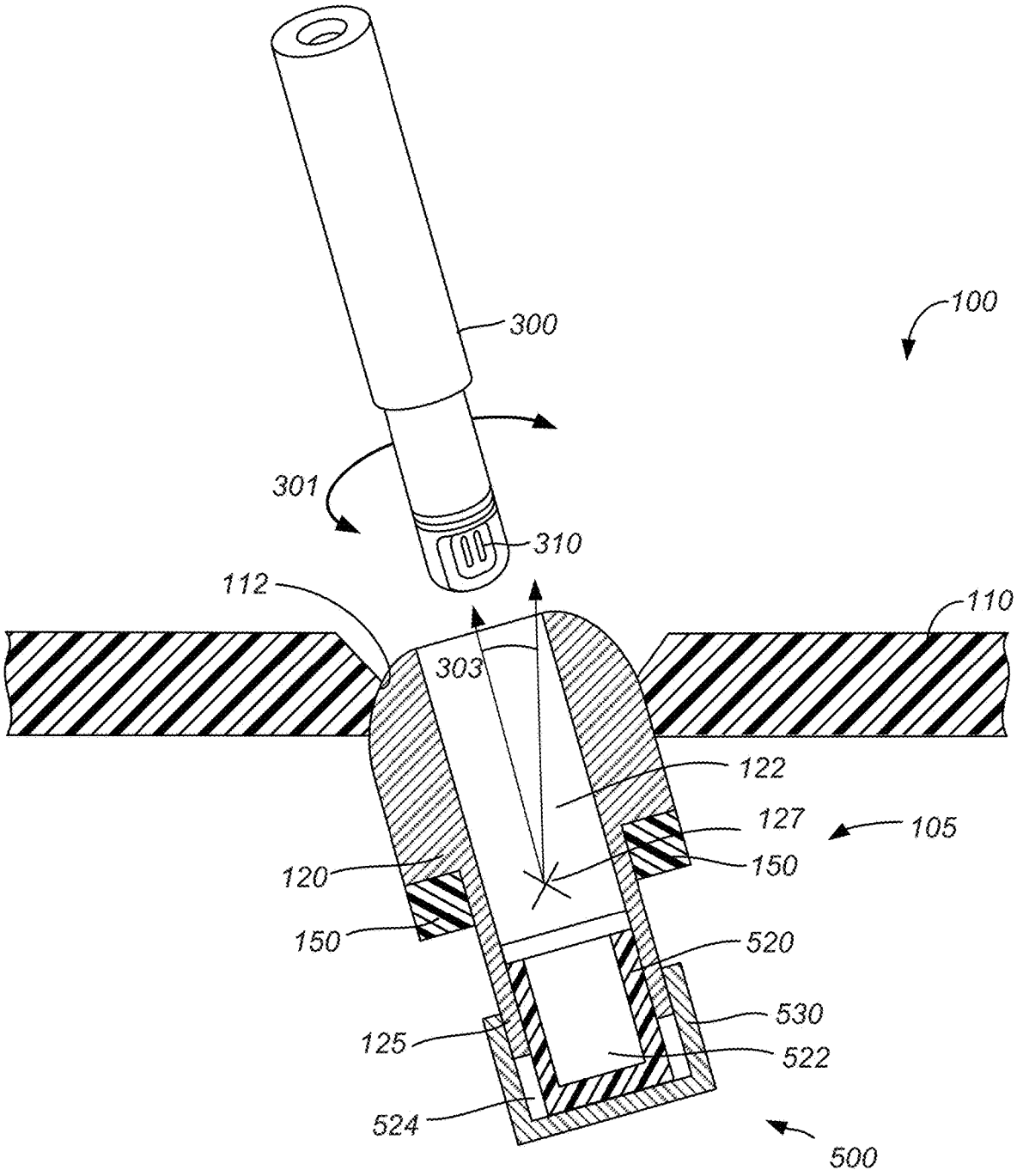
FIG. 2 illustrates a portion of an electronic system according to an embodiment of the present invention.

FIG. 2 illustrates a portion of an electronic system according to an embodiment of the present invention. Again, connector insert 300 can mate with connector receptacle assembly 105 in electronic device 100 when connector insert 300 is inserted into passage 122 of front housing 120 and cavity 522 of connector receptacle housing 520 of connector receptacle 500. Connector receptacle assembly 105 can be located in device enclosure 110. Device enclosure 110 can partially, substantially, or completely house electronic device 100. Connector receptacle assembly 105 can include a front housing 120 and connector receptacle housing 520. Front housing 120 can include extensions 125 that can fit in slots 524. Slots 524 can be located between shield 530 and connector receptacle housing 520. Connector receptacle housing 520 can include cavity 522. Connector receptacle housing 520 can support a plurality of contacts 510 (shown in FIG. 5) that mate with contacts 310 of connector insert 300 when connector insert 300 is inserted into connector receptacle housing 520.

When connector insert 300 and connector receptacle 500 are mated, connector insert 300 and connector receptacle 500 can articulate together about axis 127 relative to electronic device 100. The articulation can be in one or more directions. The articulation can be through an articulation angle 303. This articulation angle 303 can be an angle of 10 degrees, 15 degrees, 20 degrees, 25 degrees, 35 degrees, 45 degrees, or it can be another angle. This articulation can be through a plane that is normal to axis 127.

Bearing 150 can tilt or articulate about axis 127. This allows connector insert 300 and connector receptacle 500 to also articulate about axis 127. Connector insert 300 and connector receptacle 500 can also rotate about their axis identified as rotational angle 301. The amount of possible articulation can vary depending on the angle of rotation of connector insert 300 and connector receptacle 500.

The flexibility provided by the ability of connector insert 300 and connector receptacle 500 to rotate and articulate can be particularly advantageous in electronic devices such as audio headphones. Connector inserts 300 can be located at each end of a headband (not shown), where connector inserts 300 are each inserted into connector receptacle 500 in a corresponding earcup (not shown.) The rotation and articulation provided by an embodiment of the present invention can allow the two earcups to be comfortably positioned against sides of a listener's head.

Again, front housing 120 can interface with device enclosure 110 at opening 112. Front housing 120 can articulate relative to device enclosure 110 at opening 112. Opening 112 can be sealed to prevent moisture leakage or other ingress into electronic device 100.

These and other embodiments of the present invention can provide connector inserts, such as connector insert 300, and connector receptacles, such as connector receptacle 500, that can have a reduced size. This can help to save space inside of electronic device 100. Saving space in electronic device 100 can allow electronic device 100 to be smaller, include more functionality, or combination of both. Embodiments of the present invention can provide connector inserts having a reduced size by limiting the number of contacts that they have. The size of the connector inserts can be further reduced by forming the connector inserts as a tongue. In the following example, a connector insert can be formed as a tongue having top and bottom sides, with two contacts on each of the top and bottom sides. Each pair of contacts can convey a differential signal. A power supply can be combined with a differential signal and provided on the contacts. For example, a power supply can be added to each side of a first differential signal while ground can be added to each side of a second differential signal. In this way, two contacts on a first side of a connector insert can convey a power supply and a first differential signal, while two contacts on a second side of the connector insert can convey ground and a second differential signal. This arrangement can provide a connector inset having a reduced number of contacts that can still convey high-speed data signals and power. An example is shown in the following figure.

Figure 3:
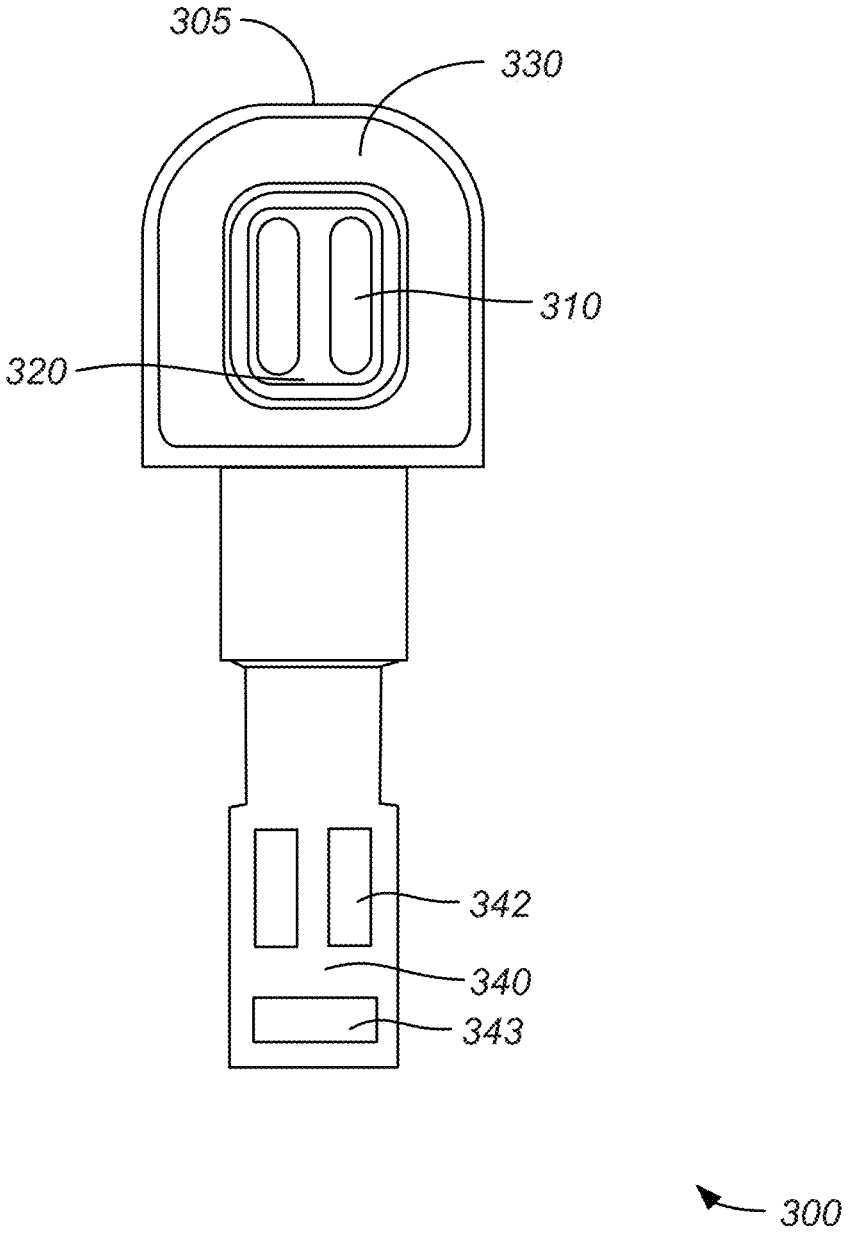
FIG. 3 illustrates a portion of a connector insert according to an embodiment of the present invention.

FIG. 3 illustrates a portion of a connector insert according to an embodiment of the present invention. In this example, connector insert 300 can include tongue 305 supporting a pair of contacts 310 on each of a top and bottom sides. Contacts 310 can be located in insulator 320. Ground ring 330 can surround insulator 320. Connector insert 300 can further include board 340. Board 340 can include contacts 342 and ground contact 343 on either or both a top and bottom side. Contacts 342 can be connected through traces or planes (not shown) on board 340 to contacts 310. Contacts 342 can be soldered or otherwise connected to wires, conduits, for example wires or conduits in a cable, or other connector portion (not shown), where the connector portion can be flexible or rigid conduit. Ground contacts 343 on either or both a top and bottom side of connector insert 300 can be connected through traces or planes (not shown) on board 340 to ground ring 330. Ground contact 343 can be soldered or otherwise connected to a shield or other ground conductor in a cable or other connector portion (not shown), where the connector portion can be flexible or rigid conduit.

Figure 4:
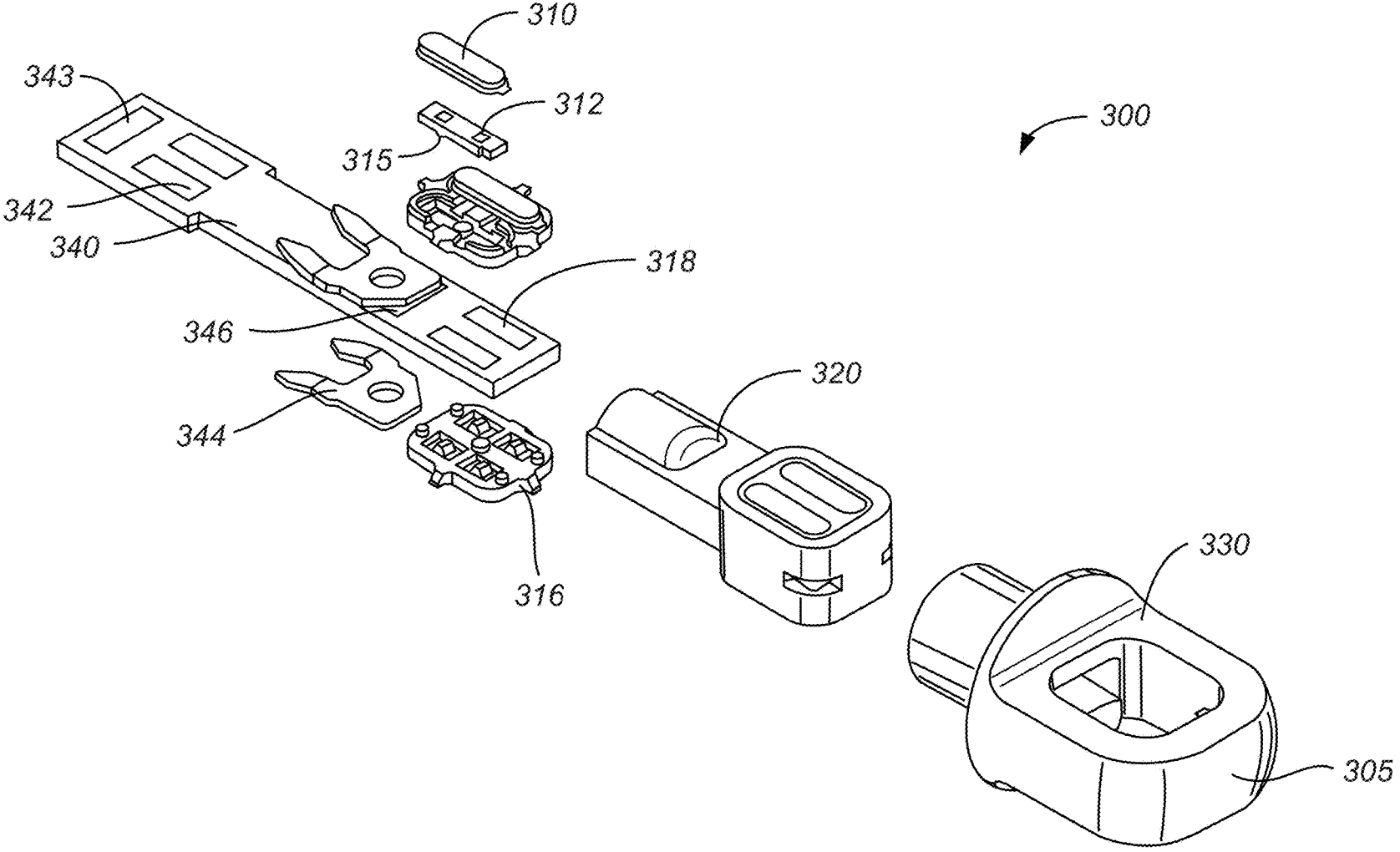
FIG. 4 is an exploded diagram of the connector insert of FIG. 3.

FIG. 4 is an exploded diagram of the connector insert of FIG. 3. In this example, contacts 310 can be mated with contacting portions 312. Contacting portions 312 can include solder points 315 that can be soldered to contacts 318 on board 340. Contacts 318 can be soldered to solder points 315 of contacting portions on each of the top and bottom side of board 340. Contacts 310 and contacting portions 312 can be located in insulating portions 316. Insulating portions 316 can be injection molded portions. Insulating portions 316 can be housed in insulator 320. Insulator 320 can be an overmold formed of nylon or other insulating material. Ground ring 330 can form tongue 305. Ground ring 330 can be formed or placed around insulator 320, or insulator 320 can be formed in ground ring 330. Ground springs 344 can be soldered to ground contacts 346 on board 340.

Board 340 can include contacts 342 and ground contact 343 on either or both a top and bottom side. Contacts 342 can be connected through traces or planes (not shown) on board 340 to contacts 310 via contacts 318 and contacting portions 312. Contacts 342 can be soldered or otherwise connected to wires or conduits in a cable or other connector portion (not shown), where the connector portion can be flexible or rigid conduit. Ground contacts 343 can be connected through traces or planes (not shown) on board 340 to ground ring 330 via ground contact 346 and ground springs 344. Ground contacts 343 can be soldered or otherwise connected to a shield or other ground in a cable or other connector portion (not shown), where the connector portion can be a flexible or rigid conduit.

Again, these and other embodiments of the present invention can provide connector inserts, such as connector insert 300, and connector receptacles, such as connector receptacle 500, that can have a reduced size. This can help to save space inside of electronic device 100 (shown in FIG. 1.) Saving space in electronic device 100 can allow electronic device 100 to be smaller, include more functionality, or combination of both.

The connector receptacles can be reduced in size by employing contacts that wrap over (or under) themselves in a space-saving configuration. For example, a connector receptacle can have two contacts having contacting portions in a top of an opening or cavity in a housing and two contacts having contacting portions in a bottom of an opening or cavity in a housing, where the contacting portions can physically and electrically connect to contacts on a connector insert tongue when the connector insert is inserted into the connector receptacle. These contacts can have contact tails that wrap underneath the contacting portions. The contact tails can include through-hole portions to be inserted into and soldered to holes in a board, posts for connecting to wires, or surface mount portions to be soldered to contacts on a board, where the board can be a flexible circuit board, printed circuit board, or other appropriate substrate. The contacts can further include barbs that can be inserted in a housing of the connector receptacle to secure the contacts to the connector receptacle housing. These barbs can extend laterally from the contacting portions to further save space. Examples of connector receptacles that can be used as connector receptacle 500 are shown in the following figures.

Figure 5:
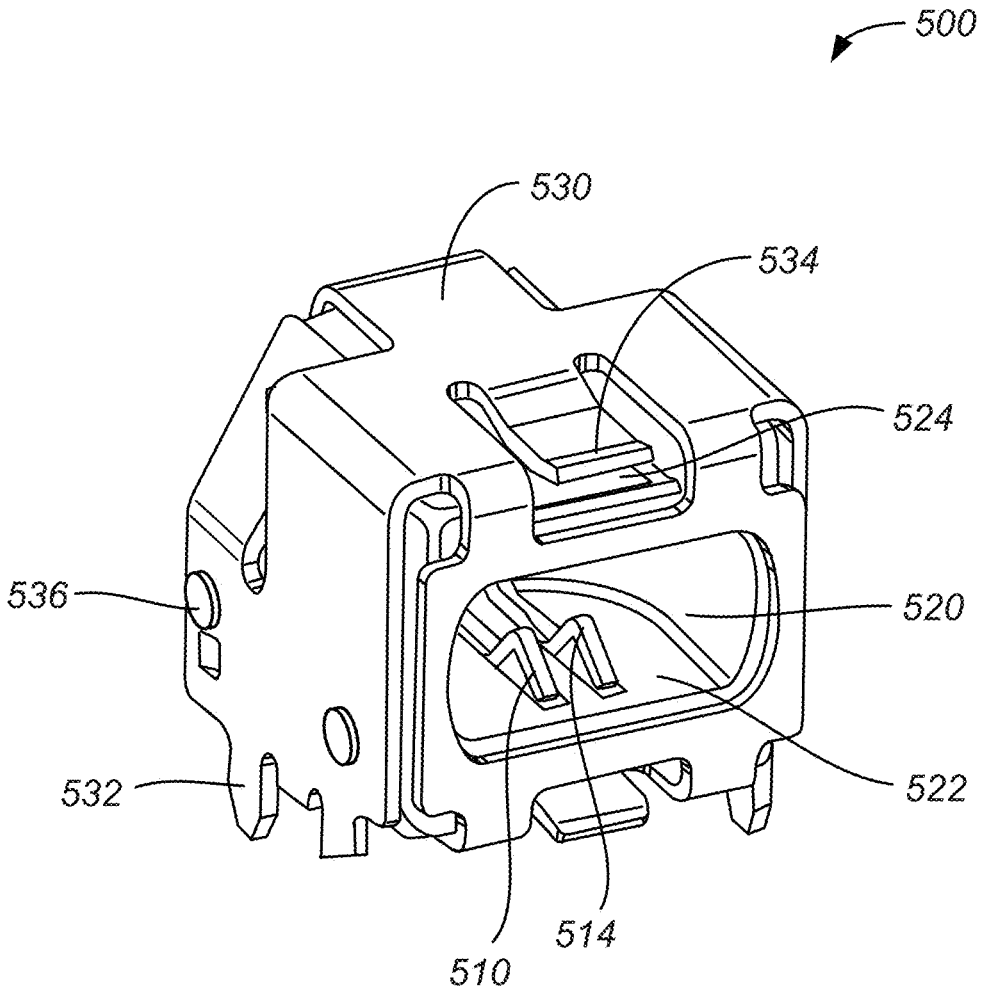
FIG. 5 illustrates a connector receptacle according to an embodiment of the present invention.

FIG. 5 illustrates a connector receptacle according to an embodiment of the present invention. In this example, contacts 510 can have contacting portions 514 located in cavity 522 of connector receptacle housing 520 of connector receptacle 500. Connector receptacle housing 520 can be shielded by shield 530. Shield 530 can be spot or laser welded to itself at various points 536. Shield 530 can include tabs 532 to form ground connections to wires, a flexible circuit board, or other flexible conduits. Extensions 125 of front housing 120 (shown in FIG. 1) can be inserted into slots 524 and held in place by tabs 534.

Figure 6:
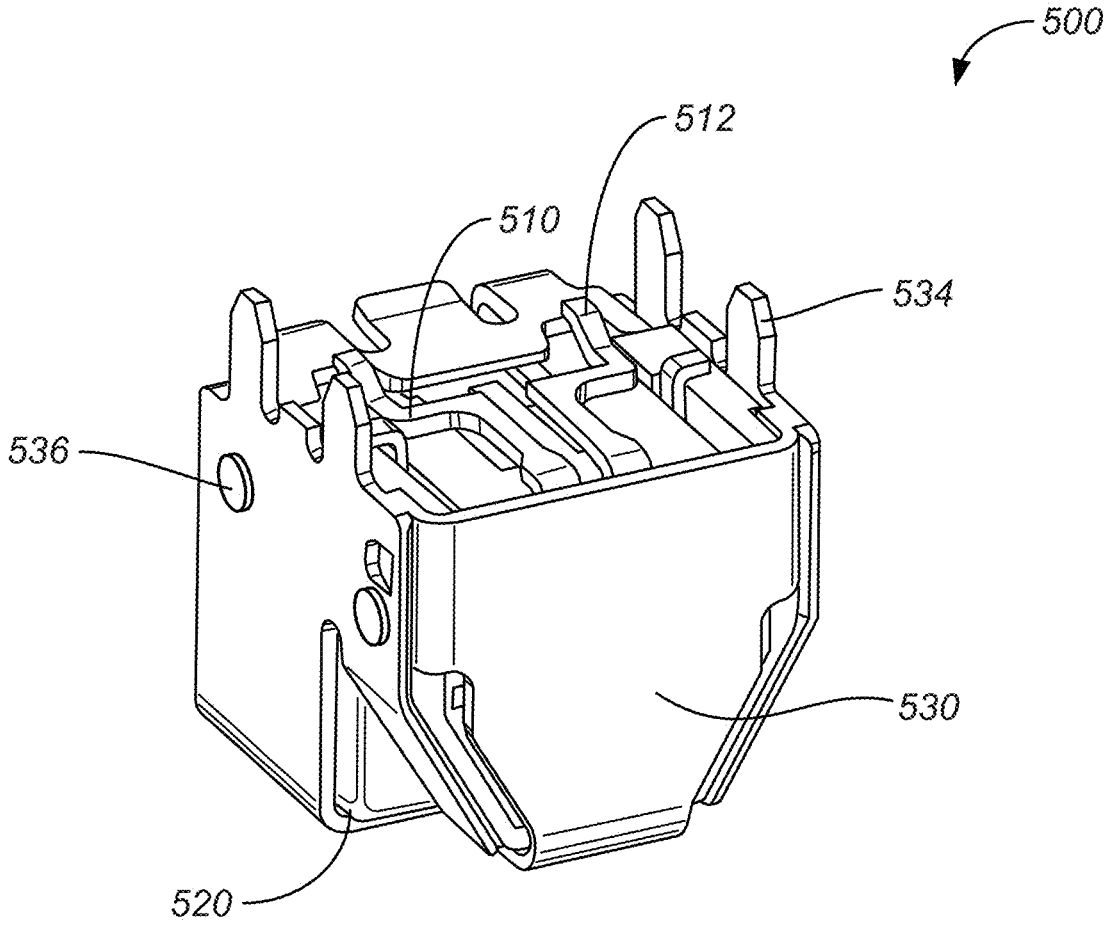
FIG. 6 illustrates a backside view of the connector receptacle of FIG. 5.

FIG. 6 illustrates a backside view of the connector receptacle of FIG. 5. Connector receptacle housing 520 of connector receptacle 500 can be shielded by shield 530. Shield 530 can include tabs 534 and can be spot or laser welded to itself at points 536. Contacts 510 can include surface mount contacting portions 512 for connecting to wires or contacts at a surface of the flexible circuit board or other conduit.

Figure 7:
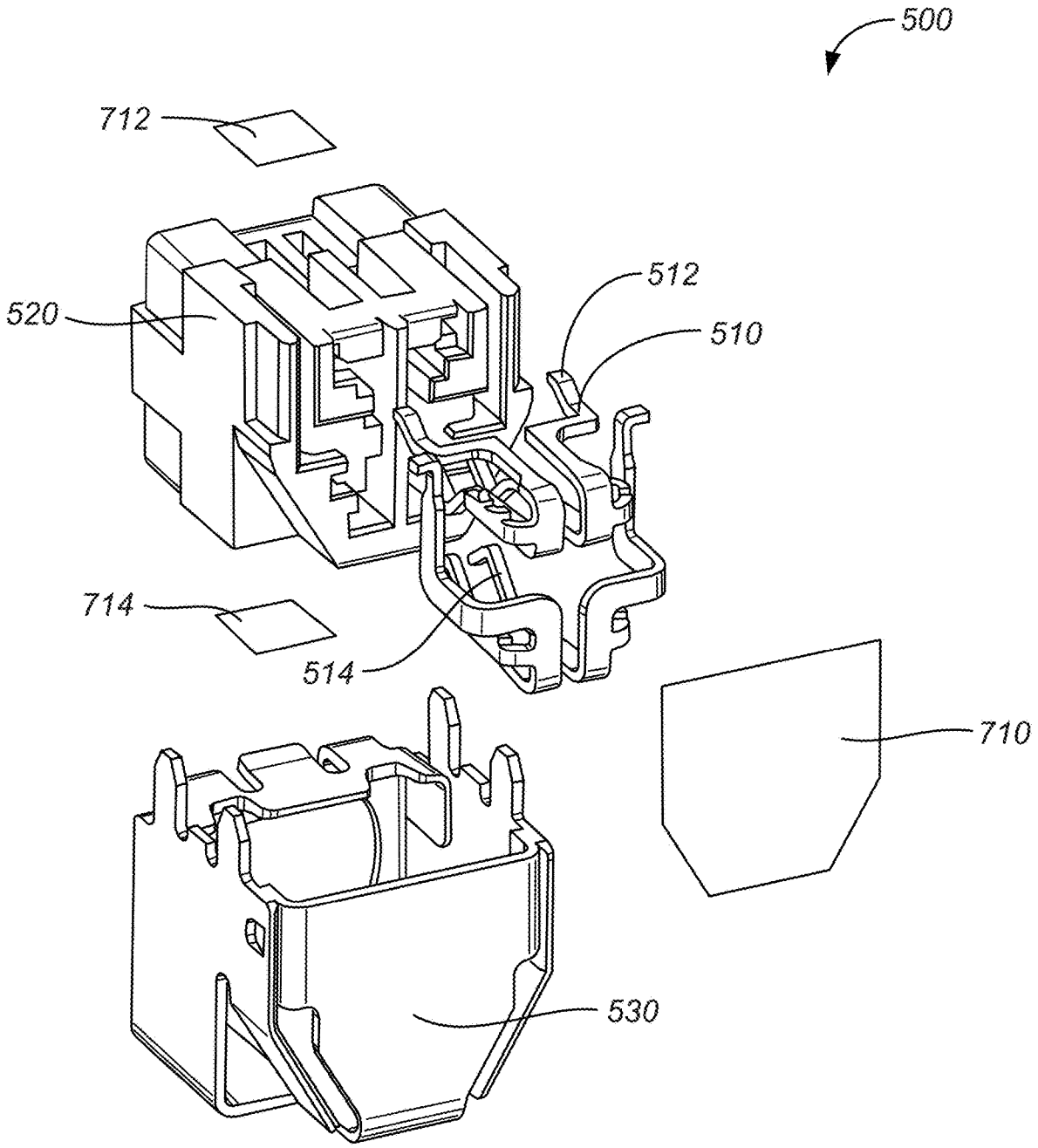
FIG. 7 is an exploded diagram of the connector receptacle of FIG. 5.

FIG. 7 is an exploded diagram of the connector receptacle of FIG. 5. In this example, contacts 510 can be inserted into connector receptacle housing 520, though connector receptacle housing 520 can be formed around contacts 510, for example by injection molding. Insulating tape 712, 714, and 710 can isolate contacts 510 from shield 530. Insulating tape 712, 714, and 710 can be Kapton tape, or other polyamide or other tape, secured using a pressure-sensitive adhesive. Shield 530 can shield connector receptacle housing 520.

Contacts 510 can include surface mount contacting portions 512 and contacting portions 514. Contacting portions 514 can physically and electrically connect to contacts 310 on connector insert 300 when connector insert 300 (shown in FIG. 4) is mated with connector receptacle 500. Surface mount contacting portions 512 can connect to wires or contacts at a surface of a flexible circuit board or other conduit. Surface mount contacting portions 512 can fold up and over contacting portions 514 to save space and reduce the size of connector receptacle 500.

Figure 8:
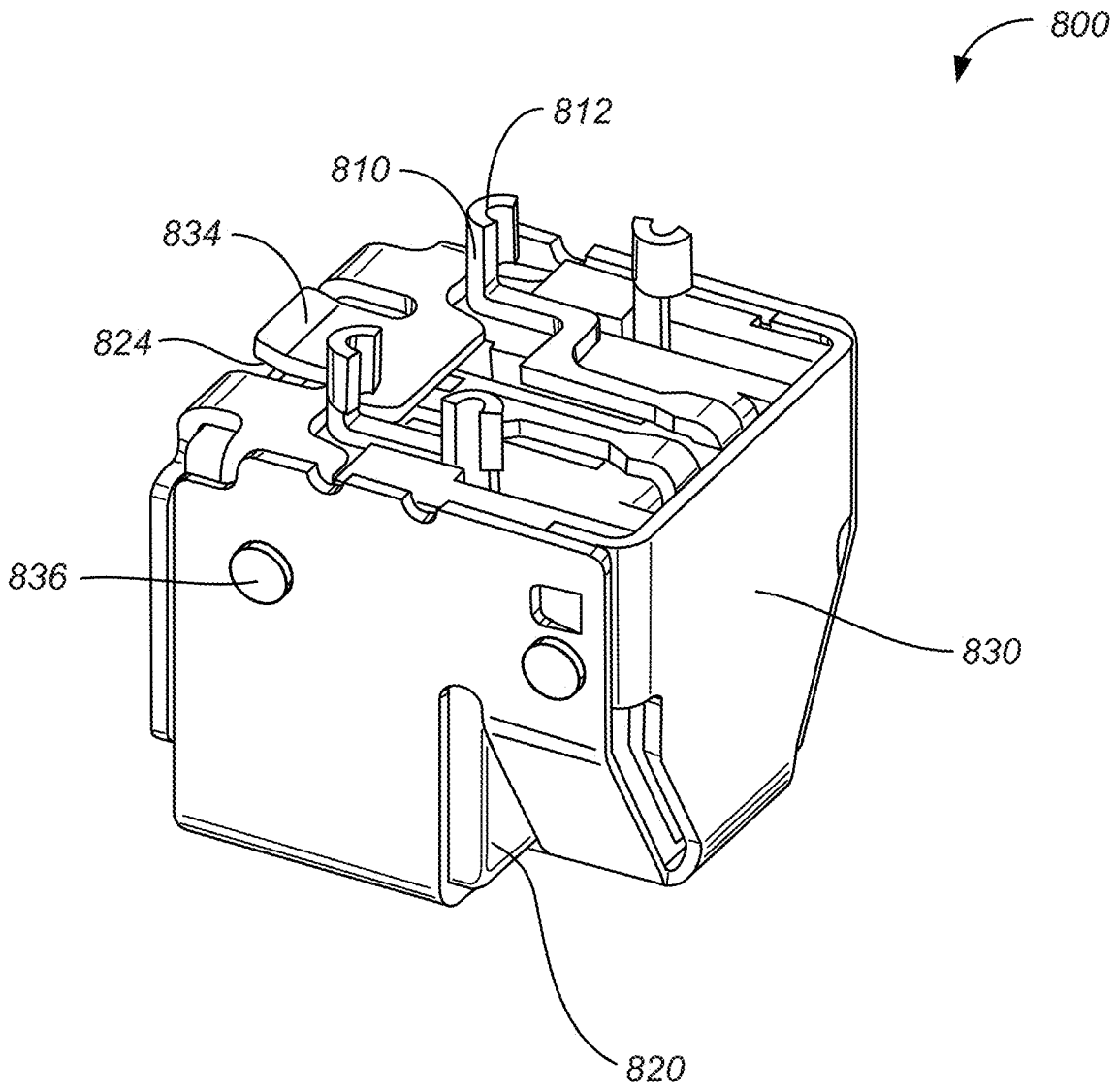
FIG. 8 illustrates another connector receptacle according to an embodiment of the present invention.

FIG. 8 illustrates another connector receptacle according to an embodiment of the present invention. This connector receptacle 800, as with the other included connector receptacles, can be used in place of connector receptacle 500 in electronic device 100 as shown in FIG. 1 and FIG. 2.

Connector receptacle 800 can include connector receptacle housing 820 shielded by shield 830. Shield 830 can be spot or laser welded to itself at points 836. Connector receptacle 800 can include tabs 834 over slot 824. Slots 824 can hold extensions 125 of front housing 120 (shown in FIG. 1.) Tabs 834 on shield 830 can hold extensions 125 in place in slots 824. Contacts 810 can include posts 812. Post 812 can be connected to wires or other flexible conduit, which can connect to circuitry in electronic device 100 (shown in FIG. 1.)

Figure 9:
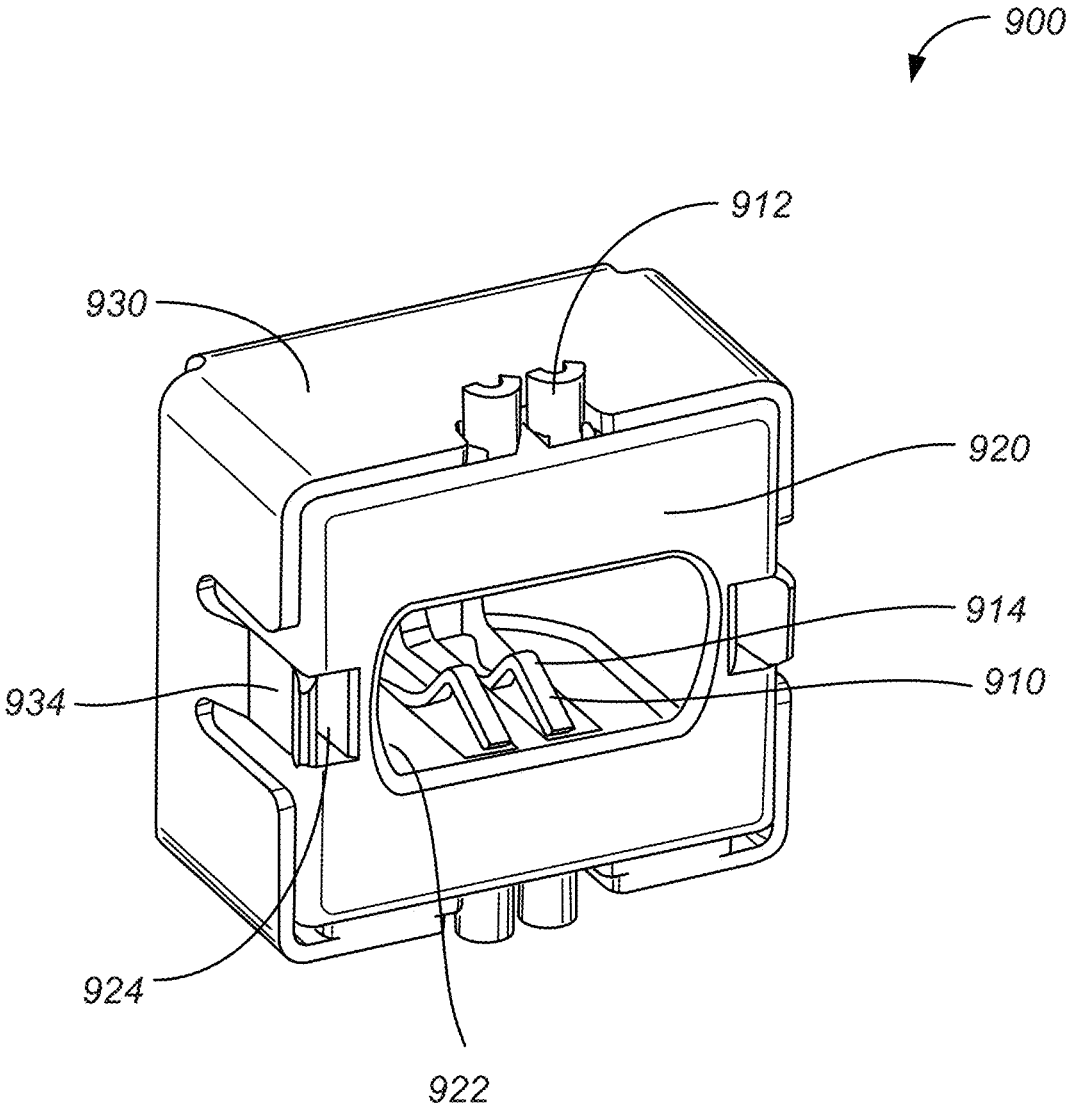
FIG. 9 illustrates another connector receptacle according to an embodiment of the present invention.

FIG. 9 illustrates another connector receptacle according to an embodiment of the present invention. This connector receptacle 900, as with the other included connector receptacles, can be used in place of connector receptacle 500 in electronic device 100 as shown in FIG. 1 and FIG. 2.

Connector receptacle 900 can include contacts 910 having contacting portions 914 in opening or cavity 922 of connector receptacle housing 920. Connector receptacle housing 920 can be shielded by shield 930. Contacts 910 can further include posts 912. Posts 912 can be soldered or otherwise connected to wires or other flexible conduit, which can connect to circuitry in electronic device 100 (shown in FIG. 1.) Tabs 124 of front housing 120 (shown in FIG. 1) can fit in slots 924 and can be held in place by tabs 934.

Figure 10:
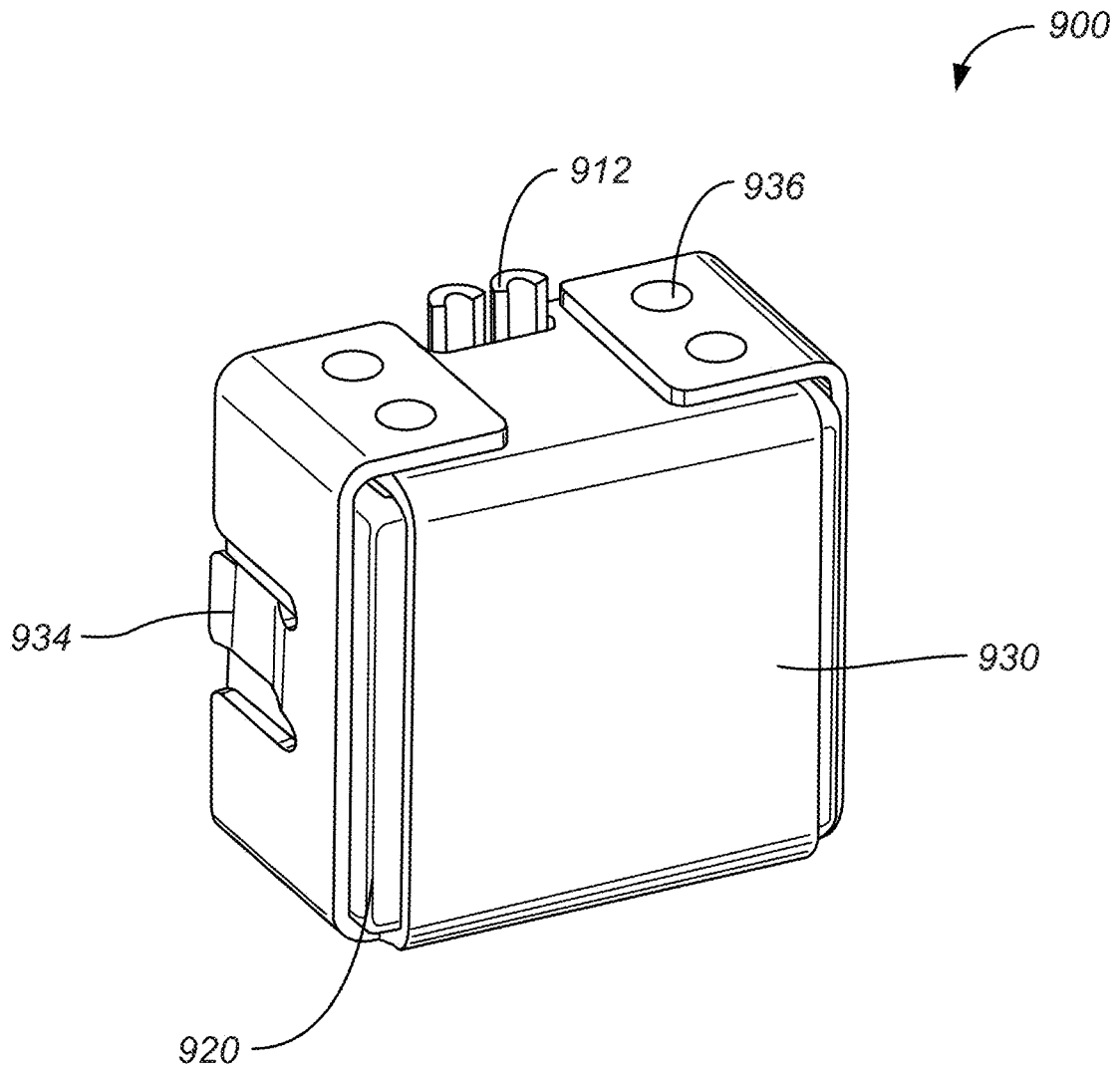
FIG. 10 illustrates a rear view of the connector receptacle of FIG. 9.

FIG. 10 illustrates a rear view of the connector receptacle of FIG. 9. In this example, connector receptacle housing 920 of connector receptacle 900 can be shielded by shield 930. Shield 930 can include tabs 934. Portions of shielding 930 can be spot or laser welded to itself at points 936. Posts 912 can be soldered or otherwise attached to wires or other flexible conduit.

Figure 11:
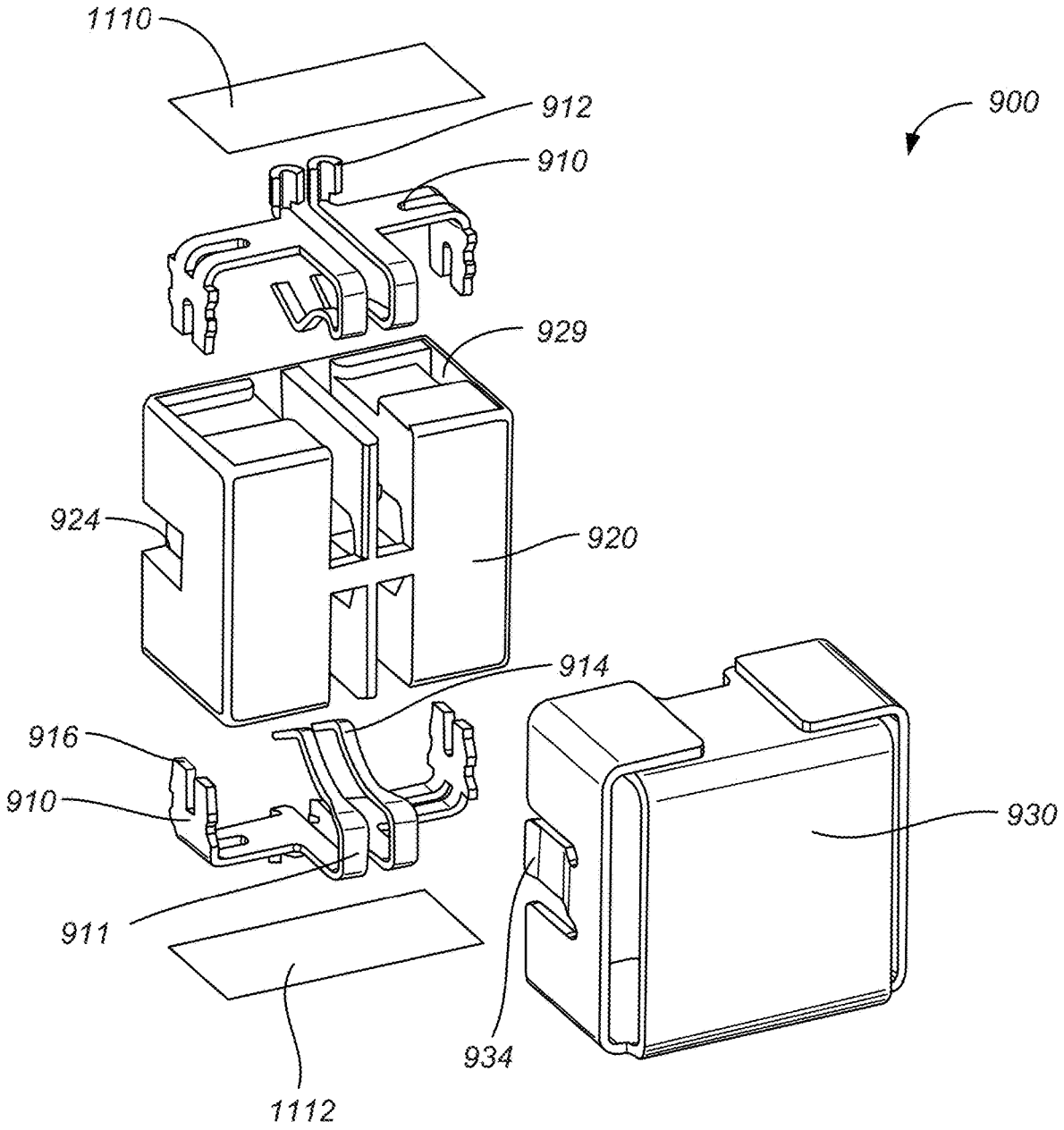
FIG. 11 is an exploded diagram of the connector receptacle of FIG. 9.

FIG. 11 is an exploded diagram of the connector receptacle of FIG. 9. In this example, contacts 910 can be inserted into connector receptacle housing 920 or connector receptacle housing 920 can be formed around contacts 910. Connector receptacle housing 920 can be shielded by shield 930. Insulating tape 1110 and 1112 can be used to isolate contacts 910 from shield 930. Insulating tape 1110 and 1112 can be Kapton tape, or other polyamide or other tape, secured using a pressure-sensitive adhesive. Tabs 124 of front housing 120 (shown in FIG. 1) can be inserted into slots 924 and held in place with tabs 934 on shield 930.

Contacts 910 can include contacting portions 914. Contacting portions 914 can physically and electrically connect to contacts 310 on connector insert 300 when connector insert 300 is mated with connector receptacle 900. Post 912 can be soldered or otherwise attached to wires or other flexible conduit to connect contacts 910 to circuitry of electronic device 100 (shown in FIG. 1.) Barbs 916 can be inserted into slots 929 in connector receptacle housing 920 to hold contacts 910 in place. Contacting portions 914 can be joined to posts using U-shaped portion 911. This can allow contacting portions 914 to wrap over (or under) posts 912, thereby saving space.

Contacts 910, as with contacts 510, 710, 810, and the other contacts shown herein, can be formed of various materials. For example, they can be formed of titanium-copper, stainless steel, steel, copper, phosphor-bronze, or other material or combination of materials. They can be plated with gold or other material. They can have an underplate formed of silver, electroless nickel, nickel, or other material.

Figure 12:
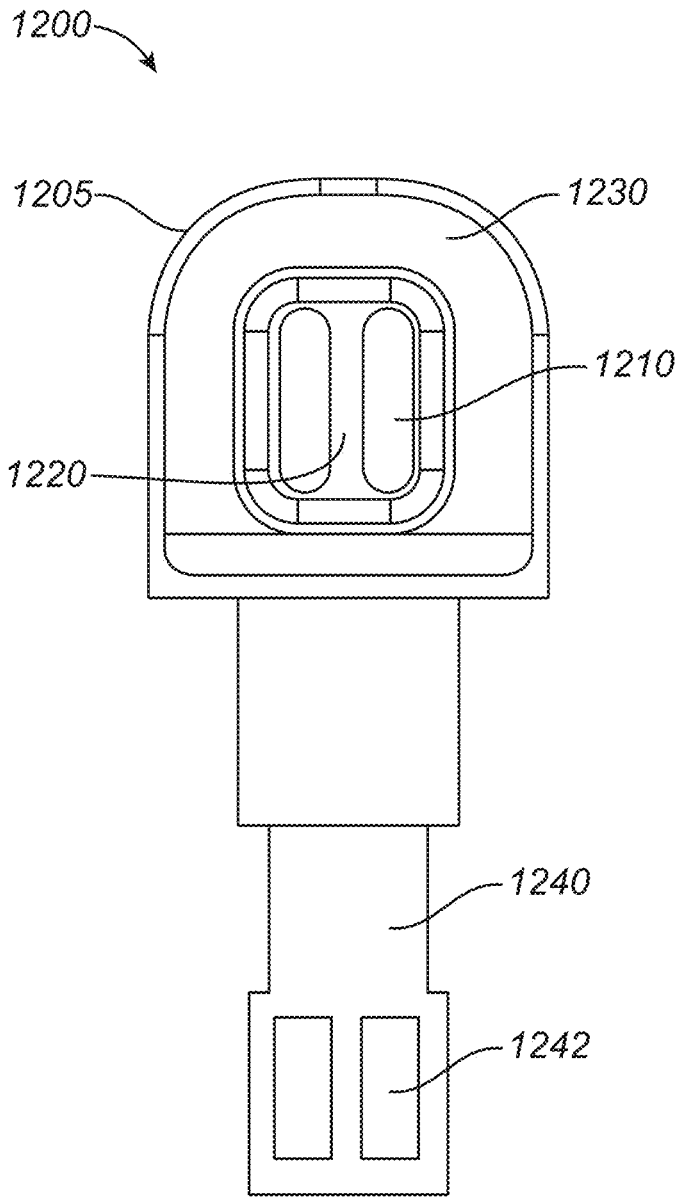
FIG. 12 illustrates a portion of another connector insert according to an embodiment of the present invention.

FIG. 12 illustrates a portion of a connector insert according to an embodiment of the present invention. Connector insert 1200 can be used as connector insert 300 in FIG. 1 or as a connector insert in these and other embodiments of the present invention. In this example, connector insert 1200 can include tongue 1205 supporting a pair of contacts 1210 on each of a top and bottom side of the tongue. Contacts 1210 can be located in insulator 1220. Ground ring 1230 can surround insulator 1220. Connector insert 1200 can further include board 1240. Board 1240 can include contacts 1242 on either or both a top and bottom side. Contacts 1242 can be connected through traces or planes (not shown) of board 1240 to contacts 1210. Contacts 1242 can be soldered or otherwise connected to wires, conduits, for example wires or conduits in a cable, or other connector portion (not shown), where the connector portion can be flexible or rigid conduit. Contacts 1243 (shown in FIG. 13) on a top and bottom side of connector insert 1200 can be connected through traces or planes (not shown) on board 1240 to ground ring 1230. Contacts 1243 can be soldered or otherwise connected to a shield or other ground conductor in a cable or other connector portion (not shown), where the connector portion can be flexible or rigid conduit.

Figure 13:
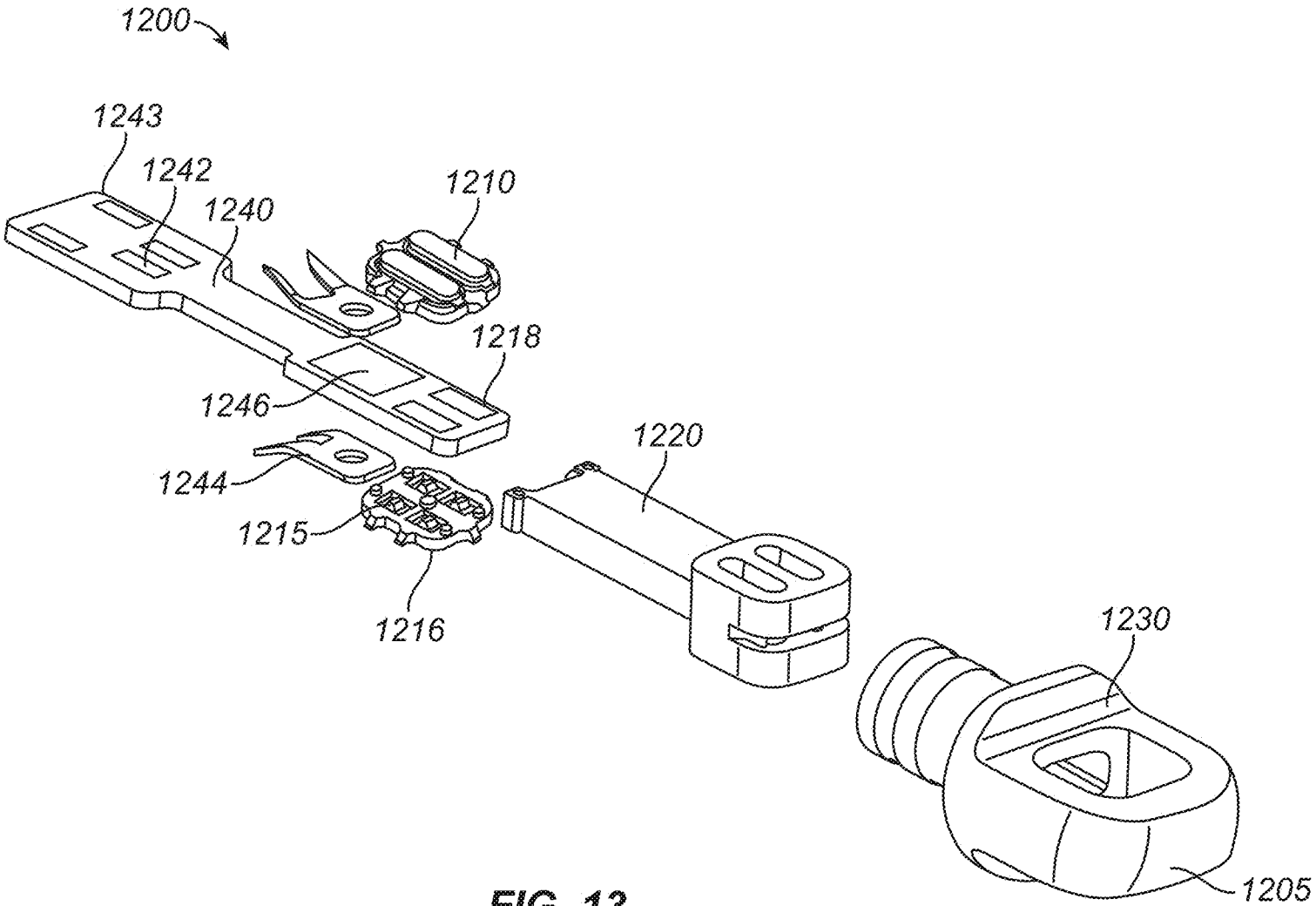
FIG. 13 is an exploded diagram of the connector insert of FIG. 12.

FIG. 13 is an exploded diagram of the connector insert of FIG. 12. In this example, contacts 1210 of connector insert 1200 can be mated with contacting portions (not shown) that can be similar to contacting portions 312 (shown in FIG. 4.) The contacting portions can include solder points 1215 that can be soldered to contacts 1218 on board 1240. Contacts 1218 can be soldered to solder points 1215 of contacting portions on each of the top and bottom side of board 1240. Contacts 1210 and their corresponding contacting portions can be located in insulating portions 1216. Insulating portions 1216 can be injection molded portions. Insulating portions 1216 can be housed in insulator 1220. Insulator 1220 can be an overmold formed of nylon or other insulating material. Ground ring 1230 can be formed or placed around insulator 1220, or insulator 1220 can be formed in ground ring 1230. Ground ring 1230 can define tongue 1205. Ground springs 1244 can be soldered to ground contacts 1246 on either or both the top and bottom sides of board 1240.

Board 1240 can include contacts 1242 and contacts 1243 on either or both a top and bottom side. On each side of board 1240, contacts 1242 can be connected through traces or planes (not shown) on board 1240 to contacts 1210 via contacts 1218 and contacting portions 1212. Contacts 1242 can be soldered or otherwise connected to wires or conduits in a cable or other connector portion (not shown), where the connector portion can be flexible or rigid conduit. On either or both a top and bottom of board 1240, contacts 1243 can be connected through traces or planes (not shown) on board 1240 to ground ring 1230 via ground contact 1246 and ground springs 1244. Contacts 1243 can be soldered or otherwise connected to a shield or other ground in a cable or other connector portion (not shown), where the connector portion can be flexible or rigid conduit. The arrangement of contacts 1242 and contacts 1243 can provide terminations for a cable where a differential signal is conveyed by conduits soldered to contacts 1242 while power and ground conduits or shields are positioned on each side of the differential signal to provide shielding and are terminated at contacts 1243.

Figure 14:
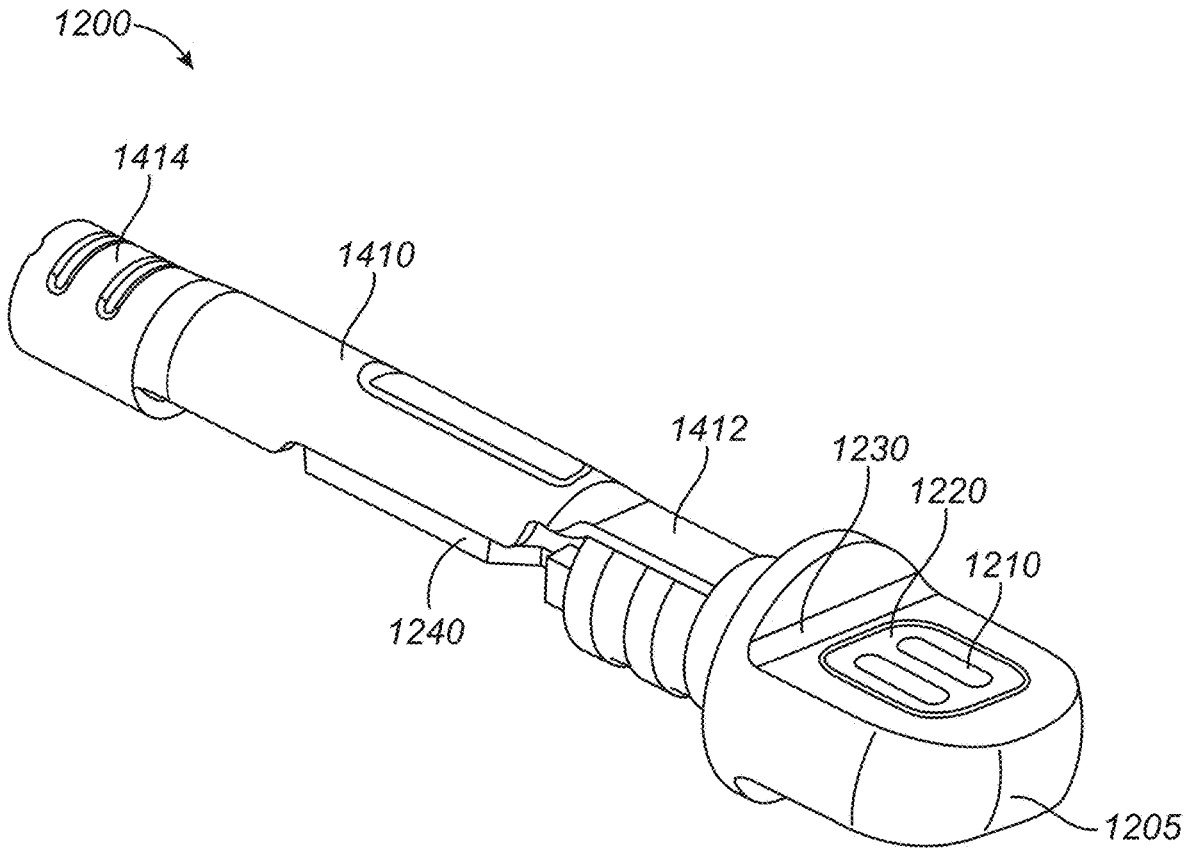
FIG. 14 illustrates a portion of a connector insert according to an embodiment of the present invention.

FIG. 14 illustrates a portion of a connector insert according to an embodiment of the present invention. In this example, crimp bracket 1410 can be attached to ground ring 1230 of connector insert 1200. Specifically, crimp bracket 1410 can include extension 1412. Extension 1412 can be laser or spot-welded to a rear portion of ground ring 1230. Extension 1412 and ground ring 1430 can provide shielding for signals and power supplies conveyed by contacts 1210. Ground ring 1230 can define tongue 1205. Ground ring 1230 can be separated from contacts 1210 by insulation 1220. Plug crimp 1414 can be crimped around a cable or conductors (not shown.) Plug crimp 1414 can hold the cable and conductors in place, and the cable and conductors can be attached to contacts 1242 and contacts 1243 (shown in FIG. 13) on board 1240.

Figure 15:
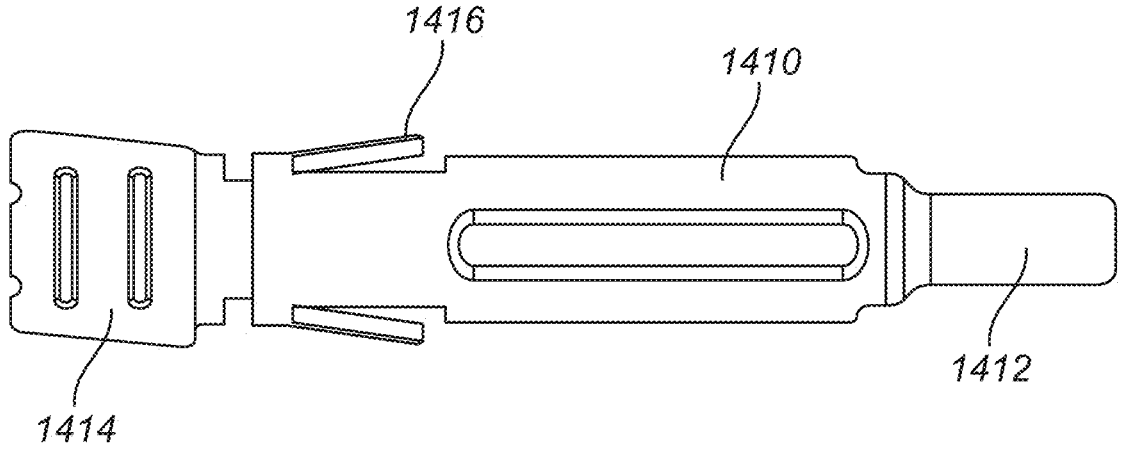
FIG. 15 illustrates another crimp bracket according to an embodiment of the present invention.

FIG. 15 illustrates another crimp bracket according to an embodiment of the present invention. As before, crimp bracket 1410 can include extension 1412. Extension 1412 can be physically and electrically connected to ground ring 1230, as shown in FIG. 14. Plug crimp 1414 can hold a cable and conduits in place in connector insert 1200 (shown in FIG. 14.) Crimp bracket 1410 can further include plug crimp ground springs 1416. Plug crimp ground springs 1416 can physically and electrically connect to a housing of a structure (not shown) supporting connector insert 300. In this way, crimp bracket 1410 can electrically and mechanically connect cable conduits, such as a ground shield, to ground ring 1230.

Again, connector insert 300 along with connector receptacle assembly 105 (shown in FIG. 2) can rotate relative to device enclosure 110 (also shown in FIG. 2.) A flexible circuit board can be used to convey signals between connector receptacle assembly 105 and circuitry housed by device enclosure 110. This flexible circuit board can include a first amount of slack or excess length, wherein the slack increases or decreases as connector receptacle assembly 105 is rotated. An example is shown in the following figures.

Figure 16:
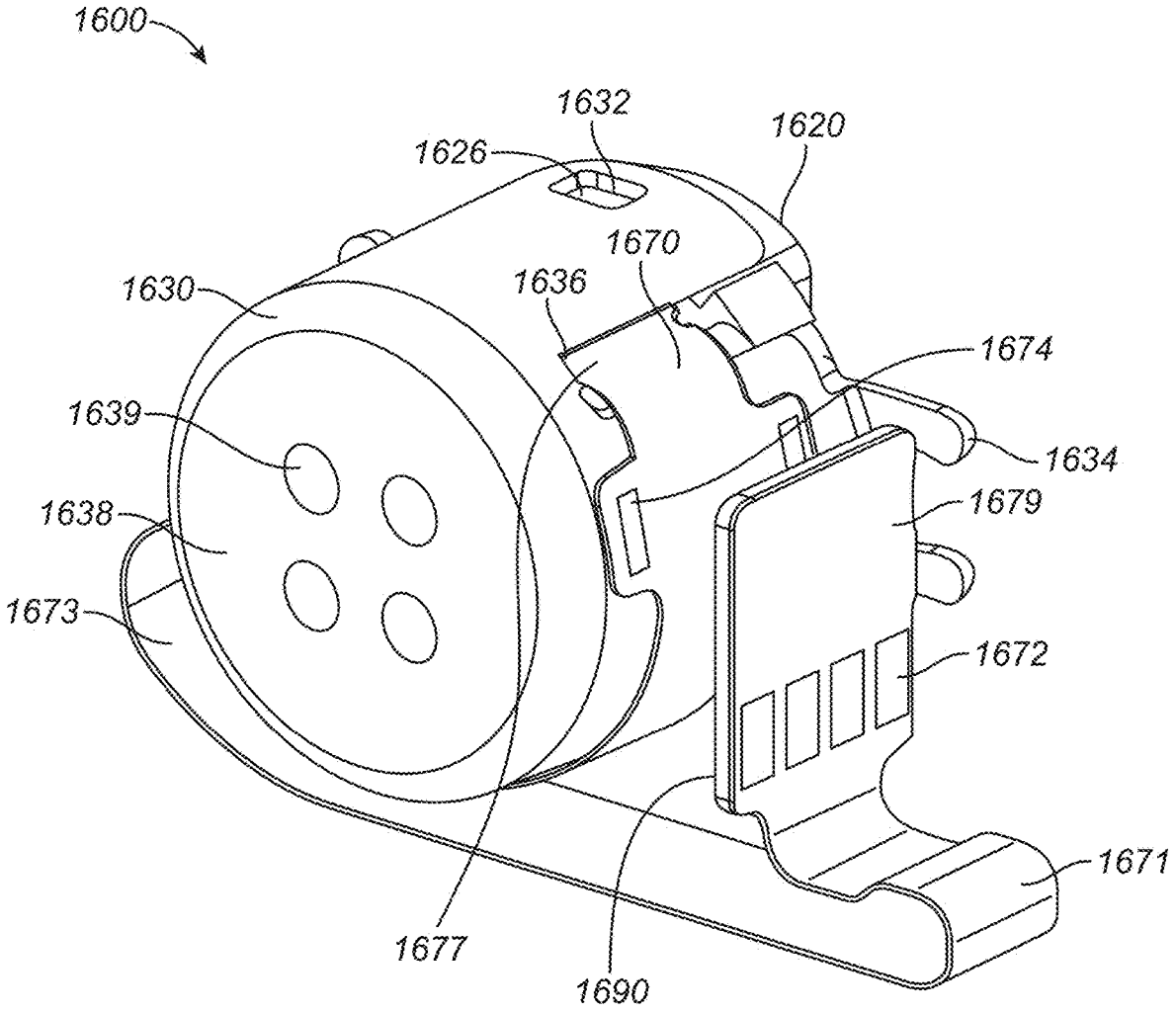
FIG. 16 illustrates a connector receptacle according to an embodiment of the present invention.

FIG. 16 illustrates a connector receptacle according to an embodiment of the present invention. Connector receptacle 1600 can be used as connector receptacle 500 in FIG. 1, or as a connector receptacle in these and other embodiments of the present invention. Connector receptacle 1600 can include housing 1620, which can be located in shield 1630. Tab 1626 of housing 1620 can fit in opening 1632 of shield 1630 to hold housing 1620 in place. Tab 1634 can extend from shield 1630 and can accept a fastener for securing connector receptacle 1600 to other structures (not shown) in electronic device 100 (shown in FIG. 1.) A back side 1638 of shield 1630 can be laser or spot-welded to bracket 1660 (shown in FIG. 17) at locations 1639. Flexible circuit board 1670 can have a first end 1677 that can be attached to posts 1616 of contacts 1610 (both shown in FIG. 17.) Flexible circuit board 1670 can further have a second end 1679. Second end 1679 can be supported by stiffener or cowling 1690 and can have one or more contacts 1672 plated on a surface. First end 1677 of flexible circuit board 1670 can pass through slot 1636 in shield 1630 in order to reach tabs posts of contact 1610. Flexible circuit board 1670 can further include ground contacts 1674. Ground contacts 1674 can be soldered or spot or laser-welded to an outside surface of shield 1630. Ground contacts 1674 can be further connected to a ground contact (one of contacts 1610) in housing 1620, to one or more ground traces in flexible circuit board 1670, or both. The connection between ground contact 1674 and shield 1630 can also act as a strain relief to protect connections between contacts 1610 and flexible circuit board 1670, details of which are shown in FIG. 17.

Flexible circuit board 1670 can include loop 1671 and an excess length, or slack, shown here as loop 1673, between first end 1677 and second end 1679. Housing 1620 and shield 1630 of connector receptacle 1600 can rotate about their central axis. Conversely, second end 1679 of flexible circuit board 1670, along with contacts 1672 and stiffener or cowling 1690, can be nonrotating. Accordingly, the amount of slack in loop 1673 can increase or decrease depending on a direction of rotation of connector receptacle housing 1620 and shield 1630. Examples are shown below.

Figure 17:
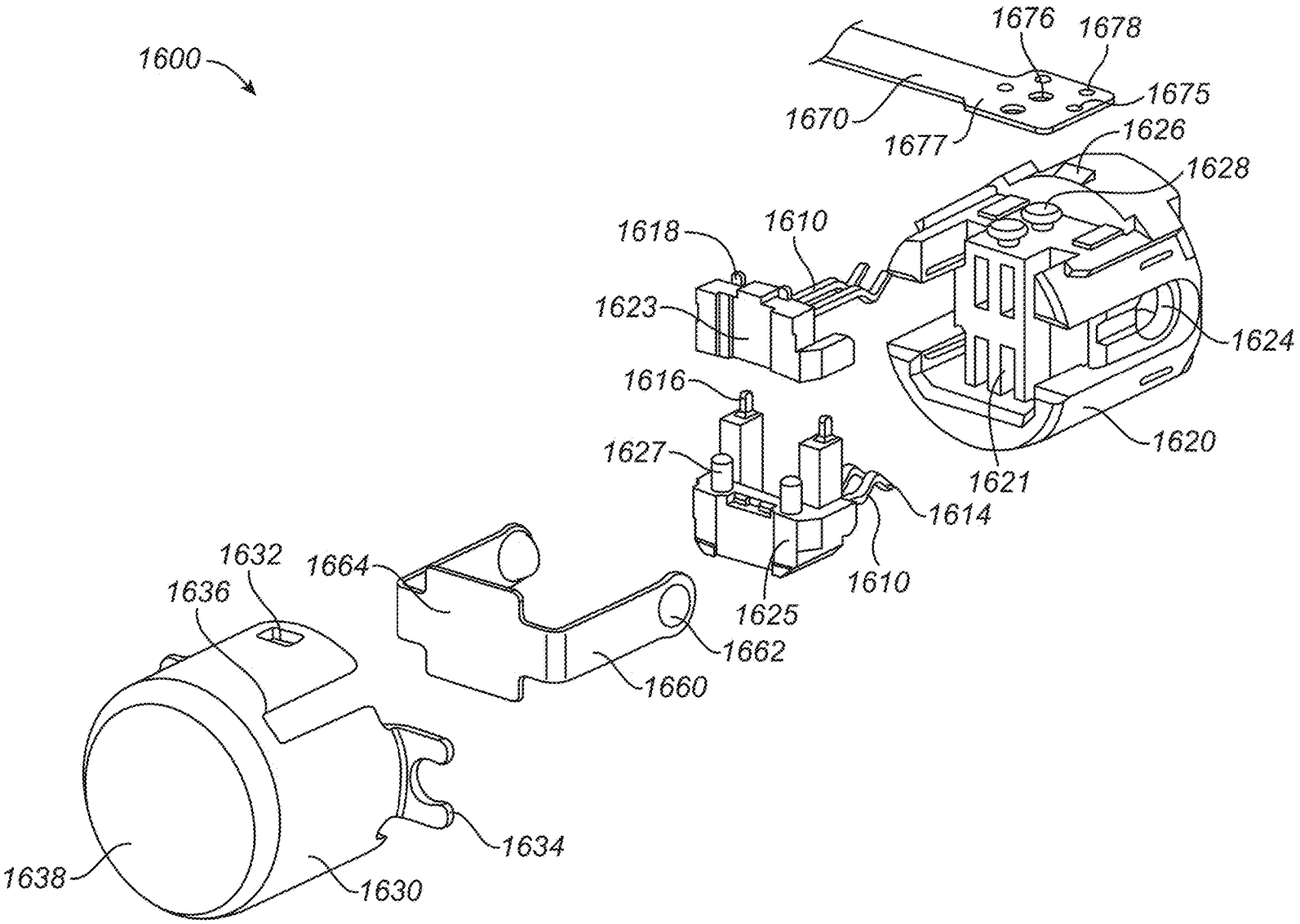
FIG. 17 is an exploded view of a connector receptacle according to an embodiment of the present invention.

FIG. 17 is an exploded view of a connector receptacle according to an embodiment of the present invention. Connector receptacle 1600 can include flexible circuit board 1670 having openings 1675, openings 1676, and openings 1678 on first end 1677. Openings 1676 can accept tabs 1628 on housing 1620 to secure first end 1677 of flexible circuit board 1670 in place relative to housing 1620. Tab 1626 on housing 1620 can fit in opening 1632 of shield 1630 to secure shield 1630 to housing 1620.

Housing portions 1623 and 1625 can each support two contacts 1610 having contacting portions 1614. Tabs 1627 on housing portion 1625 can fit in openings (not shown) in an underside of housing portion 1623. Contacts 1610 on housing portion 1623 can terminate in posts 1618. Posts 1618 can fit in, and be soldered to, openings 1675 on flexible circuit board 1670, thereby forming an electrical connection from contacts 1610 of housing portion 1623 to traces (not shown) of flexible circuit board 1670. Similarly, contacts 1610 of housing portion 1625 can terminate in posts 1616, which can fit in, and be soldered to, openings 1675 of flexible circuit board 1670. In this way, contacts 1610 of housing portion 1625 can electrically connect to traces (not shown) of flexible circuit board 1670. Further, contacts 1610 of connector receptacle 1600 can connect to corresponding contacts 1672 on second end 1679 (shown in FIG. 16) of flexible circuit board 1670.

Contacts 1610 of housing portion 1623 and contacts 1610 of housing portion 1625 can fit in rear openings 1621 in housing 1620. Bracket 1660 can fit behind housing portion 1623 and housing portion 1625. Bracket 1660 can include side ground contacts 1662, which can fit in openings 1624 of housing 1620. Shield 1630 can include slot 1636 to allow passage of flexible circuit board 1670. A back side 1638 of shield 1630 can be soldered to a back portion 1664 of bracket 1660 at locations 1639 (shown in FIG. 16.) Shield 1630 can further include tabs 1634. Tabs 1634 can be used in securing connector receptacle 1600 in place in an electronic device (not shown) housing connector receptacle 1600.

Contacting portions 1614 of contacts 1610 can mate with contacts 1210 of connector insert 1200 when connector insert 1200 is inserted into connector insert 1300. This arrangement can be particularly useful in devices such as audio headphones. Data and power can be shared among two or more of the earcups (not shown) and headband (not shown) of the headphones. For example, power received at or stored in a battery in a first earcup can be provided to a second earcup. Data can also be transferred between the first and second earcups.

Housing 1620, housing portion 1623, and housing portion 1625 can be formed of plastic, nylon, or other nonconductive material. Contacts 1610, bracket 1660, and shield 1630 can be formed of copper, steel, bronze, or other conductive materials. One or more of these structures can be plated to protect against corrosion.

These and other embodiments of the present invention can provide a connector receptacle having contacts where the contacts have contacting portions at a first end, and where the contacting portions mate with corresponding contacts of a corresponding connector insert when the connector insert is mated with the connector receptacle. The contacts can further have posts at second ends, where the posts are connected to a first end of a flexible circuit board. The flexible circuit board can terminate at a second end, where the second end supports contacts that can be soldered to wires. The wires can extend from contacts at the second end of the flexible circuit board to a junction box, where the junction box can be connected to conduits or wires that further connect to circuits and components in the electronic device housing the connector receptacle.

The contacts, connector receptacle, and first end of the flexible circuit board can rotate relative to the device enclosure, while the second end of the flexible circuit board does not rotate. An amount of slack or excess length can be provided in the flexible circuit board between the first end of the flexible circuit board and the second end of the flexible circuit board. As the first end of the flexible circuit board rotates, the slack can be increased or decreased, depending on the direction of rotation. This can allow connections between contacts in the connector receptacle and the electronic device to be maintained as the connector receptacle rotates relative to the device enclosure.

The contacts, connector receptacle, flexible circuit board, and junction box can articulate relative to the device enclosure. An amount of slack can be provided in the wires between the junction box and the circuits and components in the electronic device. As the connector receptacle articulates, the slack in the wires can vary, depending on the direction of articulation. This can allow connections between contacts in the connector receptacle and circuits and components in the electronic device to be maintained as the connector receptacle articulates relative to the device enclosure. An example is shown in the following figure.

Figure 18:
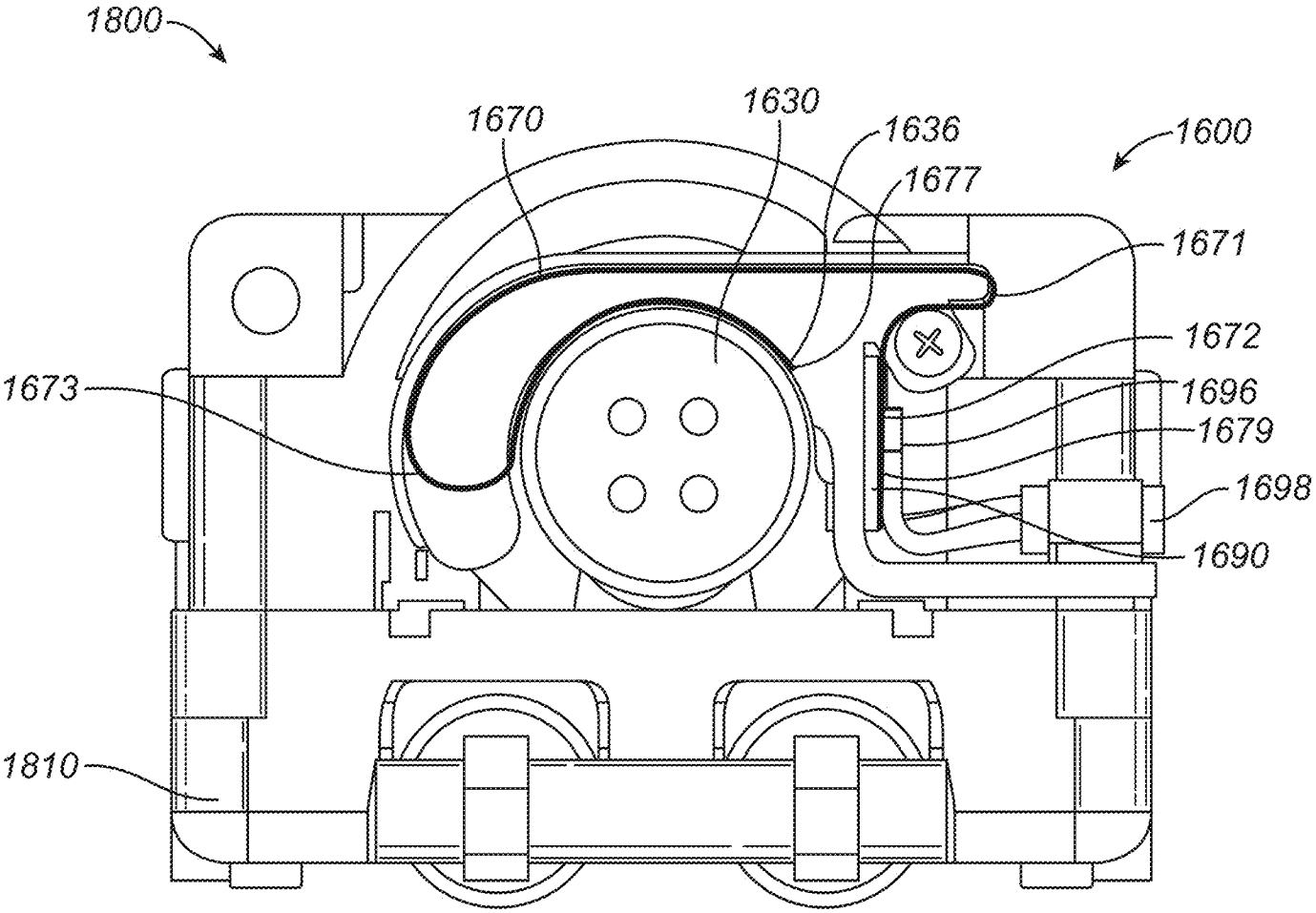
FIG. 18 illustrates a rear view of a connector receptacle and associated structures according to an embodiment of the present invention.

FIG. 18 illustrates a rear view of a connector receptacle and associated structures according to an embodiment of the present invention. In this example, connector receptacle 1600 can be included as part of connector receptacle assembly 1800, along with connector receptacle assembly housing 1810. Connector receptacle 1600 can include shield 1630 and flexible circuit board 1670. Flexible circuit board 1670 can include an excess length or slack in loop 1673. Flexible circuit board 1670 can also include loop 1671. Flexible circuit board 1670 can attach to contacts 1610 inside shield 1630 (as shown in FIG. 17) at a first end 1677. Flexible circuit board 1670 can further include second end 1679 supporting contacts 1672. Contacts 1672 can be soldered to ends of wires 1696. Wires 1696 can be connected to junction box 1698. Second end 1679 of flexible circuit board 1670 can be supported by stiffener or cowling 1690.

Again, shield 1630 along with housing 1620 (shown in FIG. 17) can rotate about a central axis. As shield 1630 and housing 1620 rotate, the amount of slack or excess length in loop 1673 in flexible circuit board 1670 can increase or decrease. Shield 1630, housing 1620, and flexible circuit board 1670, stiffener or cowling 1690, and junction box 1698 can also articulate through a plane through the central axis. Wires (not shown) or other conduits can be used to connect junction box 1698 to other circuits inside an electronic device that houses connector receptacle assembly 1800. In this way, housing 1620 and shield 1630 can rotate and articulate while maintaining a connection from contacts 1610 (shown in FIG. 17) to circuitry and components in the electronic device. Examples of these movements are shown in the following figures.

Figure 19:
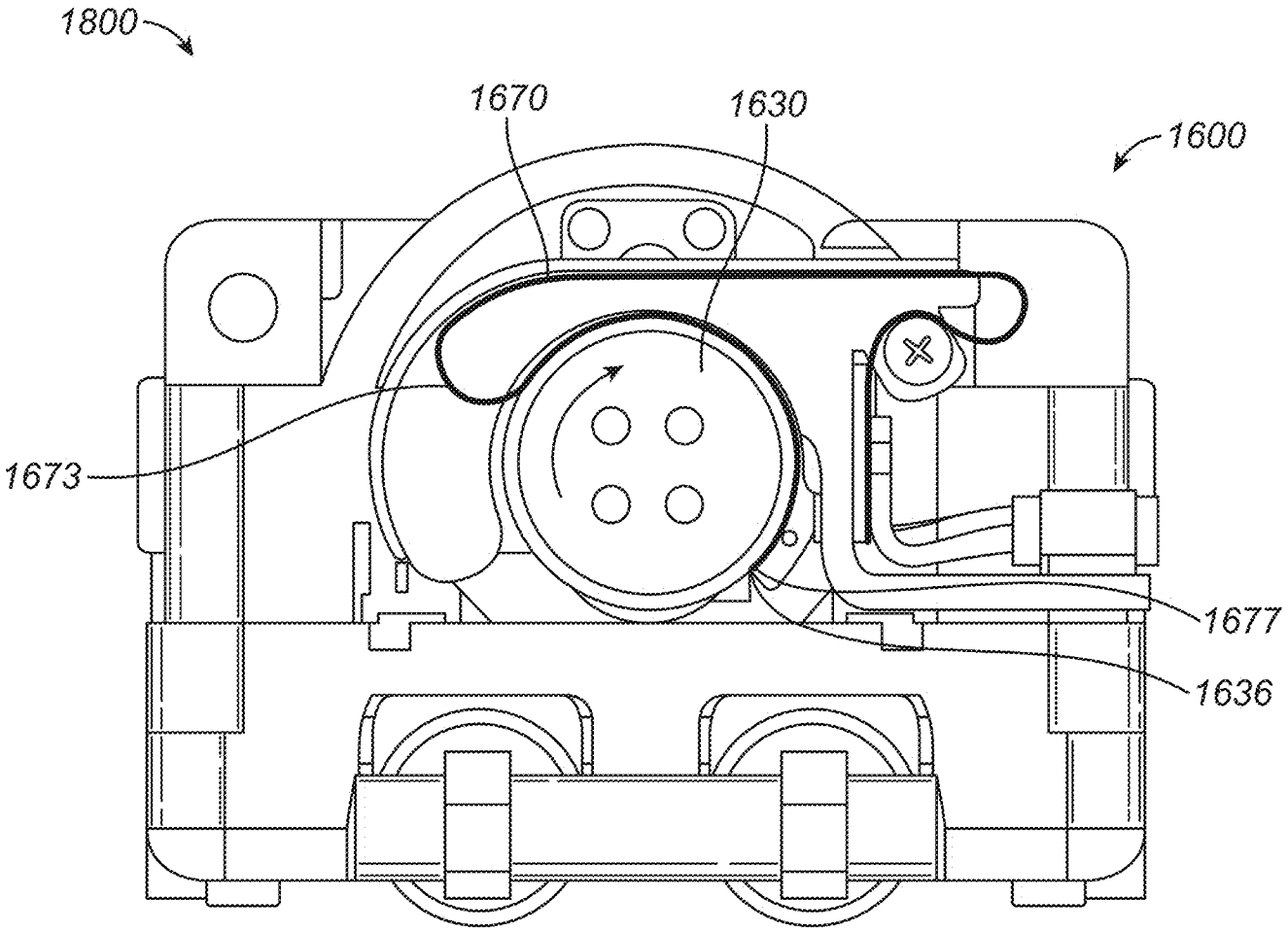
FIGS. 19-21 illustrates a rotation and articulation of a connector receptacle in a connector receptacle assembly according to an embodiment of the present invention.
Figure 20:
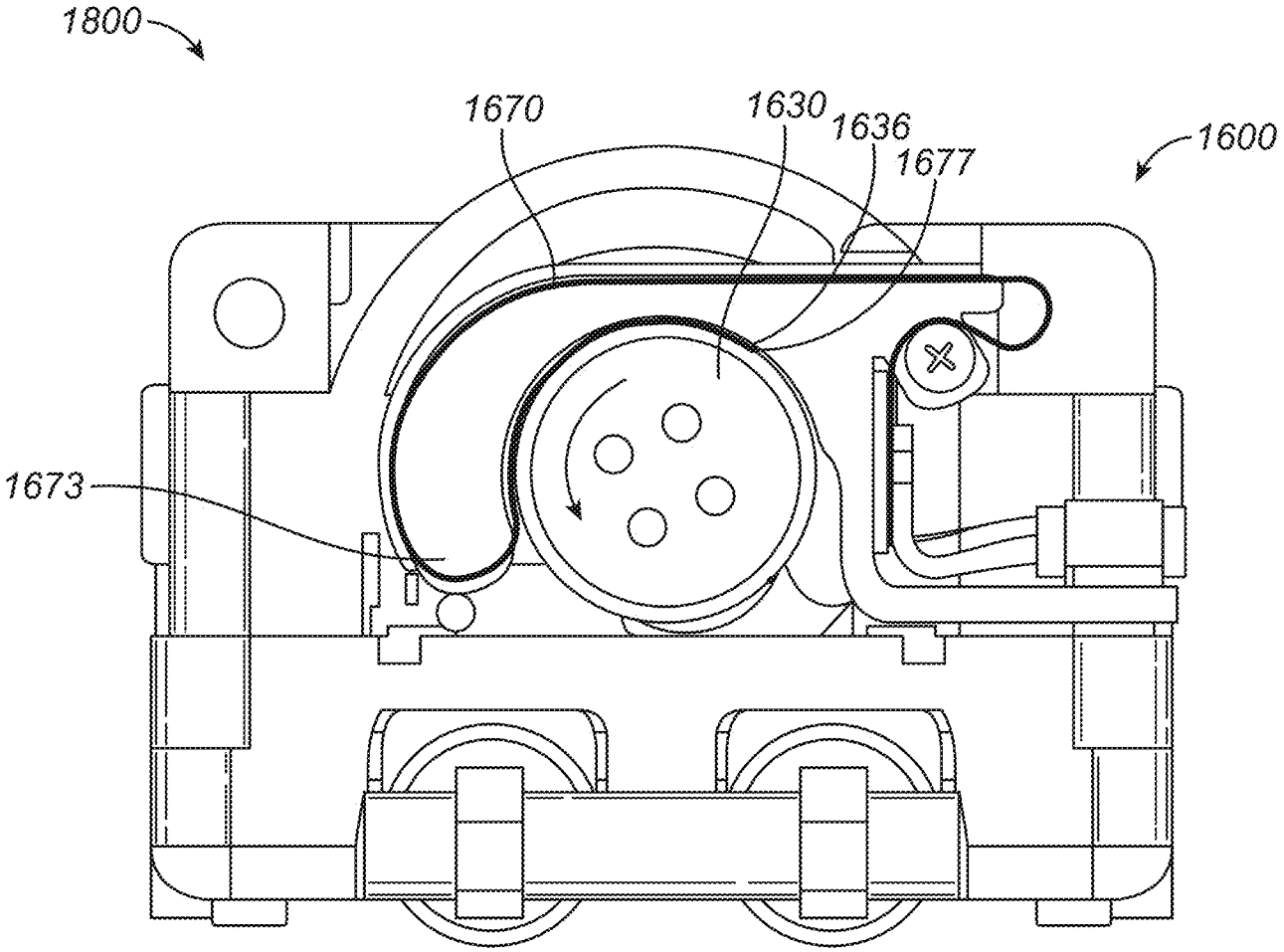
Figure 21:
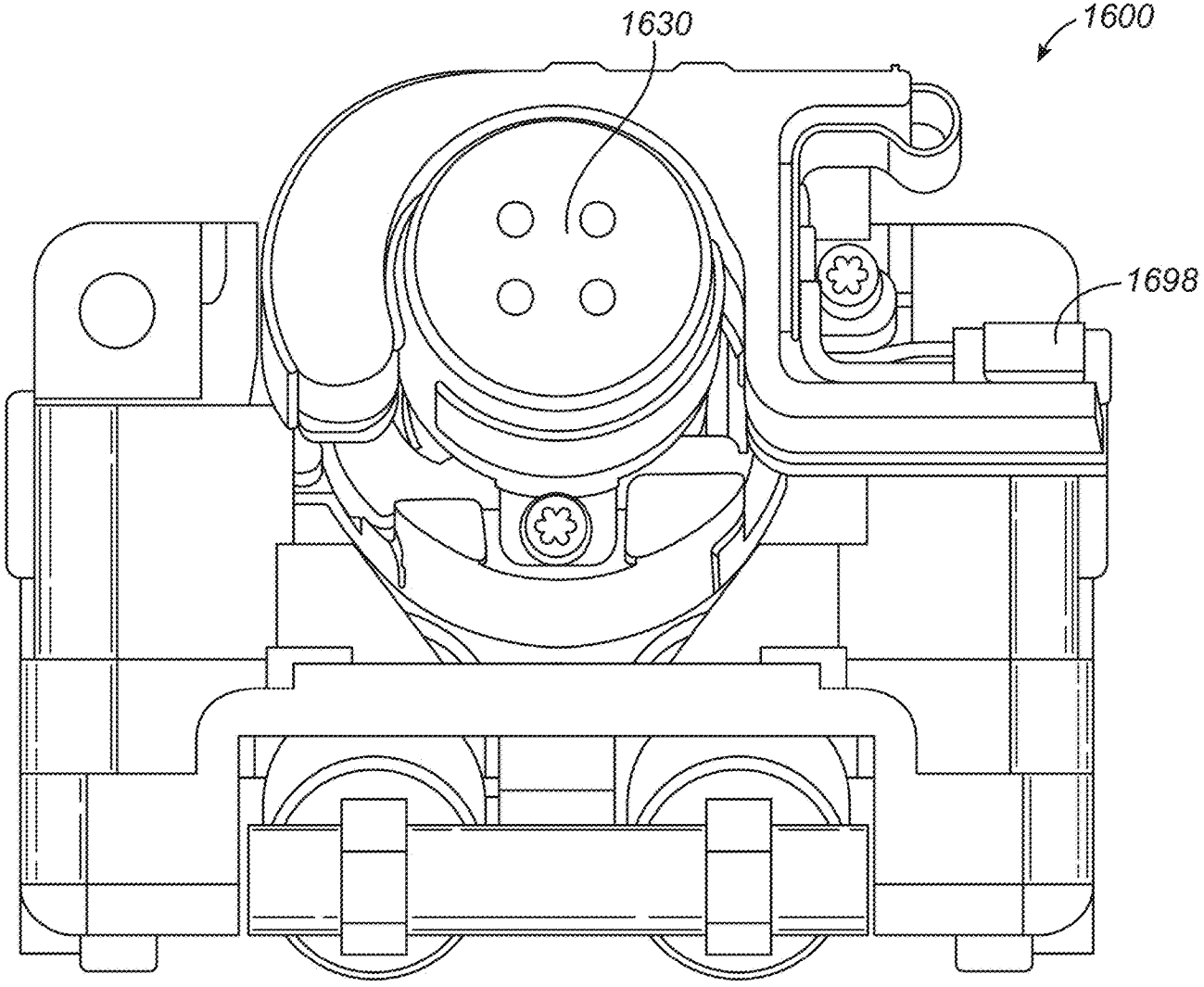

FIGS. 19-21 illustrates a rotation and articulation of a connector receptacle in a connector receptacle assembly according to an embodiment of the present invention. In FIG. 19, housing 1620 (shown in FIG. 17) and shield 1630 of connector receptacle 1600 can be rotated in a clockwise direction as shown relative to a remaining portion of connector receptacle assembly 1800. Accordingly, a slack in loop 1673 in flexible circuit board 1670 can be reduced as more of flexible circuit board 1670 is consumed along an outside surface of shield 1630 by the clockwise rotation of first end 1677 of flexible circuit board 1670 and slot 1636 in shield 1630. In FIG. 20, housing 1620 (shown in FIG. 17) and shield 1630 of connector receptacle 1600 can be rotated in a counterclockwise direction relative to the remaining portion of connector receptacle assembly 1800. Accordingly, slack in loop 1673 in flexible circuit board 1670 can be increased as less of flexible circuit board 1670 is consumed along the outside surface of shield 1630 by the counter-clockwise rotation of first end 1677 of flexible circuit board 1670 and slot 1636 in shield 1630. In FIG. 21, housing 1620 (shown in FIG. 17) and shield 1630 of connector receptacle 1600 can be articulated or tilted relative to a remaining portion of connector receptacle assembly 1800. Wires (not shown) connected to junction box 1698 can connect to circuits and components in the electronic device (not shown) housing connector receptacle assembly 1800.

In some circumstances, it can be disadvantageous for a connector insert to be able to easily disconnect from a connector receptacle. To guard against such an inadvertent disconnection, these and other embodiments of the present invention can provide a locking mechanism to secure a connector insert in place in a connector receptacle assembly. These locking mechanisms can be particularly useful in devices such as audio headphones. For example, a locking mechanism can prevent an inadvertent disconnection between a headband and an earcup of the audio headphones, which could otherwise be caused by a listener's activity, such as running or working out.

For example, a connector receptacle assembly can include a locking mechanism that locks a connector insert in place when the connector insert is inserted into the connector receptacle assembly. The connector insert can have a sliding or otherwise movable control mechanism that can be actuated to effect a release of the connector insert from the connector receptacle assembly. Examples are shown in the following figures.

Figure 22:
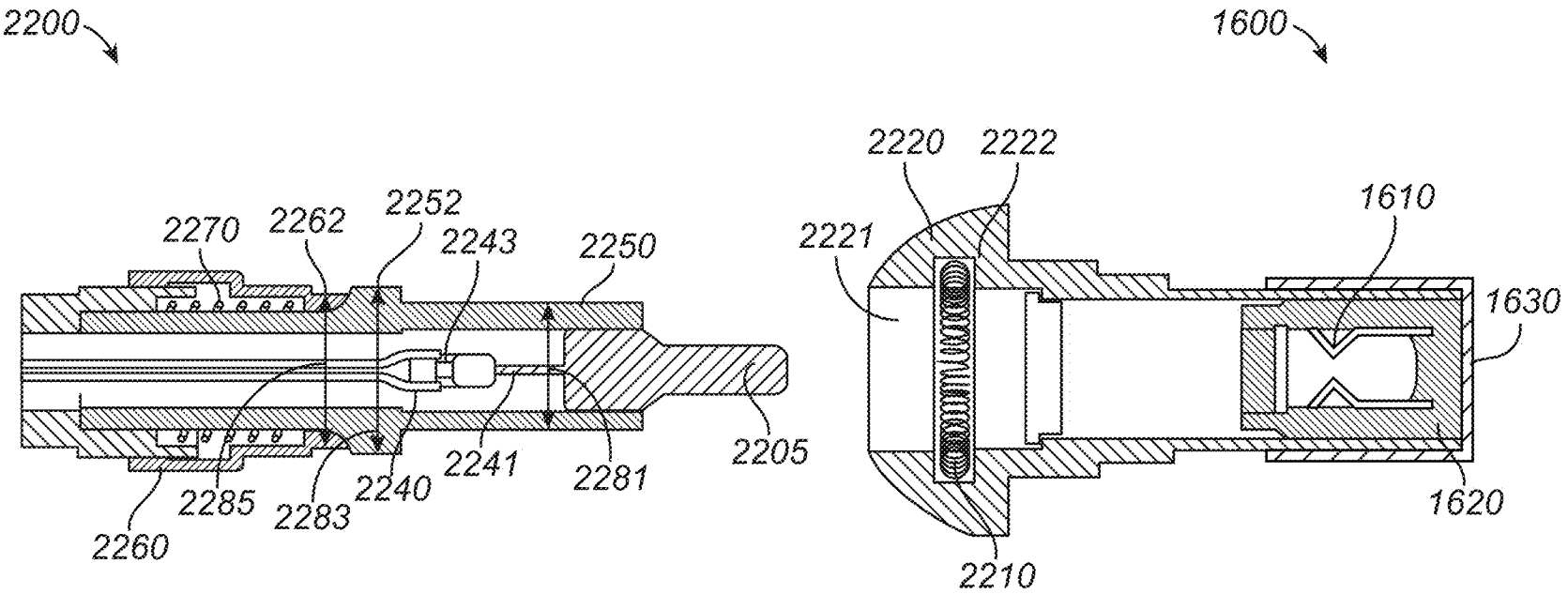
FIG. 22 illustrates a locking mechanism according to an embodiment of the present invention for attaching a connector insert to a connector receptacle.

FIG. 22 illustrates a locking mechanism according to an embodiment of the present invention for attaching a connector insert to a connector receptacle. This example utilizes canted spring 2210 (also referred to as a canted coil spring.) Canted spring 2210 can have the following properties: First, when canted spring 2210 is relaxed or in a groove geometry that allows the cant-direction to flip into one of two stable directions, canted spring 2210 might only provide a nominal resistance to an insertion and extraction; and second, when canted spring 2210 is in a constrained groove and compressed radially, canted spring 2210 can enter a state where canted spring 2210 provides a nominal resistance to an insertion (more specifically, a nominal resistance to movement in the same direction) and a large resistance to an extraction (more specifically, a large resistance to movement in the opposing direction). As such, when connector insert 1200 is inserted into connector receptacle 1600, canted spring 2210 can be positioned in a constrained groove and can provide minimal insertion resistance. Once connector insert 1200 is in place in connector receptacle 1600, so long as canted spring 2210 remains in the constrained groove, canted spring 2210 can provide a large resistance to an extraction of connector insert 1200. This can help to avoid an inadvertent extraction of connector insert 1200 from connector receptacle 1600. In order to release connector insert 1200, the groove geometry can be altered, thereby allowing the cant-direction to flip on extraction reducing the resistance to the extraction of connector insert 1200.

In this implementation, connector insert 2200 can include tongue 2205, which can support contacts (not shown) for mating with contacts 1610 in connector receptacle 1600. Connector insert 2200 can further include board 2241 and contacts 2243. Conductors 2240 can be soldered to contacts 2243. Connector insert 2200 can be partially encased by shell 2250. Shell 2250 can have various widths or diameter along its length. For example, shell 2250 can have a diameter 2281 along a front portion, followed by a wider diameter 2283 at step 2252. Sliding portion 2260 can be placed around a rear portion of shell 2250. Spring 2270 can bias sliding portion 2260 against step 2252 of shell 2250. Sliding portion 2260 can include a front end 2262 having diameter 2285.

Connector insert 2200 can be inserted into opening 2221 in front housing 2220. Contacts on tongue 2205 can physically and electrically connect to contacts 1610 in housing 1620 of connector receptacle 1600 when connector insert 2200 is mated with connector receptacle 1600. Canted spring 2210 can be located in slot or groove 2222 in front housing 2220. Housing 1620 can be shielded by shield 1630.

As connector insert 2200 is inserted into connector receptacle 1600, canted spring 2210 can first encounter shell 2250. Since canted spring 2210 is in the relaxed state and not compressed radially in a constrained groove, only a nominal insertion force is needed to insert connector insert 2200 into connector receptacle 1600. Step 2252 of shell 2250 can then encounter canted spring 2210, thereby stretching canted spring 2210 over the larger diameter 2283 and compressing radially. Once canted spring 2210 reaches narrowed front end 2262 of sliding portion 2260, connector insert 2200 is fully inserted into connector receptacle 1600. At this position, canted spring 2210 enters a constrained groove and can provide a significant resistance to an extraction of connector insert 2200. This state is shown further in the following figure.

Figure 23:
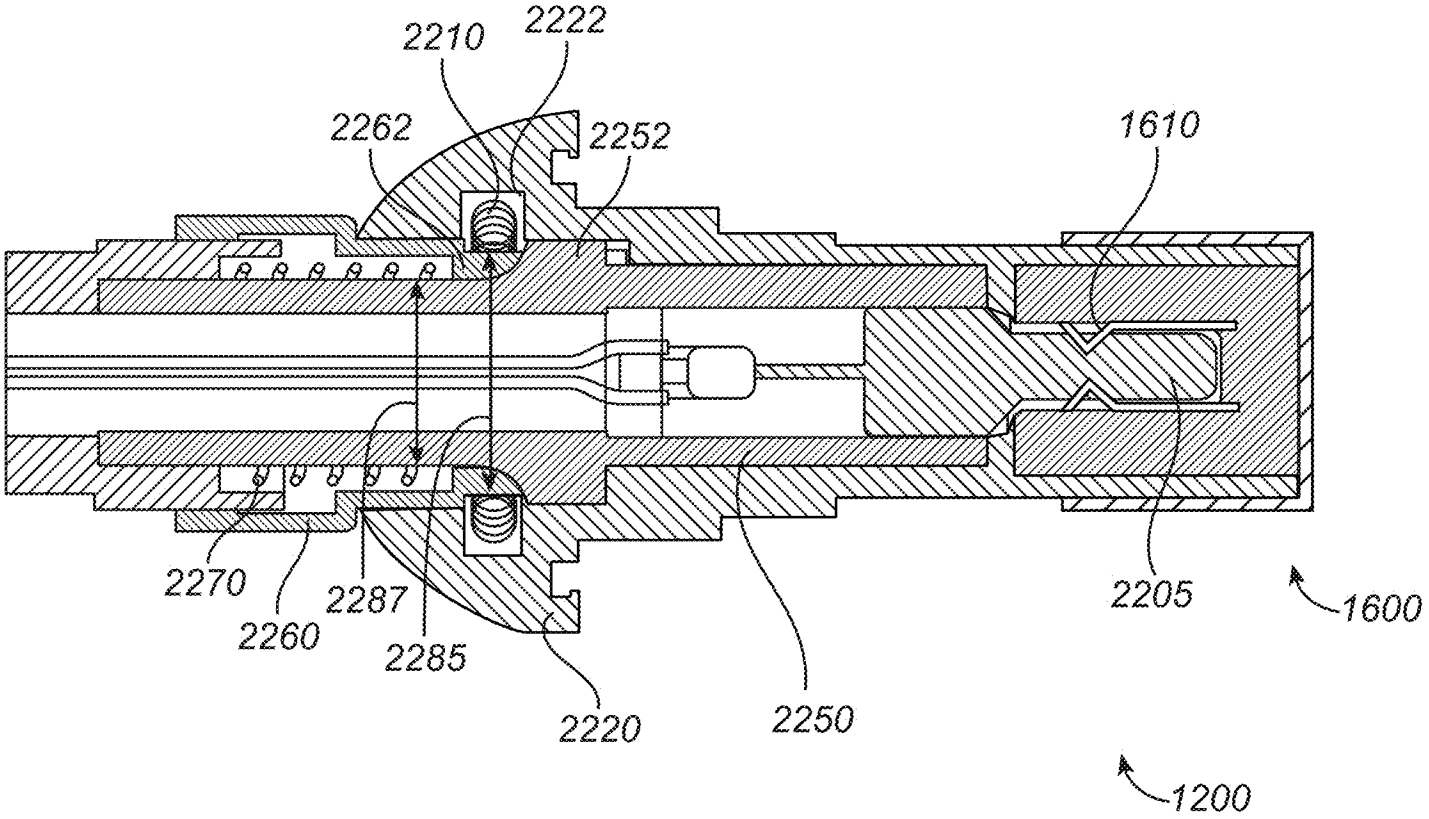
FIG. 23 illustrates a connector insert held in place in a connector receptacle by a locking mechanism according to an embodiment of the present invention.

FIG. 23 illustrates a connector insert held in place in a connector receptacle by a locking mechanism according to an embodiment of the present invention. In this example, connector insert 2200 has been fully inserted into connector receptacle 1600. Contacts on tongue 2205 of connector insert 2200 can physically and electrically connect to contacts 1610 in connector receptacle 1600. Canted spring 2210 can be located in slot or groove 2222 in front housing 2220. Canted spring 2210 can be stretched to an inside width or diameter 2285 by a front end 2262 of sliding portion 2260. Spring 2270 can bias front end 2262 of sliding portion 2260 against step 2252 of shell 2250.

Connector insert 2200 can be extracted from connector receptacle 1600 by sliding portion 2260 away from step 2252. This can allow canted spring 2210 to relax to the diameter of 2287 into a larger groove shaped to allow the cant-direction to flip upon extraction and cause canted spring 2210 to provide only a nominal resistance to the extraction of connector insert 2200 from connector receptacle 1600. Once connector insert 2200 has been fully extracted from connector receptacle 1600, canted spring 2210 can be in a relaxed state and can provide a nominal resistance to the next insertion of connector insert 2200.

In these and other embodiments of the present invention, a sliding mechanism can move an interference structure into a position where it interferes with an extraction of a connector insert from a connector receptacle. An example is shown in the following figure.

Figure 24:
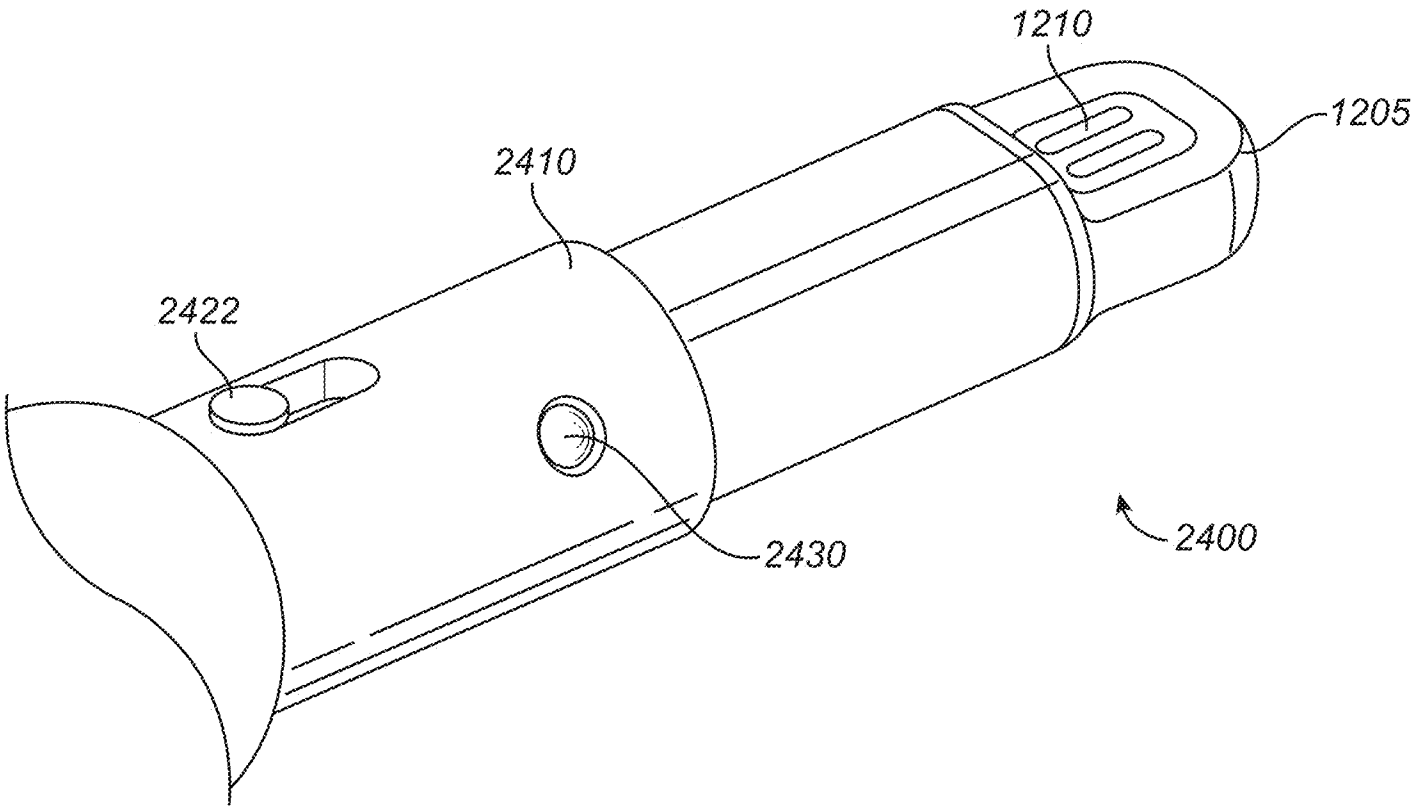
FIG. 24 illustrates a connector insert according to an embodiment of the present invention.

FIG. 24 illustrates a connector insert according to an embodiment of the present invention. In this example, connector insert 2400 can include a tongue 1205 supporting contacts 1210. A sliding mechanism 2422 can be located in housing 2410. Sliding mechanism 2422 can be moved between two positions. When sliding mechanism 2422 is in a first position, interference structure 2430 can be flush or recessed below a surface of housing 2410. When sliding mechanism 2422 is in a second position, interference structure 2430 can extend the above a surface of housing 2410, thereby providing an interference fit with a corresponding structure on a connector receptacle (not shown) in order to prevent an inadvertent extraction of the connector insert from the connector receptacle.

Figure 25:
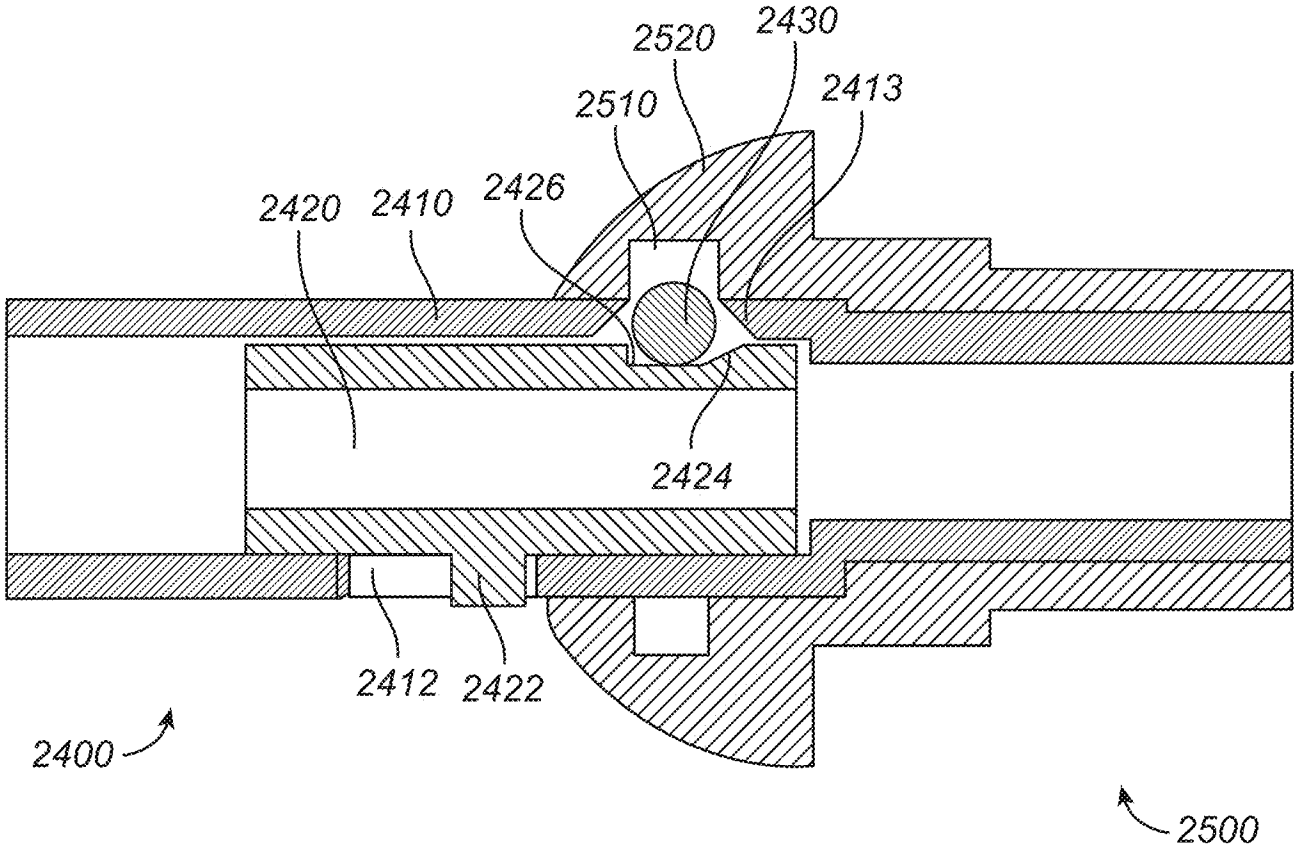
FIG. 25 is a cutaway side-view of a locking mechanism according to an embodiment of the present invention.

FIG. 25 is a cutaway side-view of a locking mechanism according to an embodiment of the present invention. In this example, connector insert 2400 has been inserted into connector receptacle 2500, but is not yet been locked in place. In this example, sliding mechanism 2422 of locking mechanism 2420 can be in a forward position in opening 2412. Interference structure 2430, shown here as a sphere, can be located in recess 2426 behind ramp 2424 of locking mechanism 2420. Interference structure 2430 can be located in notch 2413 in housing 2410. Interference structure 2430 can be aligned with notch 2510 in housing 2520 of connector receptacle 2500. In order to lock connector insert 2400 in place in connector receptacle 2500, sliding mechanism 2422 can be slid backward in opening 2412. This can force interference structure 2430 to slide up ramp 2424 of locking mechanism 2420 and into notch 2510. This can cause an interference fit preventing an accidental extraction of connector insert 2400 from connector receptacle 2500. This locked state is shown further in the following figure.

Figure 26:
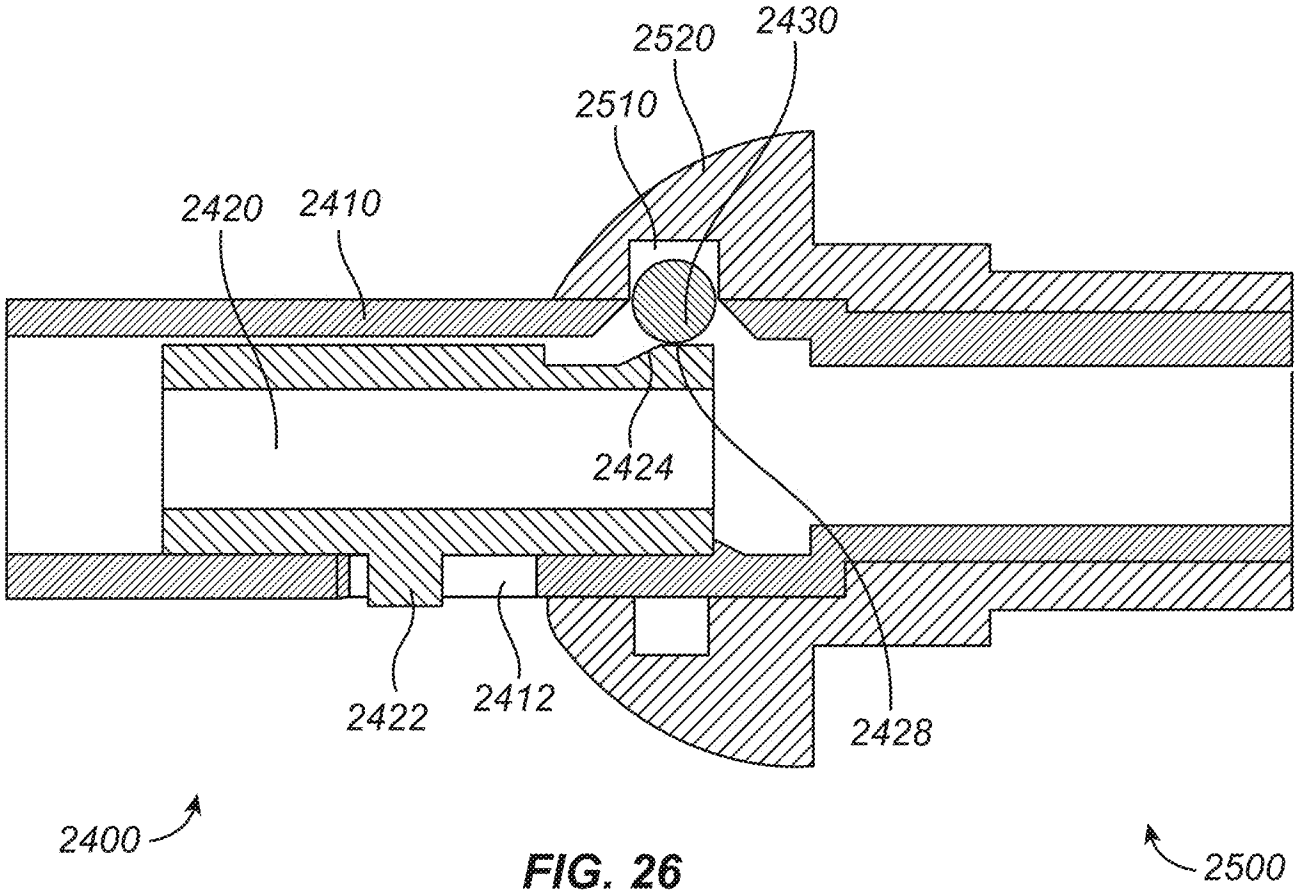
FIG. 26 is a cutaway side-view illustrating a locking mechanism according to an embodiment of the present invention.

FIG. 26 is a cutaway side-view illustrating a locking mechanism according to an embodiment of the present invention. In this example, sliding mechanism 2422 has been slid backward in opening 2412. This backward movement of locking mechanism 2420 can force interference structure 2430 up ramp 2424 to position 2428. In this configuration, interference structure 2430 can extend the above a surface of housing 2410 and can extend into notch 2510 in housing 2520 of connector receptacle 2500. The extension of interference structure 2430 into notch 2510 can provide an interference fit between connector insert 2400 and connector receptacle 2500, thereby a helping to prevent an accidental extraction of connector insert 2400 from connector receptacle 2500.

These and other embodiments of the present invention can provide other locking mechanisms where a locking mechanism locks a connector insert in place when the connector insert is inserted into the connector receptacle assembly. To release the connector insert, the connector insert can be rotated beyond an expected range (overturned) whereupon the connector insert can be released. Examples are shown in the following figures.

Figure 27:
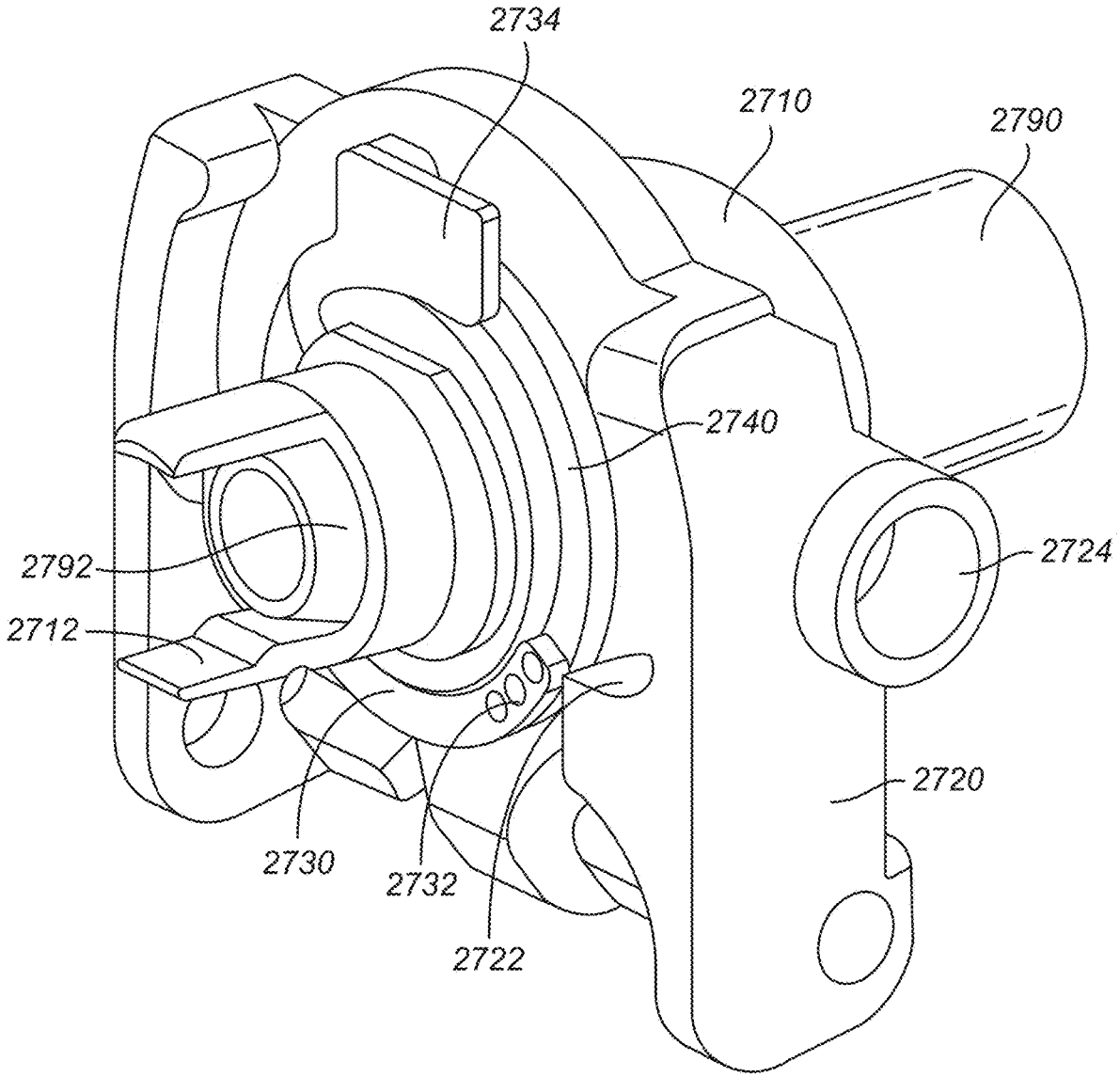
FIG. 27 illustrates a locking mechanism according to an embodiment of the present invention.

FIG. 27 illustrates a locking mechanism according to an embodiment of the present invention. In this example, a portion 2790 of a connector insert, such as connector insert 1200 (shown in FIG. 12) can be inserted into connector receptacle locking assembly 2700. Connector receptacle locking assembly 2700 can include front housing 2710 having extensions 2712. Extensions 2712 can be used to secure a connector receptacle, such as connector receptacle 1600, to connector receptacle locking assembly 2700. Connector receptacle locking assembly 2700 can further include bearing 2720 having stop 2722. Clip carrier 2740 can support clip 2730. Clip 2730 can be spot or laser welded to clip carrier 2740 at locations 2732. Clip 2730 can include wide portion 2734 and interference portion 2736 (shown in FIG. 29.) Interference portion 2736 can fit in a slot or groove (not shown) in connector insert portion 2790 to lock connector insert portion 2790 in place in connector receptacle locking assembly 2700.

Bearing 2720 can pivot about axis 2724 relative to device enclosure 110 (shown in FIG. 1) and front housing 2710 can rotate axially in bearing 2720 relative to device enclosure 110. This arrangement allow connector insert portion 2790, or other connector insert, such as connector insert 1200 in FIG. 13, to move relative to device enclosure 110. For example, connector insert 1200 can rotate relative to device enclosure 110 and bearing 2720 about its primary axis.

Connector insert 1200 can also tilt or articulate about axis 2724 relative to device enclosure 110. A connector receptacle, such as connector receptacle 1600 (shown in FIG. 16), can be attached to extensions 2712 of front housing 2710 and can rotate and articulate along with connector insert 1200. In such a configuration, bearing 2720 can be a moment-compensator bearing.

Connector insert portion 2790 can have a front tapered edge 2792 that can deflect interference portion 2736 of clip 2730, thereby allowing an insertion of connector insert portion 2790. Once locked in place, clip 2730 can act to retain connector insert portion 2790 in place in connector receptacle locking assembly 2700. To remove connector insert portion 2790, connector insert portion 2790 can be rotated until wide portion 2734 of clip 2730 reaches stop 2722 of bearing 2720. A further rotation (referred to as an overturn) beyond this point can cause clip 2730 to distort and can cause interference portion 2736 to be pulled out of the slot or groove in connector insert portion 2790, thereby allowing connector insert portion 2790 to be extracted from connector receptacle locking assembly 2700. Examples of this are shown in the following figures.

Figure 28C:
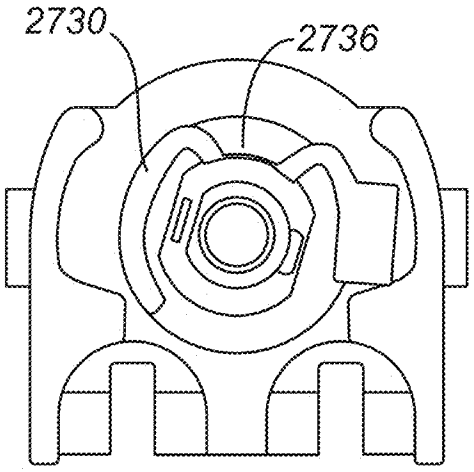
FIG. 28A-28C illustrate the operation of the overturn lock of FIG. 27.
Figure 28B:
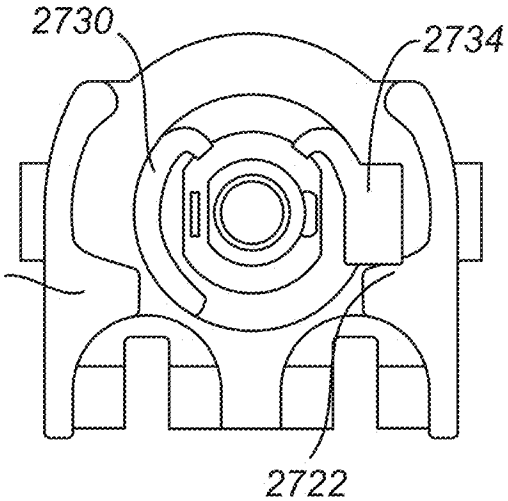
Figure 28A:
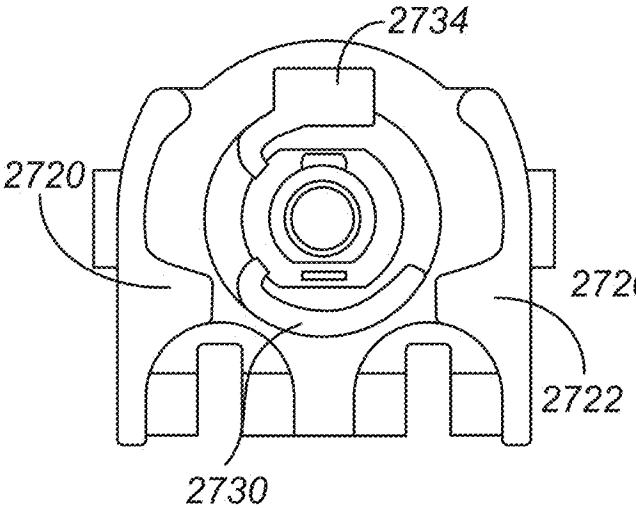

FIG. 28A-28C illustrate the operation of the overturn lock of FIG. 27. In FIG. 28A, clip 2730 can be at a normal position and wide portion 2734 of clip 2730 can be away from stop 2722 of bearing 2720. In FIG. 28B, connector insert portion 2790 can be turned, in this example approximately 90 degrees, until wide portion 2734 of clip 2730 reaches stop 2722 of bearing 2720. FIG. 28C shows that with further overturning, clip 2730 can begin to distort. Interference portion 2736 can be pushed by this distortion out of a groove (not shown) in connector insert portion 2790 (shown in FIG. 26.)

Figure 29:
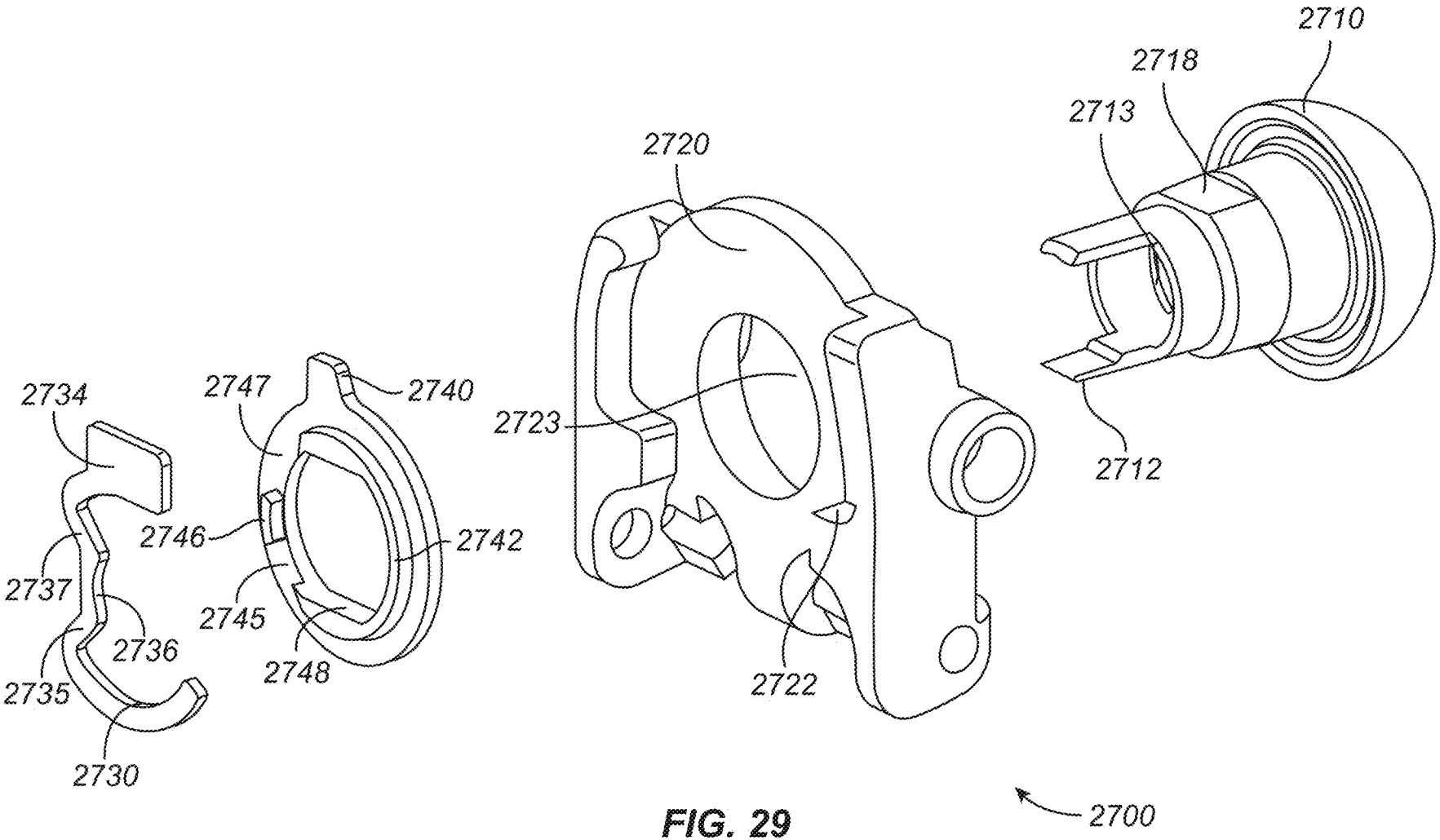
FIG. 29 is an exploded view of the locking mechanism of FIG. 27.

FIG. 29 is an exploded view of the locking mechanism of FIG. 27. In this example, connector receptacle locking assembly 2700 can include front housing 2710. Front housing 2710 can include alignment portion 2718 for mating with features 3748 of clip carrier 2740. Front housing 2710 can further include a slot 2713 through which interference portion 2736 can fit when it is located in a groove slot on a corresponding connector insert (not shown.) Front housing 2710 can further include extensions 2712. A connector receptacle, such as connector receptacle 1600 (shown in FIG. 16) can be attached to extensions 2712.

Connector receptacle locking assembly 2700 can further include bearing 2720 having passage 2723 for accepting front housing 2710. Bearing 2720 can further include stop 2722. Clip carrier 2740 can include raised features 2742 and 2746 separated by gaps 2745 and 2747. Clip 2730 can be placed on clip carrier 2740 and spot or laser welded to clip carrier 2740 as shown in FIG. 27. Clip portions 2735 and 2737 can fit in gaps 2745 and 2747 of clip carrier 2740. Interference portion 2736 can be placed inside of raised portion 2746. Wide portion 2734 can be at an opposite end of clip 2730 away from where clip 2730 is attached to clip carrier 2740.

Figure 30:
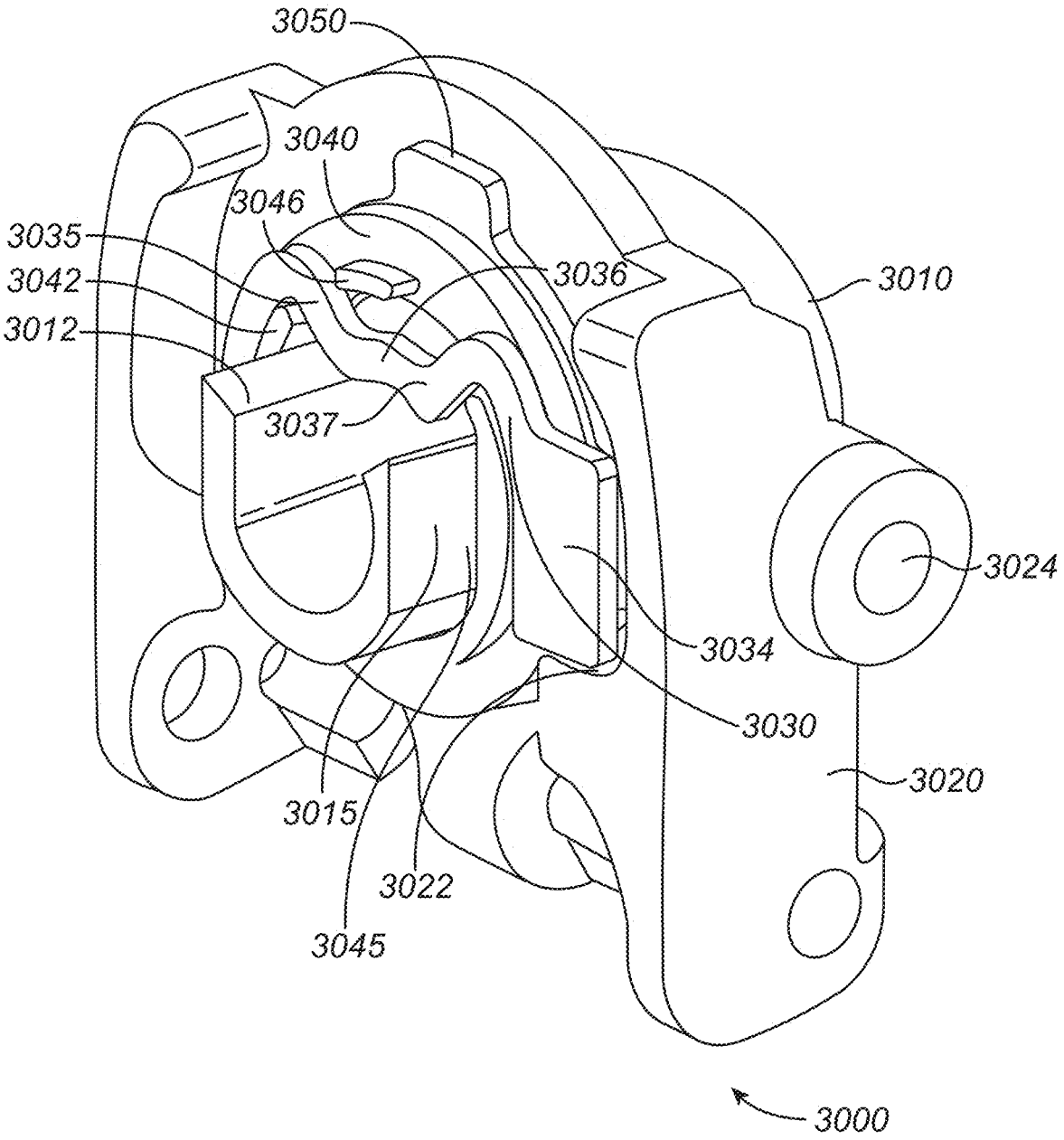
FIG. 30 illustrates another locking mechanism according to an embodiment of the present invention.

FIG. 30 illustrates another locking mechanism according to an embodiment of the present invention. In this example, connector receptacle locking assembly 3000 can include front housing 3010 and bearing 3020. Connector receptacle locking assembly 3000 can further include compression plate 3050 and disk spring 3060 (shown in FIG. 32.) Similar to the example shown in FIG. 27, connector receptacle locking assembly 3000 can further include clip carrier 3040 and clip 3030.

As before, clip 3030 can be spot or laser-welded to clip carrier 3040. Clip 3030 can include a wide portion 3034 and interference portion 3036. Joining portions 3035 and 3037 of clip 3030 can fit in gaps between raised features 3042 and 3046 on clip carrier 3040. Interference portion 3036 can fit in a groove or slot on a connector insert (not shown) via cutout 3012 in front housing 3010 to help to retain the connector insert in connector receptacle locking assembly 3000.

Bearing 3020 can pivot about axis 3024 relative to device enclosure 110 and front housing 3010 can rotate axially in bearing 3020 relative to device enclosure. This arrangement allow a connector insert, such as connector insert 1200 in FIG. 13, to move relative to device enclosure 110 (shown in FIG. 1.) For example, connector insert 1200 can rotate relative to device enclosure 110 and bearing 3020 about its primary axis. Connector insert 1200 can also tilt or articulate about axis 3024 relative to device enclosure 110. A connector receptacle, such as connector receptacle 1600 (shown in FIG. 16), can be attached to a rear of front housing 3010 and can rotate and articulate along with connector insert 1200. In such a configuration, bearing 3020 can be a moment-compensator bearing.

Front housing 3010 can include flat portion 3015 that can mate with flat portion 3045 of clip carrier 3040. As a connector insert (not shown) that is inserted into connector receptacle locking assembly 3000 is rotated, wide portion 3034 of clip 3030 can reach stop 3022 of bearing 3020. As the connector insert is rotated beyond this point, clip 3030 can distort. As before, this can cause interference portion 3036 to extract from the slot in the connector insert, thereby allowing the connector insert to be extracted from connector receptacle locking assembly 3000.

In some circumstances, it can be desirable to increase a force necessary to overturn front housing 3010 and distort clip 3030. Accordingly, embodiments of the present invention can provide structures that increase friction as this overturning occurs. Examples are shown in the following figures.

Figure 31B:
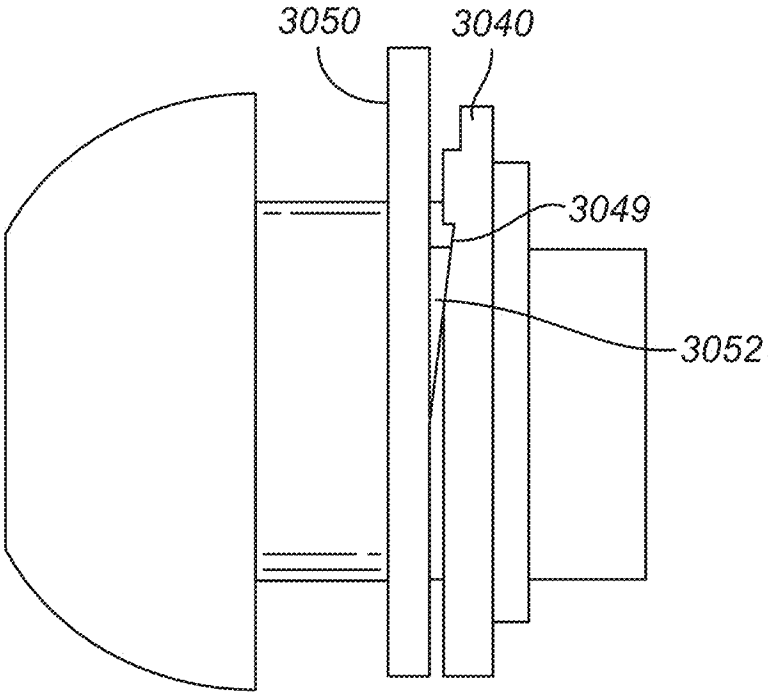
FIGS. 31A-31B illustrate a structure for generating friction during overturn of the locking mechanism of FIG. 30.
Figure 31A:
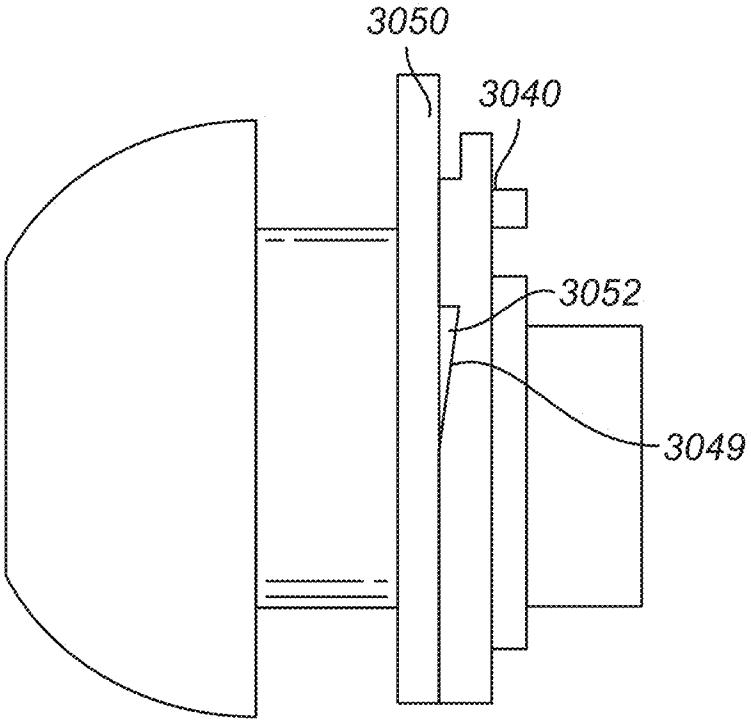

FIGS. 31A-31B illustrate a structure for generating friction during overturn of a locking mechanism according to an embodiment of the present invention. In FIG. 31A, clip carrier 3040 can include notch 3049 for accepting ramp 3052 on compression plate 3050. In FIG. 31B, compression plate 3050 can be held in place as clip carrier 3040 rotates. This can cause ramp 3052 to push clip carrier 3040 away from compression plate 3050, thereby increasing a friction resisting further rotation of clip carrier 3040.

Figure 32:
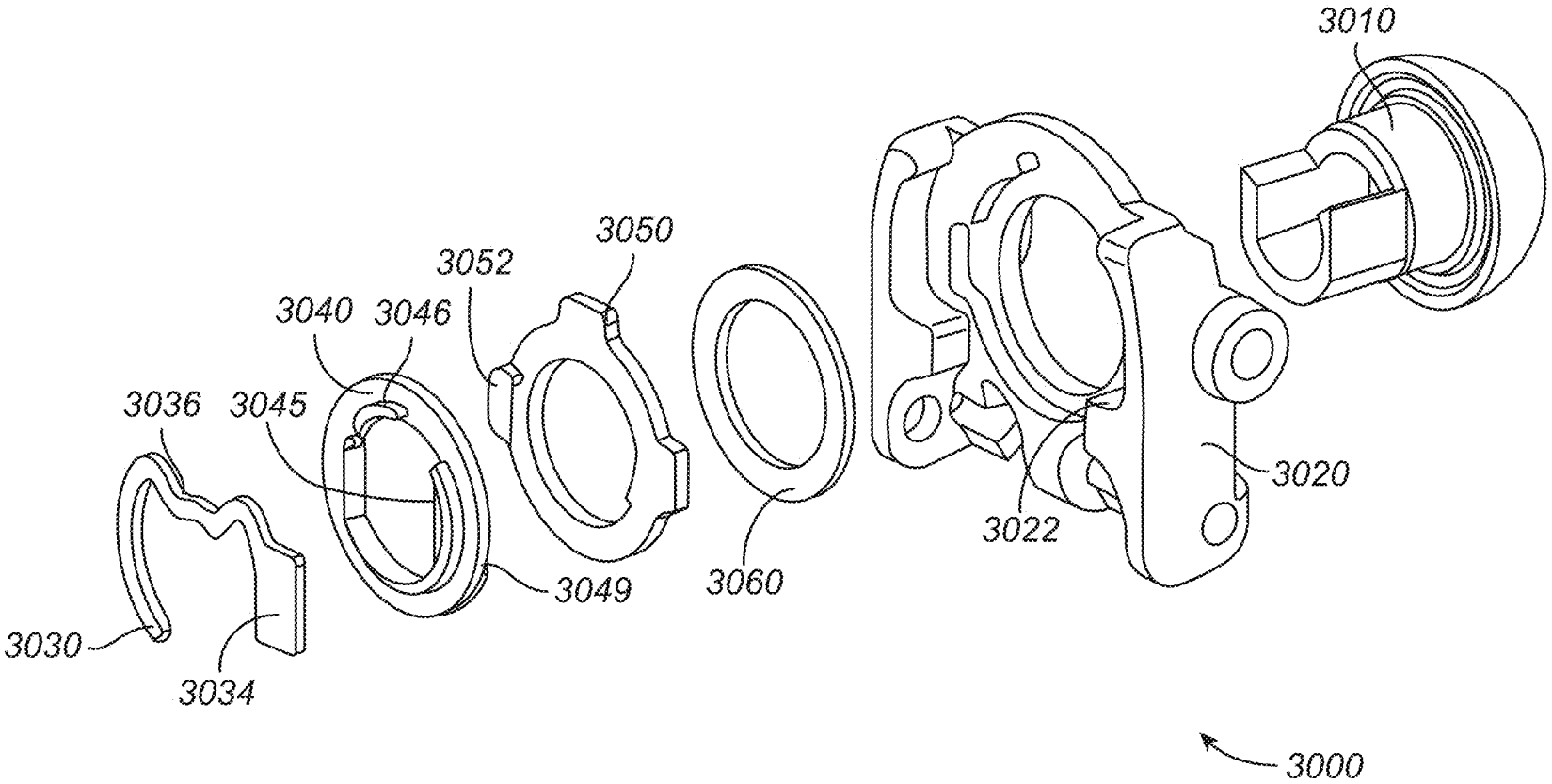
FIG. 32 is an exploded view of the connector receptacle locking assembly of FIG. 30.

FIG. 32 is an exploded view of the connector receptacle locking assembly of FIG. 30. Connector receptacle locking assembly 3000 can include front housing 3010 and bearing 3020. Bearing 3020 can include stop 3022. Clip 3030 can include interference portion 3036 and wide portion 3034. Clip 3030 can be held in place by clip carrier 3040. As shown above, clip 3030 can mate with raised features 3042 and 3046 on clip carrier 3040. Compression plate 3050 can include ramp 3052, which can fit in notch 3049 on a back surface of clip carrier 3040. Disk spring 3060 can provide a compression force on compression plate 3050.

Again, this example utilizes an increasing friction force to limit the overturning of a connector insert in a connector receptacle assembly. Instead of friction, these and other embodiments can use other forces, such as a spring force. An example is shown in the following figure.

Figure 33:
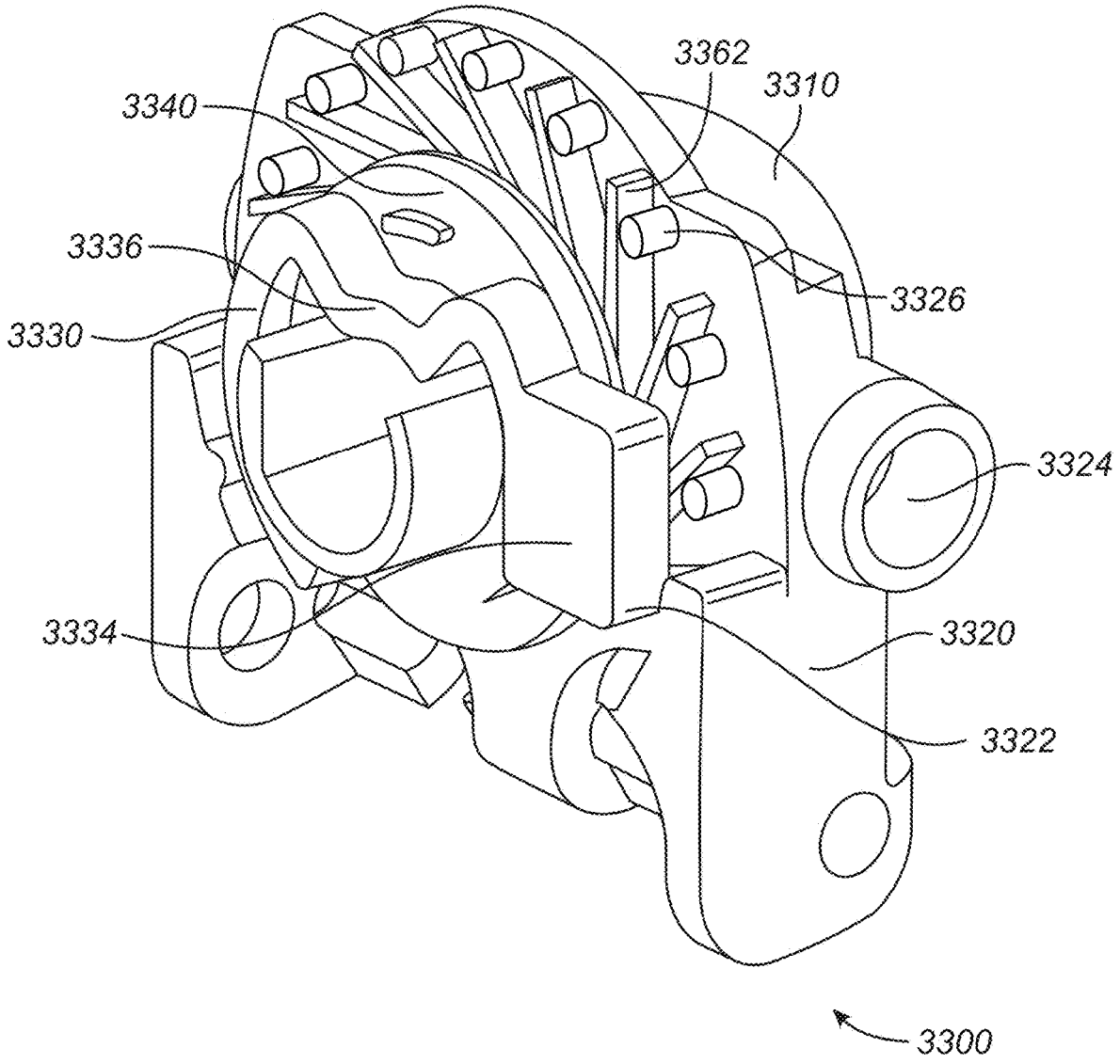
FIG. 33 illustrates a connector receptacle locking assembly according to an embodiment of the present invention.

FIG. 33 illustrates a connector receptacle locking assembly according to an embodiment of the present invention. In this example, connector receptacle locking assembly 3300 can include front housing 3310, bearing 3320, clip carrier 3040, clip 3030, and springs 3362. Instead of compression plate 3050 used in the above example, springs 3362 can be used to provide an increasing spring resistance as a connector insert (not shown) that is inserted into connector receptacle locking assembly 3300 is overturned.

Bearing 3320 can pivot about axis 3324 relative to device enclosure 110 and front housing 3310 can rotate axially in bearing 3320 relative to device enclosure. This arrangement allow a connector insert, such as connector insert 1200 in FIG. 13, to move relative to device enclosure 110 (shown in FIG. 1.) For example, connector insert 1200 can rotate relative to device enclosure 110 and bearing 3020 about its primary axis. Connector insert 1200 can also tilt or articulate about axis 3324 relative to device enclosure 110. A connector receptacle, such as connector receptacle 1600 (shown in FIG. 16), can be attached to a rear of front housing 3310 and can rotate and articulate along with connector insert 1200. In such a configuration, bearing 3320 can be a moment-compensator bearing.

This spring resistance can be provided by springs 3362 and spring limiters 3326. Spring limiters 3326 can be tabs or projections from a rear surface of bearing 3320. As before, as the connector insert is overturned, wide portion 3334 of clip 3330 can reach stop 3322 of bearing 3320. Further overturning can distort clip 3330, thereby forcing interference feature 3336 out of a slot or groove on the connector insert, thereby allowing the connector insert to be removed from connector receptacle locking assembly 3300. Also as the connector insert is overturned, a spring force provided by springs 3362 can increase. In this way, a deliberate effort can be required to remove the connector insert from connector receptacle locking assembly 3300.

Figure 34:
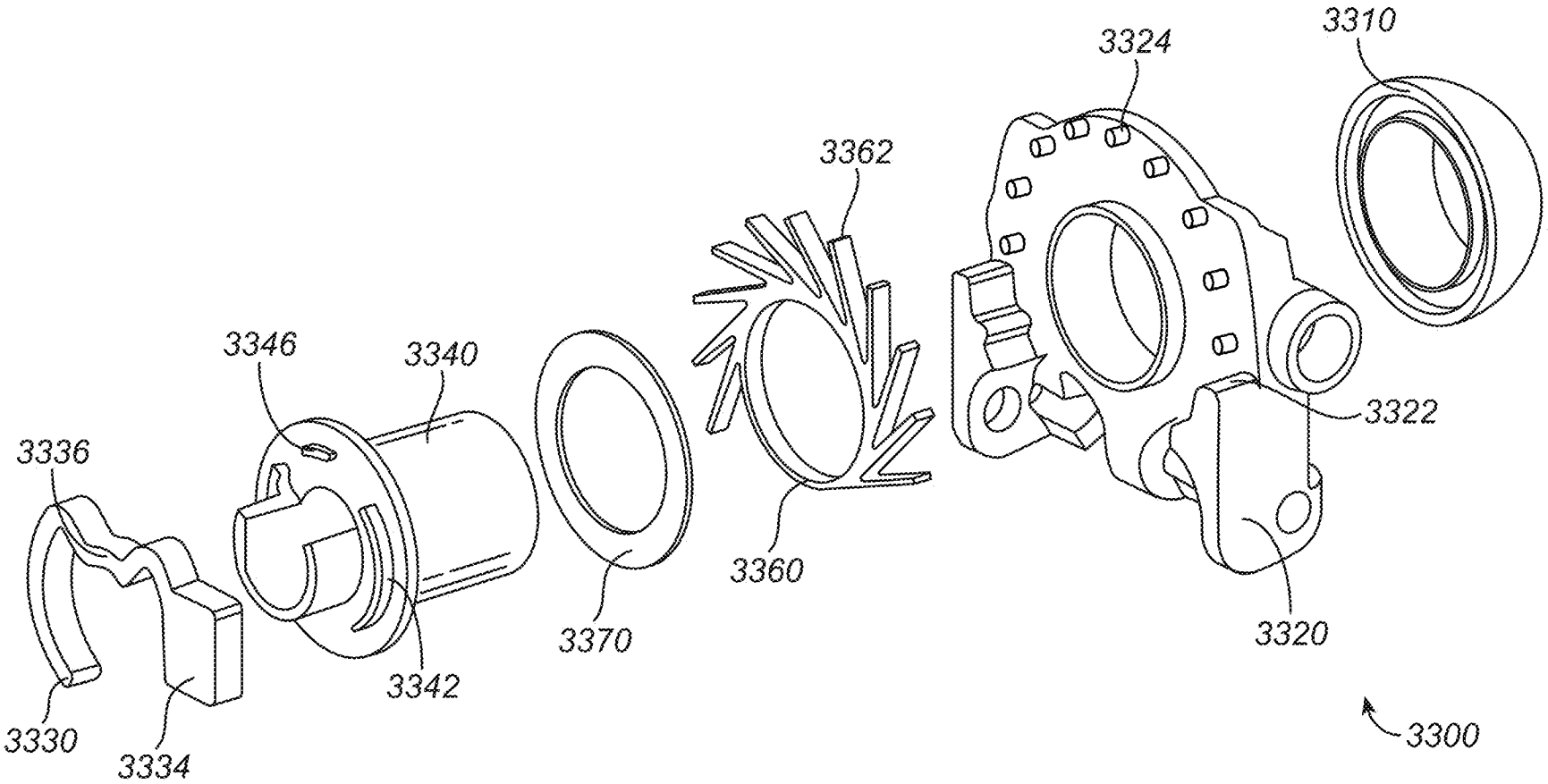
FIG. 34 is an exploded view of the connector receptacle locking assembly of FIG. 33.

FIG. 34 is an exploded view of the connector receptacle locking assembly of FIG. 33. Connector receptacle locking assembly 3300 can include front housing 3310 and bearing 3320. Bearing 3320 can include stop 3322 and spring limiters 3326. Springs 3362 can extend from spring assembly 3360. Clip 3330 can include interference feature 3336 and wide portion 3334 and can fit with raised features 3342 and 3346 on clip carrier 3040. Washer 3370 can be utilized to provide spacing in order to prevent binding between springs 3362 at a rear surface of clip carrier 3340.

These and other embodiments of the present invention can provide other locking mechanisms that use a locking mechanism such as a latch to lock a connector insert in place when a connector insert is inserted into a connector receptacle assembly. To release the connector insert, a sliding mechanism can be actuated to move the latch, whereupon the connector insert can be released. Examples are shown in the following figures.

Figure 35:
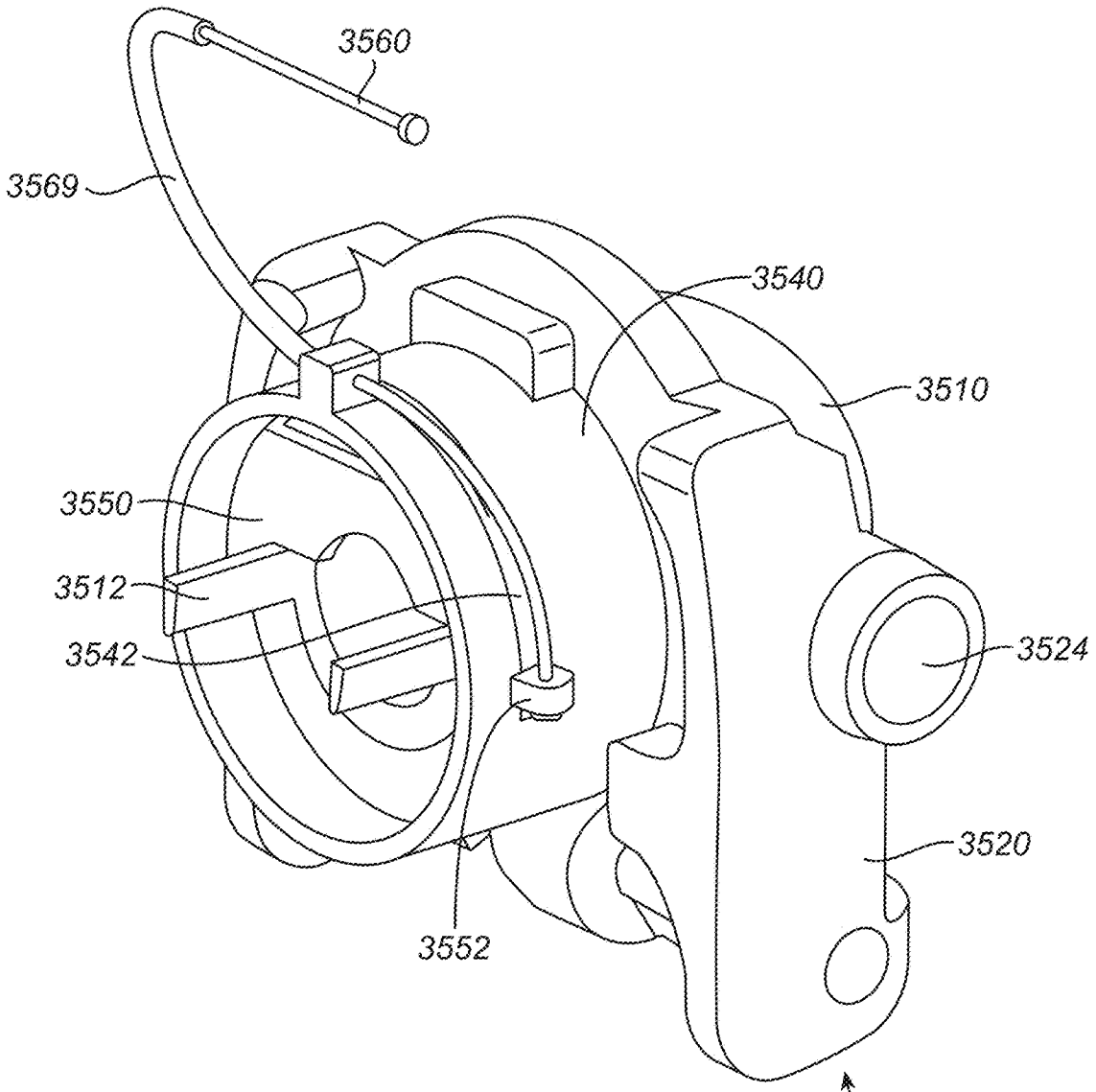
FIG. 35 illustrates a connector receptacle locking assembly according to an embodiment of the present invention.

FIG. 35 illustrates a connector receptacle locking assembly according to an embodiment of the present invention. Connector receptacle locking assembly 3500 can include front housing 3510 having extensions 3512. Extension 3512 can be secured to a connector receptacle, such as connector receptacle 1600 (shown in FIG. 16.) Connector receptacle locking assembly 3500 can further include bearing 3520. Latch collar 3540 can be attached to bearing 3520. Latch collar 3540 can support latch 3550. Latch 3550 can be opened and closed using cable 3560. That is, latch 3550 can be moved between a closed position and an open position. When latch 3550 is in the closed position, latch 3550 can fit in a groove or slot in a connector insert, such as connector insert 1200 (shown in FIG. 13), thereby securing connector insert 1200 in place in connector receptacle locking assembly 3500. When latch 3550 is in the open position, latch 3550 is clear of the groove or slot in connector insert 1200 and connector insert 1200 can be inserted or extracted.

Pulling on cable 3560 can lift point 3552 of latch 3550 in an upward direction as shown to the open position, thereby allowing a connector insert, such as connector insert 1200 (shown in FIG. 12) to be inserted and extracted from connector receptacle locking assembly 3500. To effectuate the movement of latch 3550 to the open position, latch 3550 can pivot about point 3553 (shown in FIG. 37) on a first end of latch 3550 to allow point 3552 on a second end of latch 3550 to move upward through slot 3542 in latch collar 3540. Releasing cable 3560 can allow point 3552 to move downward as shown, thereby moving latch 3550 to the closed position. When connector insert 1200 is inserted into connector receptacle locking assembly 3500, moving latch 3550 into the closed position can place latch 3550 in a groove or slot in connector inset 1200, thereby locking connector insert 1200 in place in connector receptacle locking assembly 3500. Cable 3560 can be protected by sleeve 3569 to reduce friction induced wear.

Bearing 3520 can pivot about axis 3524 relative to device enclosure 110 and front housing 3510 can rotate axially in bearing 3520 relative to device enclosure. This arrangement can allow a connector insert, such as connector insert 1200, to move relative to device enclosure 110 (shown in FIG. 1.) For example, connector insert 1200 can rotate relative to device enclosure 110 and bearing 3520 about its primary axis. Connector insert 1200 can also tilt or articulate about axis 3524 relative to device enclosure 110. A connector receptacle, such as connector receptacle 1600, can be attached to extensions 3512 of front housing 3510 and can rotate and articulate along with connector insert 1200. In such a configuration, bearing 3520 can be a moment-compensator bearing.

In these and other embodiments of the present invention, cable 3560 can be attached to a sliding mechanism on a device enclosure for an electronic device that also supports connector receptacle locking assembly 3500. An example is shown in the following figure.

Figure 36:
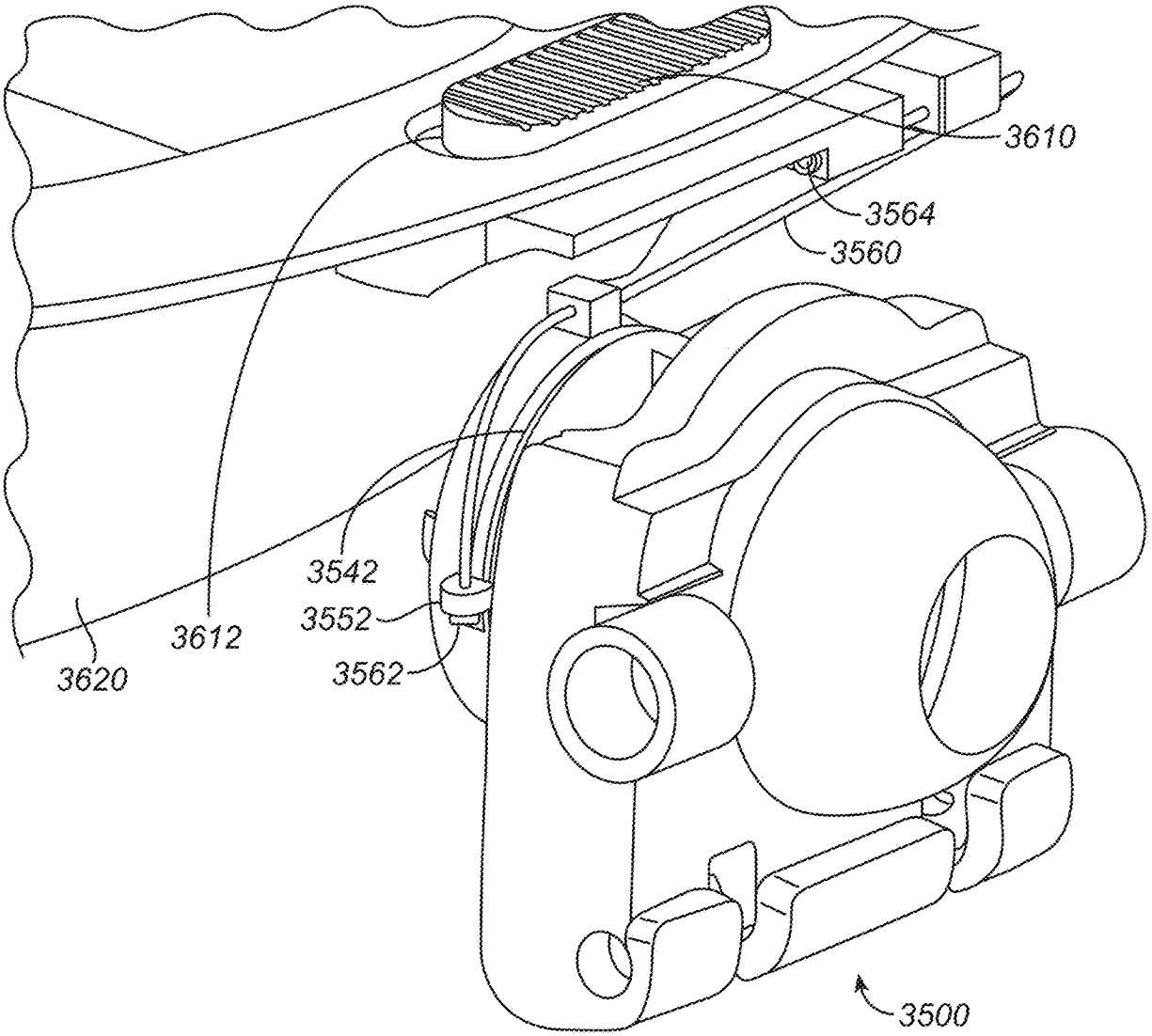
FIG. 36 illustrates the connector receptacle locking assembly of FIG. 35 along with a portion of a device enclosure according to an embodiment of the present illustrates the invention.

FIG. 36 illustrates the connector receptacle locking assembly of FIG. 35 along with a portion of a device enclosure according to an embodiment of the present illustrates the invention. In this example, cable 3560 can terminate at a first end 3564 connected to sliding mechanism 3610. Sliding mechanism 3610 can move between a first position and a second position in opening 3612 in device enclosure 3620. Cable 3650 can terminate at a second end 3562. Second end 3562 can provide a force to point 3552, which can open latch 3550 (shown in FIG. 35) as sliding mechanism 3610 moves to an open position. In this example, sliding mechanism 3610 is shown in the first position and latch 3550 (shown in FIG. 35) is closed. Moving sliding mechanism 3610 in opening 3612 to the second position can pull on cable 3560, which can pull upward on point 3552, thereby moving latch 3550 in slot 3542 to the open position in connector receptacle locking assembly 3500.

Figure 37:
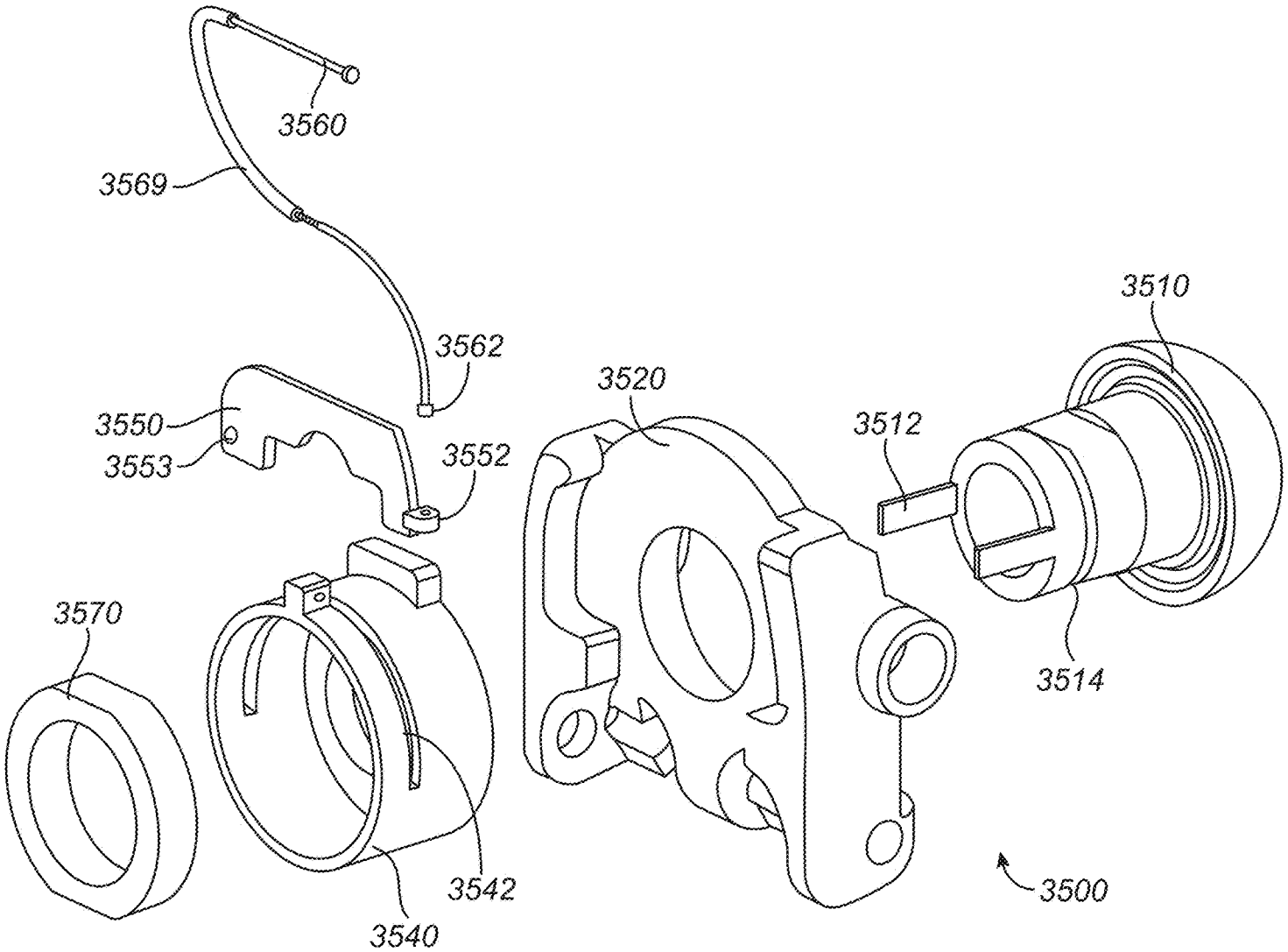
FIG. 37 is an exploded view of the connector receptacle locking assembly FIG. 35.

FIG. 37 is an exploded view of the connector receptacle locking assembly FIG. 35. Connector receptacle locking assembly 3500 can include front housing 3510 for accepting a connector insert, such as connector insert 1200 (shown in FIG. 1200). Front housing 3510 can include extension 3512, which can support a connector receptacle, such as connector receptacle 1600 (shown in FIG. 16). Front housing 3510 can mate with bearing 3520. Latch collar 3540 can fit over rear portion 3514 of front housing 3510. Latch collar 3540 can include slot 3542 for guiding latch 3550. Latch 3550 can rotate about point 3553 when point 3552 is pulled on by second end 3562 of cable 3560. A nut or other fastener 3570 can secure latch collar 3540 to front housing 3510. Cable 3560 can be protected by sleeve 3569.

These and other embodiments of the present invention can provide connector structures that can be implemented in both a connector receptacle and a connector insert. This dual utilization can reduce tooling and design costs since one structure can be used for both the connector receptacle and the connector insert. These connector structures can be symmetrical or otherwise configured such that two such structures can mate when they are placed in opposition and one structure is rotated relative to the other, for example by 90 degree, 180 degrees, or other angle.

The contacts of these dual-use connector structures can have various configurations. Contacts in a connector can mate with corresponding contacts in a corresponding connector, where the contacts and corresponding contacts have mating features such that they form an electrical connection when the connector and corresponding connector are mated. These mating features can be interlocking features, mating surface features, or other features that provide an electrical connection between contacts. For example, contacts formed as pins or prongs in a connector can mate by interlocking with forked contacts in a corresponding connector. In another example, contacts formed as pins or prongs in a connector can mate with contacts having recessed surfaces in corresponding connector.

These different contacts can be symmetrically located in connector structures that are used in both a connector insert and a connector receptacle. The different contacts can be arranged in an alternating fashion in an array, radially, or in another configuration. For example, a connector structure can have contacts in a two-by-two array or radial configuration, where contacts having first mating features are located in opposing corners of the array or radial configuration, and contacts having second mating features are located in the remaining corners of the array or radial configuration. Where contacts having the first interlocking features have a different size than contacts having the second interlocking features, the overall size of the connector structure can be reduced by placing these two types of contacts in an alternating manner.

In one example, a connector structure can include two contacts formed as pins or prongs can be placed in opposing corners, while two forked contacts can be placed in the remaining corners. In another example, a connector structure can include two contacts formed as pins or prongs can be placed in opposing corners, while two contacts having mating recesses can be placed in the remaining corners. Such a connector structure can be mated with an identical connector structure when they are placed in opposition and one is rotated 90 degrees relative to the other. Examples of such connector structures are shown in the following figures.

Figure 38:
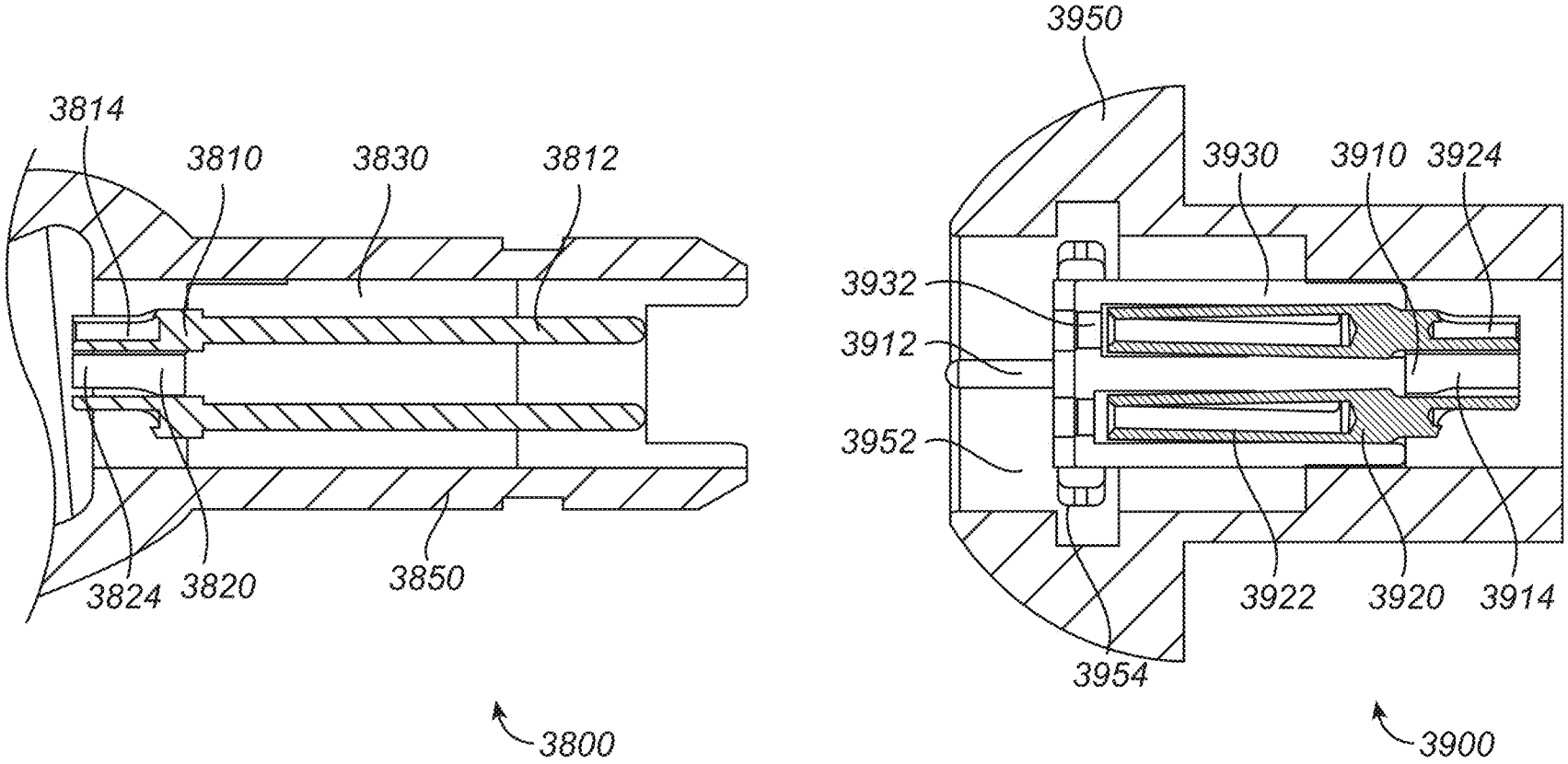
FIG. 38 illustrates a connector insert and a connector receptacle utilizing a common connector structure according to an embodiment of the present invention.

FIG. 38 illustrates a connector insert and a connector receptacle utilizing a common connector structure according to an embodiment of the present invention. Connector insert 3800 can include a connector structure comprising contacts 3810, contacts 3820, and housing 3830. Connector receptacle 3900 can include an identical or similar connector structure comprising contacts 3910, contacts 3920, and housing 3930.

Connector insert 3800 can be mated with connector receptacle 3900 by inserting shell 3850 of connector insert 3800 into opening 3952 in housing 3950 of connector receptacle 3900. Shell 3850 can be conductive and can electrically connect to ground contacts 3954 in housing 3950. In this way, shell 3850 can form a ground path from a first electronic device (not shown) supporting connector insert 3800 to a second electronic device (not shown) housing connector receptacle 3900.

In connector insert 3800, housing 3830 can support contacts 3810 and contacts 3820. Contacts 3810 can include wire terminals 3814. Wires (not shown) from the first electronic device supporting connector insert 3800 and can be crimped, soldered, or otherwise fixed to wire terminals 3814. Contacts 3810 can further include a contacting portion 3812. In this example, contacting portion 3812 can be a mating feature having a prong or pin shape. Contacts 3820 can include wire terminals 3824. Wires (not shown) from the first electronic device supporting connector insert 3800 can be crimped soldered, or otherwise fixed to wire terminals 3824. Contacts 3820 can further include contacting portions (not shown), which can be the same as contacting portions 3922 of contacts 3920.

In connector receptacle 3900, housing 3930 can support contacts 3910 and contacts 3920. Contacts 3910 can include wire terminals 3914. Wires (not shown) from the second electronic device housing connector receptacle 3900 can be crimped, soldered, or otherwise fixed to wire terminals 3914. Contacts 3910 can further include a contacting portion 3912. In this example, contacting portion 3912 can be a mating feature having a prong or pin shape. Contacts 3920 can include wire terminals 3924. Wires (not shown) from the second electronic device supporting connector receptacle 3900 can be crimped soldered, or otherwise fixed to wire terminals 3924. Contacts 3920 can further include contacting portions 3922, which can be a mating feature having a forked shape.

In this example, when connector insert 3800 is mated with connector receptacle 3900, the prong or pin-shaped contacting portions 3812 of contacts 3810 can fit in and contact with forked-shaped contacting portions 3922 of contacts 3920. Contacting portions 3812 of contacts 3810 can access contacting portions 3922 of contacts 3920 via passages 3932 in housing 3930. Similarly, the prong or pin-shaped contacting portions 3912 of contacts 3910 can fit in and contact with forked-shaped contacting portions (not shown) of contacts 3820. In this way, data, power, and other electronic signals can be shared between the first electronic device and the second electronic device through a path including wires in the first electronic device, contacts 3810 and contacts 3820, contacts 3910, contacts 3920, and wires in the second electronic device. An example is shown in the following figure.

Figure 39:
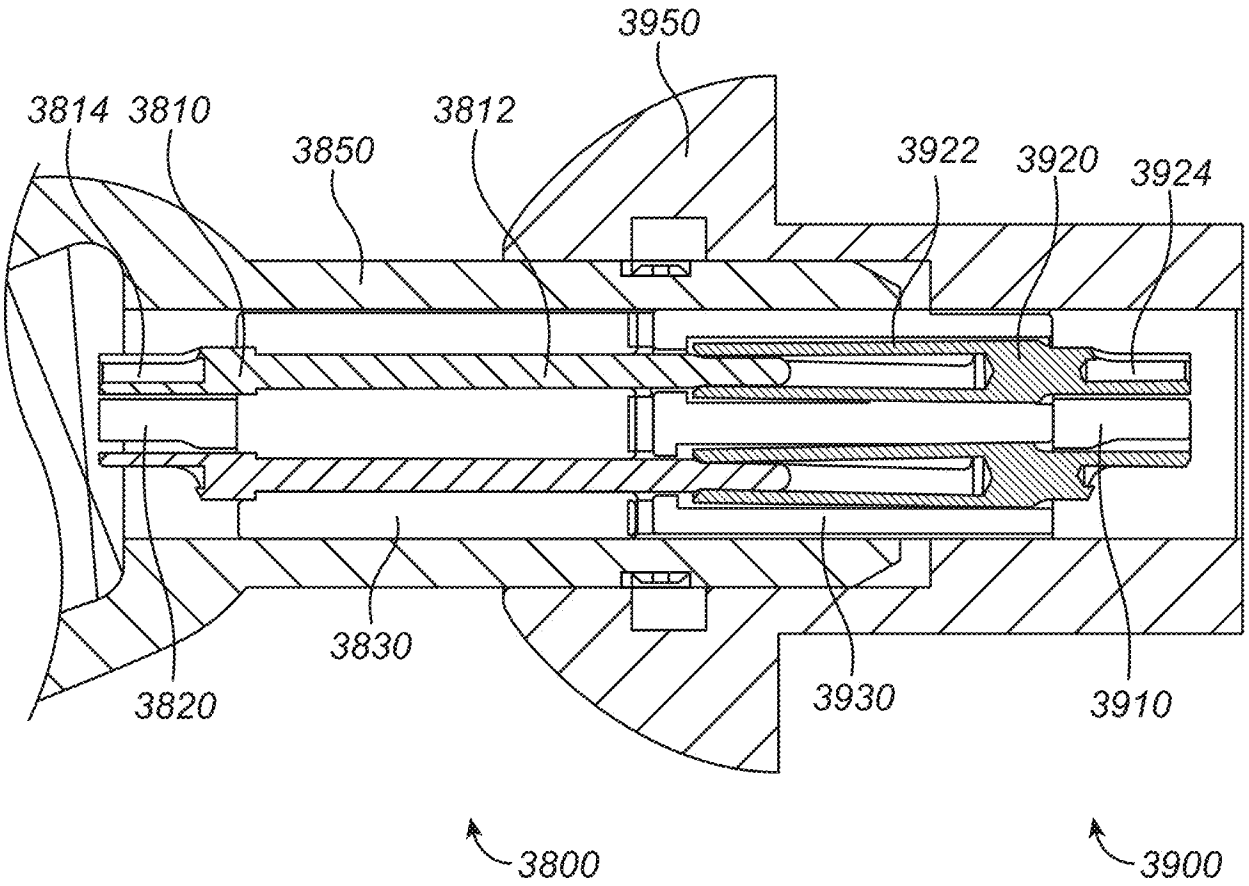
FIG. 39 illustrates a connection between a connector insert and a connector receptacle utilizing a common connector structure according to an embodiment of the present invention.

FIG. 39 illustrates a connection between a connector insert and a connector receptacle, each utilizing a common connector structure according to an embodiment of the present invention. Connector insert 3800 can include housing 3830 inside shell 3850. Housing 3830 can support contacts 3810. Contacts 3810 can include wire terminals 3814. Wires (not shown) in a first electronic device (not shown) supporting connector insert 3800 can be crimped, soldered, or otherwise fixed to wire terminals 3814. Contacts 3810 can further include contacting portions 3812, shown in this example as having prong or pin shaped mating features.

Contacting portions 3812 can fit in and mate with contacting portions 3922 of contacts 3920, which in this example can have fork-shaped mating portions. Contacts 3920 can further include wire terminals 3924. Wire terminals 3924 can be connected to wires (not shown) in a second electronic device housing connector receptacle 3900. Connector receptacle 3900 can further include housing 3950, which can support housing 3930. Housing 3930 can be formed around and can support contacts 3910.

Connector insert 3800 can further include contacts 3820, which can be the same as or similar to contacts 3920 in connector receptacle 3900. Similarly, connector receptacle 3900 can further include contacts 3910, which can be the same or similar to contacts 3810 in connector insert 3800.

Figure 40:
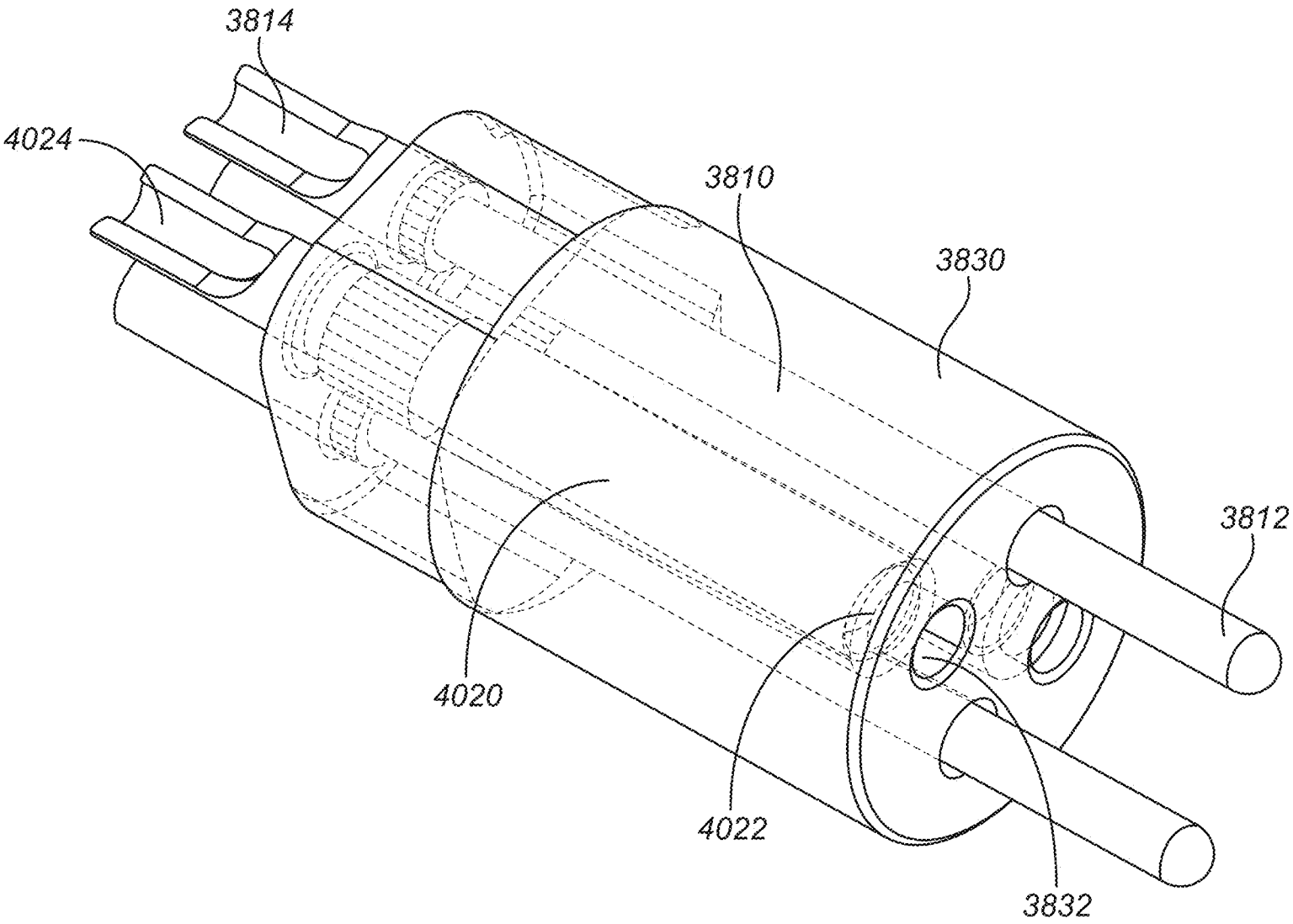
FIG. 40 illustrates another connector portion according to an embodiment of the present invention.

FIG. 40 illustrates another connector portion according to an embodiment of the present invention. The illustrated connector portion can be used in both a connector insert and a connector receptacle, such as connector insert 3800 and connector receptacle 3900 (shown in FIG. 38.) In this example, contacts 4020 can be utilized in place of contacts 3820 (or 3920), and have a different mating feature for contacting portion 4022, as compared to the mating feature of contacting portion 3822 of contacts 3820. Specifically, in this example, contacting portion 4022 can include a recessed mating feature, as opposed to the fork-shaped mating feature of contacts 3820 (and 3920.)

In this example, housing 3830 can support contacts 3810 and contacts 4020. Housing 3830 can be formed of plastic, nylon, or other nonconductive material. Housing 3830 can be insert or injection molded around contacts 3810 and contacts 4020. Contacts 3810 and contacts 4020 can be formed of copper, brass, steel, or other conductive material. Contacts 3810 can be plated, for example to improve conductivity and reduce corrosion. Contacts 3810 can include wire terminals 3814 and contacting portions 3812 having a prong or pin shaped mating feature. Contacts 4020 can include wire terminal portions 4024 and contacting portion 4022, again having a recessed mating feature. A corresponding contact in a corresponding connector portion can mate with contacting portion 4022 of contact 4020 via opening 3832 in housing 3830. The insertion of a prong-shaped mating feature into opening 3832 can provide friction to help to secure a connector insert in place in a corresponding connector receptacle.

Figure 41:
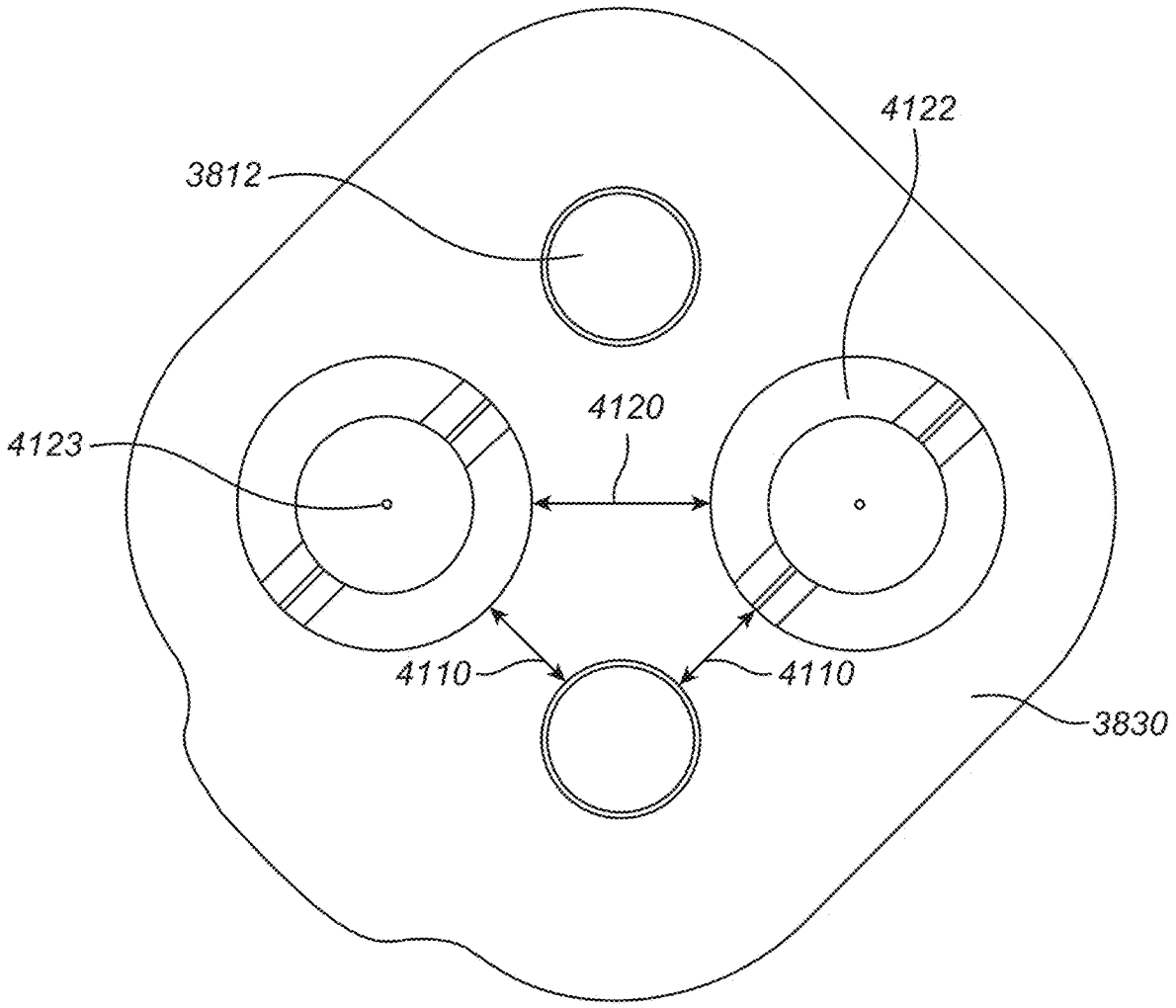
FIG. 41 illustrates a front view of a connector portion according to an embodiment of the present invention.

FIG. 41 illustrates a front view of a connector portion according to an embodiment of the present invention. As before, housing 3830 can support contacts having contacting portions 4022 and 3812. Contacting portions 4022 can include a recessed portion 4023.

In this example, contacting portions 4012 and 3812 can be arranged in a two-by-two array, which can be the same as contacting portions 4012 and 3812 being radially placed 90° from each other. As shown, a cross-section area of contacting portion 3812 can be smaller than a cross-section of contacting portion 4012. This reduced cross-section area can allow a spacing 4120 between opposing contacting portions to be reduced while maintaining spacing 4010 between adjacent contacting portions. This can provide for connector portions having a smaller cross-sectional area as compared to a connector portion having four contacting portions 4022.

In various embodiments of the present invention, contacts, ground rings, shield, and other conductive portions of a connector receptacles and connector inserts can be formed by stamping, forging, metal-injection molding, machining, micro-machining, 3-D printing, or other manufacturing process. The conductive portions can be formed of stainless steel, steel, copper, copper-titanium, phosphor-bronze, or other material or combination of materials. They can be plated or coated with electroless nickel, nickel, gold, or other material. The nonconductive portions, such as the housings and other structures can be formed using injection or other molding, 3-D printing, machining, or other manufacturing process. The nonconductive portions can be formed of silicon or silicone, rubber, hard rubber, plastic, nylon, liquid-crystal polymers (LCPs), ceramics, or other nonconductive material or combination of materials.

Embodiments of the present invention can provide connector receptacles, connector receptacle assemblies, and connector inserts that can be located in, or can connect to, various types of devices, such as portable computing devices, tablet computers, desktop computers, laptop computers, all-in-one computers, wearable computing devices such as smart watches, headphones, earbuds, cell phones, smart phones, media phones, storage devices, portable media players, navigation systems, monitors, power supplies, audio devices, video delivery systems, adapters, styluses, remote control devices, chargers, and other devices. These connector receptacles and connector inserts can provide pathways for signals that are compliant with various standards such as one of the Universal Serial Bus standards including USB Type-C, High-Definition Multimedia Interface®, Digital Visual Interface, Ethernet, DisplayPort, Thunderbolt™, Lightning™, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention can provide connector receptacles and connector inserts that can be used to provide a reduced set of functions for one or more of these standards. In various embodiments of the present invention, these connector receptacles and connector inserts can be used to convey power, ground, signals, test points, and other voltage, current, data, or other information.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having a front cavity to accept a corresponding connector insert;

a first plurality of contacts supported by the housing, each of the first plurality of contacts comprising a contacting portion exposed in the front cavity to electrically connect to a corresponding contact of the corresponding connector insert when the corresponding connector insert is mated with the connector receptacle, each of the first plurality of contacts further comprising a post extending from the housing;

a shield substantially around a rear and sides of the housing; and a flexible circuit board comprising a first end attached to the post of each of the first plurality of contacts and a second end, the second end supporting a second plurality of contacts, wherein the flexible circuit board further comprises an excess length between the first end and the second end, such that the housing, the first plurality of contacts, the shield, and the first end of the flexible circuit board can rotate about an axis while the second end of the flexible circuit board and the second plurality of contacts remain stationary.

2. The connector receptacle of claim 1 wherein the housing comprises a first housing portion having the front cavity, a second housing portion supporting a first contact and a second contact in the first plurality of contacts, and a third housing portion supporting a third contact and a fourth contact in the first plurality of contacts.

3. The connector receptacle of claim 2 wherein the shield comprises a slot, and wherein the first end of the flexible circuit board passes through the slot and is attached to the post of each of the first plurality of contacts.

4. The connector receptacle of claim 3 wherein the flexible circuit board further comprises a ground contact, wherein the ground contact is attached to an outside surface of the shield.

5. The connector receptacle of claim 4 further comprising a bracket, wherein the bracket comprises a back side attached to a back side of the shield, and two arms, each arm terminating in a side ground contact, wherein the side ground contacts are exposed in sides of the front cavity.

6. The connector receptacle of claim 5 wherein each of the first plurality of contacts is electrically connected to a corresponding contact in the second plurality of contacts through a corresponding trace of the flexible circuit board.

7. The connector receptacle of claim 1 further comprising:

a locking assembly supporting the connector receptacle and comprising:

a bearing having a central opening;

a front housing having a front opening to accept the corresponding connector insert, the front opening in front of the bearing, the front housing extending through the central opening and having a rear portion behind the bearing;

a latch collar around the rear portion of the front housing, the latch collar having a slot; and a latch positioned in the slot and movable between a closed position and an open position, wherein when the latch is in the closed position and the connector insert is inserted in the connector receptacle, the latch is positioned in a groove in the connector insert and the connector insert is locked in place in the locking assembly, and wherein when the latch is in the open position, the latch is not positioned in the groove in the connector insert and the connector insert is not locked in place in the locking assembly.

8. The connector receptacle of claim 7 wherein the latch rotates in the slot around a first point at a first end of the latch and is attached to a first end of a cable at a second point at a second end of the latch.

9. The connector receptacle of claim 8 wherein a second end of the cable is attached to a sliding mechanism, and when the sliding mechanism is in a first position the latch is in the closed position and when the sliding mechanism is in a second position, the latch is in the open position.

10. The connector receptacle of claim 1 wherein the connector receptacle comprises a first connector portion and the corresponding connector insert comprises a second connector portion, wherein the first connector portion and the second connector portion are identical, wherein first connector portion comprises the first plurality of contacts and the housing, the first plurality of contacts comprising:

a first contact having a first type of contacting portion; and a second contact diagonally adjacent to the first contact and having the first type of contacting portion, the first connector portion further comprising:

a third contact horizontally adjacent to the first contact and having a second type of contacting portion, the second type of contacting portion different than the first type of contacting portion; and a fourth contact vertically adjacent to the first contact and having the second type of contacting portion, wherein when the connector insert and connector receptacle are mated, a contacting portion of a first contact of the connector insert physically and electrically connects to the contacting portion of the third contact of the connector receptacle.

11. The connector receptacle of claim 1 further comprising:

a locking assembly supporting the connector receptacle and comprising:

a bearing having a central opening;

a front housing having a front opening to accept the corresponding connector insert, the front opening in front of the bearing, the front housing extending through the central opening and having a rear portion behind the bearing, wherein the rear portion comprises a cutout; and a clip having an interference portion positioned in the cutout such that the interference portion fits in a groove in the connector insert to hold the connector insert in place when the connector insert is inserted in the connector receptacle.

12. The connector receptacle of claim 11 wherein rotating the connector insert around a central axis of the front housing distorts the clip such that the interference portion exits the groove in the connector insert and allows the connector insert to be removed.

13. A connector receptacle comprising a housing having a passage to accept a connector insert, the passage terminating in a front cavity;

a first plurality of contacts supported by the housing, each of the first plurality of contacts comprising a contacting portion exposed in the front cavity to electrically connect to a corresponding contact of the connector insert when the connector insert is mated with the connector receptacle, each of the first plurality of contacts further comprising a post extending from the housing; and a shield substantially around a rear and sides of a rear portion of the housing, wherein the inside surface of the passage in the housing comprises a concave portion, and wherein when the connector insert is inserted into the connector receptacle, a locking object can be positioned in the concave portion to secure the connector insert in the connector receptacle, wherein the locking object comprises a coil spring.

14. The connector receptacle of claim 13 wherein the coil spring comprises a canted coil spring.

15. The connector receptacle of claim 14 wherein the concave portion comprises a circumferential groove in the inside surface of the housing.

16. A connector receptacle comprising a housing having a passage to accept a connector insert, the passage terminating in a front cavity;

a first plurality of contacts supported by the housing, each of the first plurality of contacts comprising a contacting portion exposed in the front cavity to electrically connect to a corresponding contact of the connector insert when the connector insert is mated with the connector receptacle, each of the first plurality of contacts further comprising a post extending from the housing; and a shield substantially around a rear and sides of a rear portion of the housing, wherein the inside surface of the passage in the housing comprises a concave portion, and wherein when the connector insert is inserted into the connector receptacle, a locking object can be positioned in the concave portion to secure the connector insert in the connector receptacle, wherein the locking object comprises a sphere.

17. The connector receptacle of claim 16 wherein the concave portion comprises a notch in the inside surface of the housing.

18. The connector receptacle of claim 17 wherein the sphere is located on the connector insert and when the connector insert is inserted in the connector receptacle, the locking object can be positioned in a first position in the concave portion to secure the connector insert in the connector receptacle, and the locking object can be positioned in a second position such that the connector insert can be removed from the connector receptacle.

19. A connector receptacle comprising a housing having a passage to accept a connector insert, the passage terminating in a front cavity;

a first plurality of contacts supported by the housing, each of the first plurality of contacts comprising a contacting portion exposed in the front cavity to electrically connect to a corresponding contact of the connector insert when the connector insert is mated with the connector receptacle, each of the first plurality of contacts further comprising a post extending from the housing;

a shield substantially around a rear and sides of a rear portion of the housing, wherein the inside surface of the passage in the housing comprises a concave portion, and wherein when the connector insert is inserted into the connector receptacle, a locking object can be positioned in the concave portion to secure the connector insert in the connector receptacle; and a flexible circuit board having a first end attached to the post of each of the first plurality of contacts and a second end, the second end supporting a second plurality of contacts, wherein the flexible circuit board further comprises an excess length between the first end and the second end, such that the housing, the first plurality of contacts, the shield, and the first end of the flexible circuit board can rotate about an axis while the second end of the flexible circuit board and the second plurality of contacts remain stationary.

* * * * *